US010283885B2

(12) United States Patent
Little et al.

(10) Patent No.: US 10,283,885 B2
(45) Date of Patent: May 7, 2019

(54) ELECTRICAL CONNECTOR ASSEMBLY AND SYSTEM USING THE SAME

(71) Applicant: FOXCONN INTERCONNECT TECHNOLOGY LIMITED, Grand Cayman (KY)

(72) Inventors: Terrance F. Little, Fullerton, CA (US); Yuan Zhang, Rowland-Heights, CA (US); An-Jen Yang, Irvine, CA (US); Jie Zheng, Rowland-Heights, CA (US); Yuan-Chieh Lin, Lake Forest, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/333,469

(22) Filed: Oct. 25, 2016

(65) Prior Publication Data

US 2017/0133777 A1 May 11, 2017

Related U.S. Application Data

(60) Provisional application No. 62/252,419, filed on Nov. 6, 2015.

(51) Int. Cl.

| | |
|---|---|
| ***H01R 12/00*** | (2006.01) |
| ***H01R 12/71*** | (2011.01) |
| ***H01R 12/75*** | (2011.01) |
| ***H01R 13/405*** | (2006.01) |
| ***H01R 13/50*** | (2006.01) |

(Continued)

(52) U.S. Cl.

CPC ..... *H01R 12/716* (2013.01); *H01R 12/75* (2013.01); *H01R 13/405* (2013.01); *H01R 13/50* (2013.01); *H01R 13/6275* (2013.01); *H01R 13/646* (2013.01); *H01R 13/665* (2013.01); *H01R 24/60* (2013.01); *H01R 2107/00* (2013.01); *H01R 2201/06* (2013.01)

(58) Field of Classification Search

CPC ..... H01R 12/716; H01R 12/75; H01R 12/79; H01R 13/405; H01R 13/50; H01R 13/6275; H01R 13/646; H01R 13/665; H01R 24/60; H01R 2107/00; H01R 2201/06

USPC ..... 439/65, 74, 76.1, 502

See application file for complete search history.

(56) References Cited

U.S. PATENT DOCUMENTS 4,981,438 A * 1/1991 Bekhiet ..... H02B 1/202 439/502

6,971,887 B1 * 12/2005 Trobough ..... H05K 7/1092 439/71

(Continued)

*Primary Examiner* — Khiem Nguyen

(74) *Attorney, Agent, or Firm* — Wei Te Chung; Ming Chieh Chang

(57) ABSTRACT

An electrical cable connector assembly comprises a receptacle connector mated with a plug/cable connector. The receptacle connector mounted upon an external printed circuit board and includes an insulative housing forming a mating cavity, and a terminal module assembly received within the housing with contacting sections exposed in the mating cavity. The cable connector includes an internal printed circuit board with a contact module fixed at a front end region and a cable having a plurality of wires fixed at a rear end region in a multilevel manner. A die-casting cover encloses the internal printed circuit board with heat dissipation fin structure on an exterior surface.

20 Claims, 70 Drawing Sheets

(51) Int. Cl.

| | |
|---|---|
| ***H01R 13/627*** | (2006.01) |
| ***H01R 13/646*** | (2011.01) |
| ***H01R 13/66*** | (2006.01) |
| ***H01R 24/60*** | (2011.01) |
| *H01R 107/00* | (2006.01) |

(56) References Cited

U.S. PATENT DOCUMENTS

| | | | | |
|---|---|---|---|---|
| 7,148,428 | B2 * | 12/2006 | Meier | G06F 1/184 174/260 |
| 7,794,241 | B2 | 9/2010 | Bright et al. | |
| 8,371,882 | B1 | 2/2013 | Szczesny et al. | |
| 8,708,729 | B2 * | 4/2014 | An | H01R 12/79 439/331 |
| 8,840,432 | B2 | 9/2014 | Alden, III et al. | |
| 2015/0285986 | A1 | 10/2015 | Wu et al. | |
| 2016/0149324 | A1 | 5/2016 | Regnier | |

* cited by examiner

540

540

ELECTRICAL CONNECTOR ASSEMBLY AND SYSTEM USING THE SAME

BACKGROUND OF THE INVENTION

1. Field of the Invention

The present invention relates generally to an electrical connector assembly and system using the same, more particularly to the system with an internal printed circuit board having a contact module at a front end region and a multilevel wires connected at a rear end region. Furthermore, such electrical connector assembly is used on an add-on card which is further connected with a jumper cable in a connection system on a main printed circuit board.

2. Description of Related Arts

The electrical cable connector approaches 25 G now. A new structure that endures the high frequency and high speed while promptly removing the corresponding heat is required.

SUMMARY OF THE INVENTION

An electrical cable connector assembly comprises a receptacle connector mated with a plug/cable connector. The receptacle connector mounted upon an external printed circuit board and includes an insulative housing forming a mating cavity, and a terminal module assembly received within the housing with contacting sections exposed in the mating cavity. The cable connector includes an internal printed circuit board with a contact module fixed at a front end region and a cable having a plurality of wires fixed at a rear end region in a multilevel manner. A die-casting cover encloses the internal printed circuit board with heat dissipation fin structure on an exterior surface. A thermal interface material is sandwiched between an electronic component, which is mounted upon the internal printed circuit board, and an interior surface of the cover for heat dissipation. A latch and a pull tape is disposed around a rear end of the cover for disengaging the cable connector from a correspond cage. Moreover, a main board includes a CPU side region on which a CPU is mounted, and an add-on card region on which an add-on card is mounted. A connection system includes a jumper cable having connectors on two opposite ends respectively connected to the CPU and the add-on card. The receptacle connector is mounted around the add-on card to mate with the cable connector.

DETAILED DESCRIPTION OF THE PREFERRED EMBODIMENT

Figure 1:
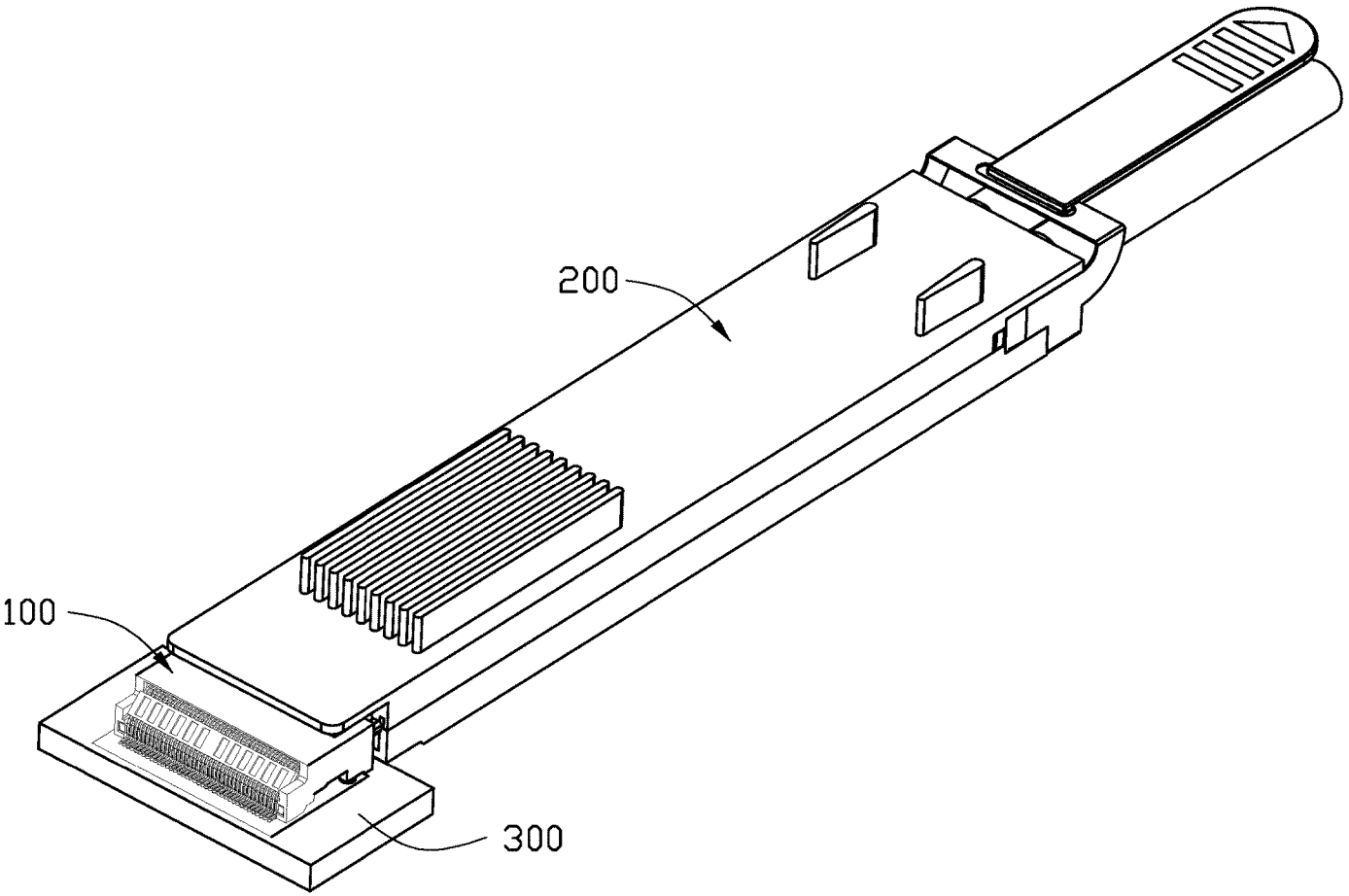
FIG. 1 is a perspective view of a receptacle connector and a cable connector mated with each other in accordance with the present invention.
Figure 2A:
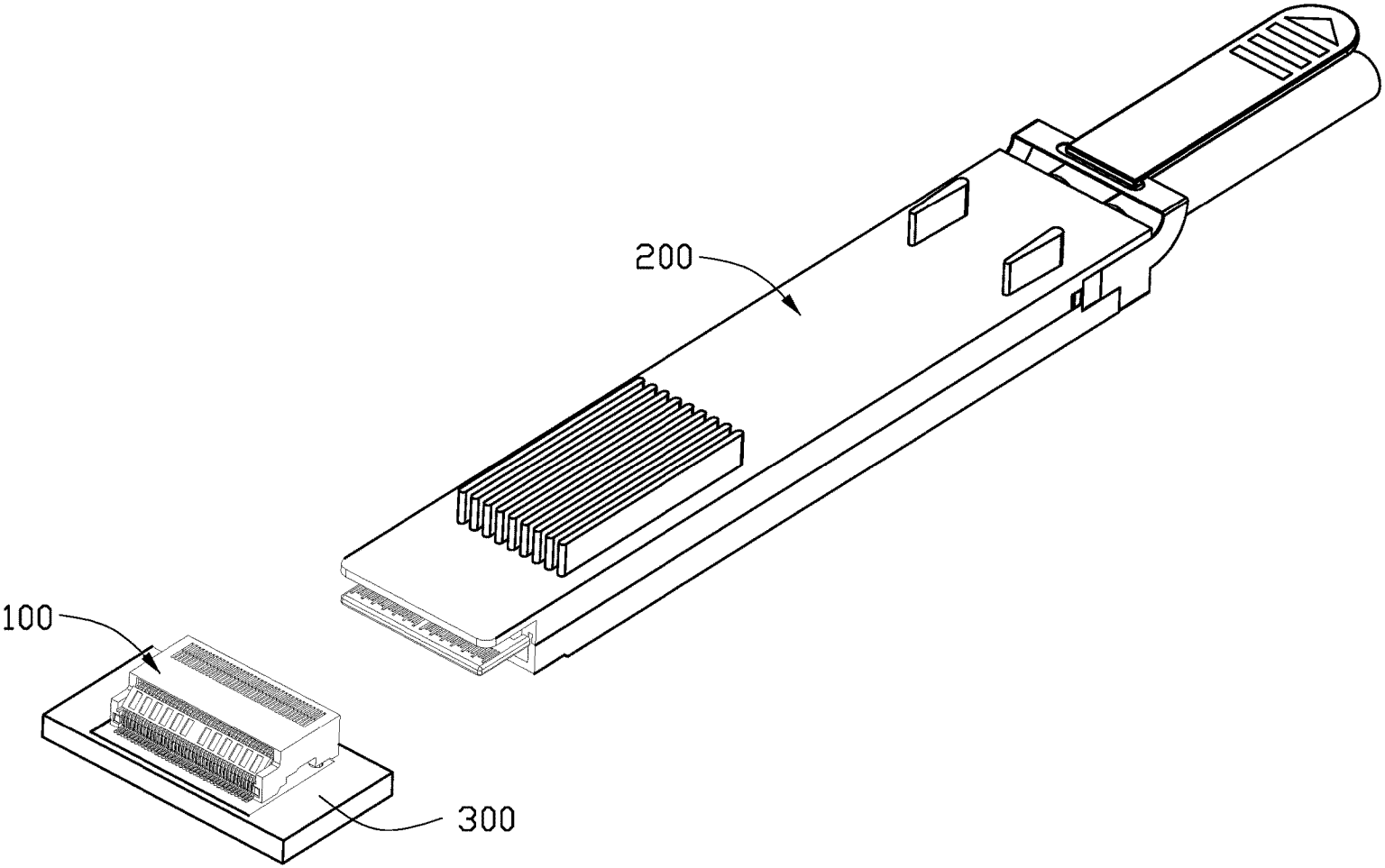
FIG. 2(A) is a perspective view of the receptacle connector and the cable connector of FIG. 1 in an unmated status.
Figure 2B:
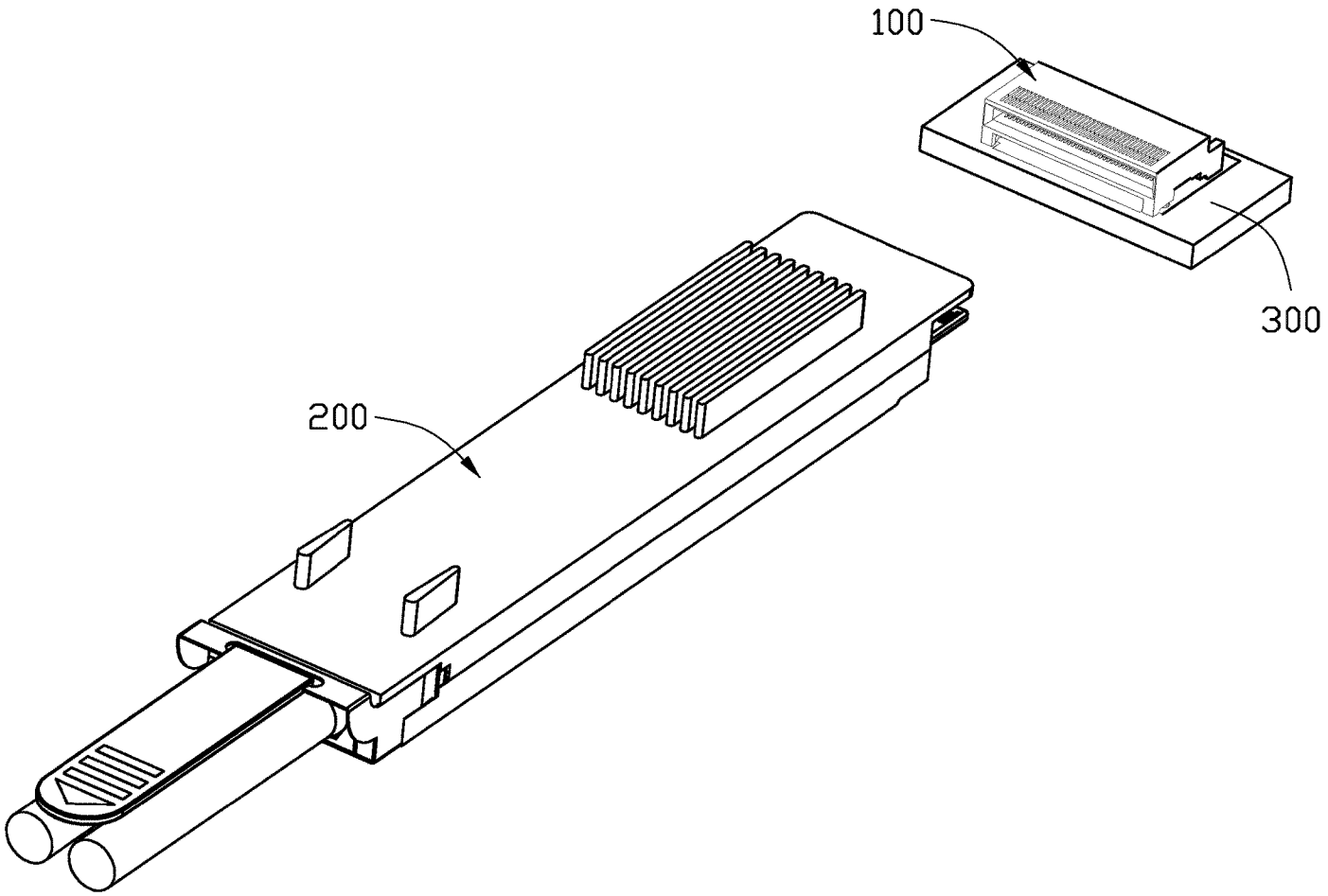
FIG. 2(B) is another perspective view of the receptacle connector and cable connector of FIG. 2.
Figure 3A:
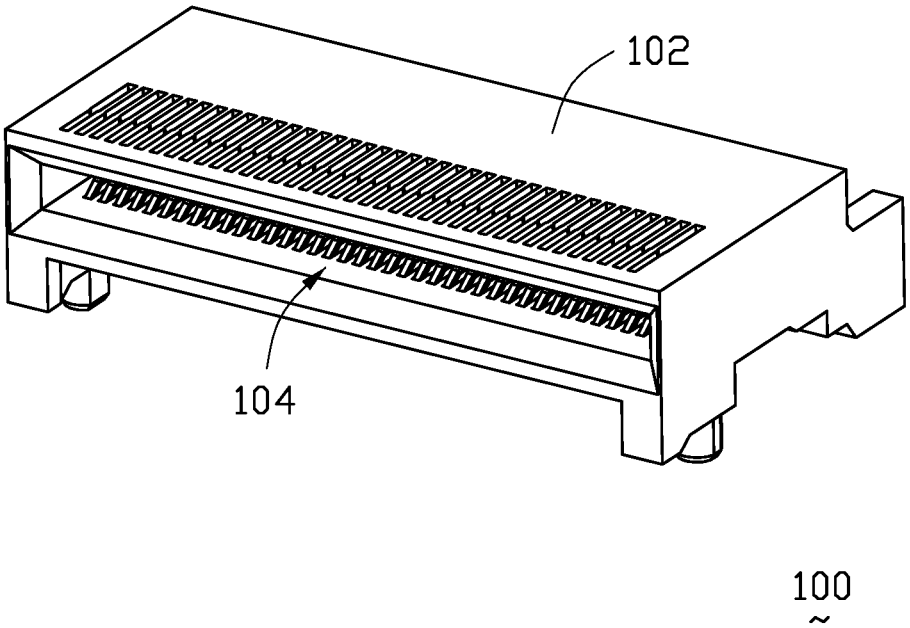
FIG. 3(A) is a perspective view of the receptacle connector of FIG. 1.
Figure 3B:
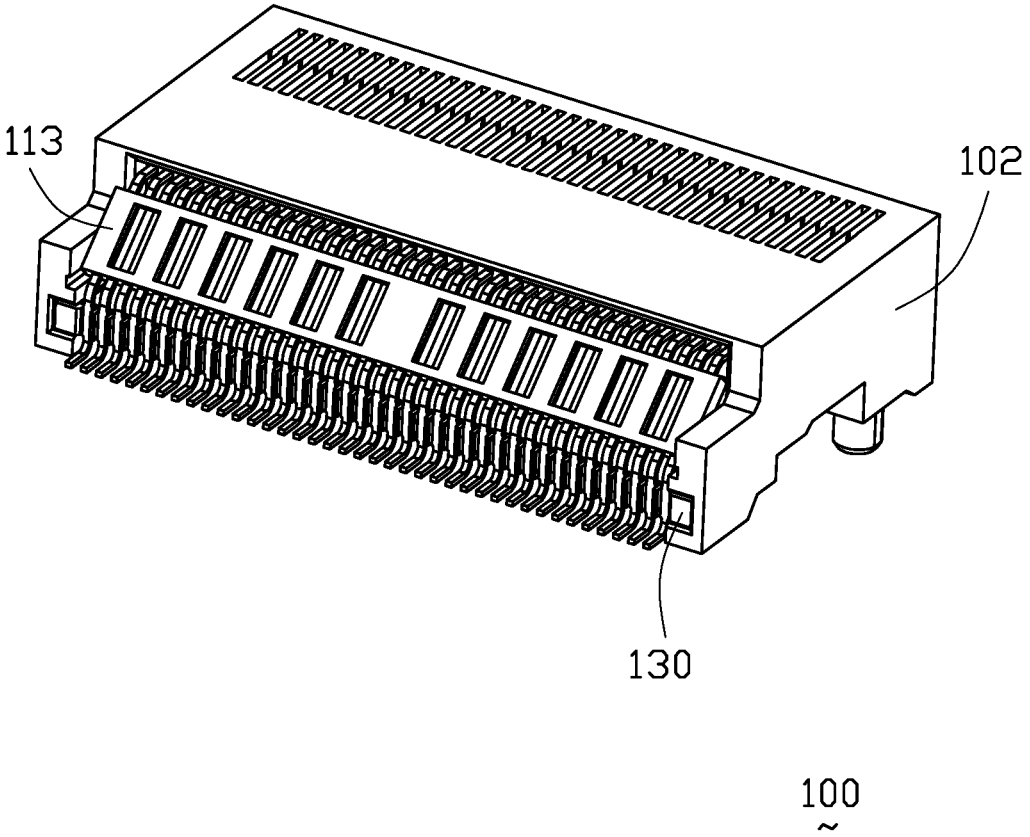
FIG. 3(B) is another perspective view of the receptacle connector of FIG. 4.
Figure 4A:
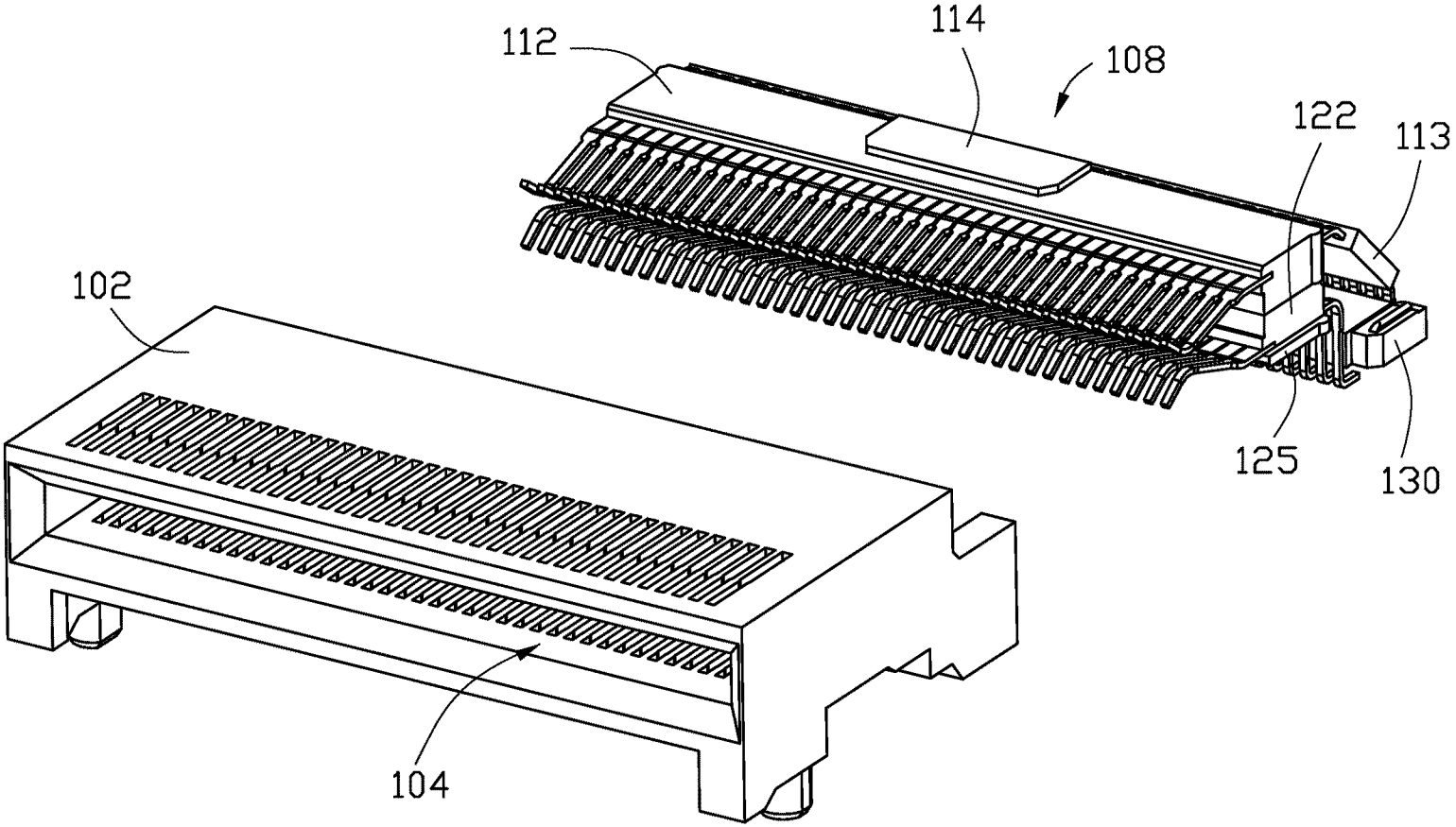
FIG. 4(A) is an exploded perspective view of the receptacle connector of FIG. 3(A)
Figure 4B:
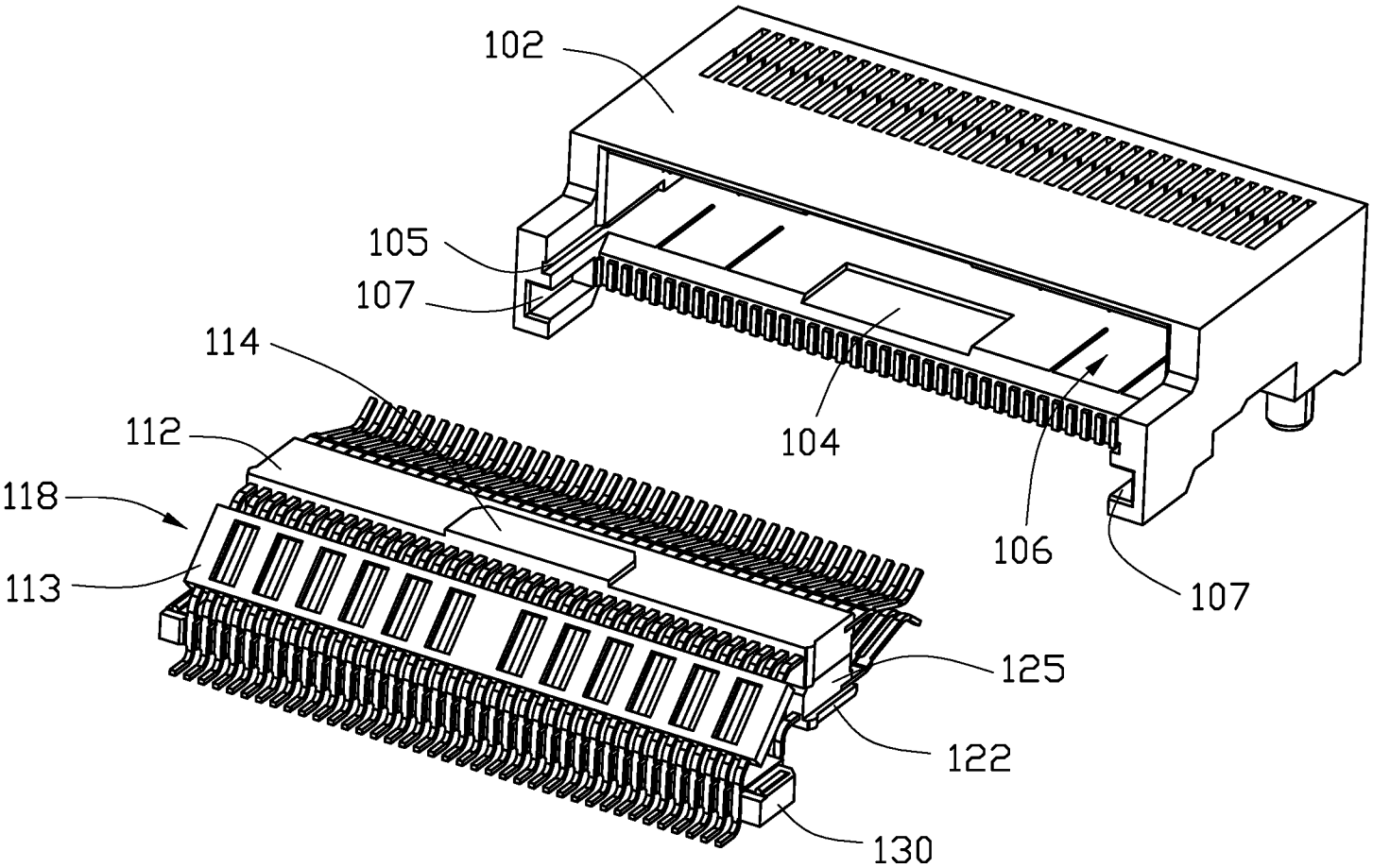
FIG. 4(B) is another exploded perspective view of the receptacle connector of FIG. 1.
Figure 5A:
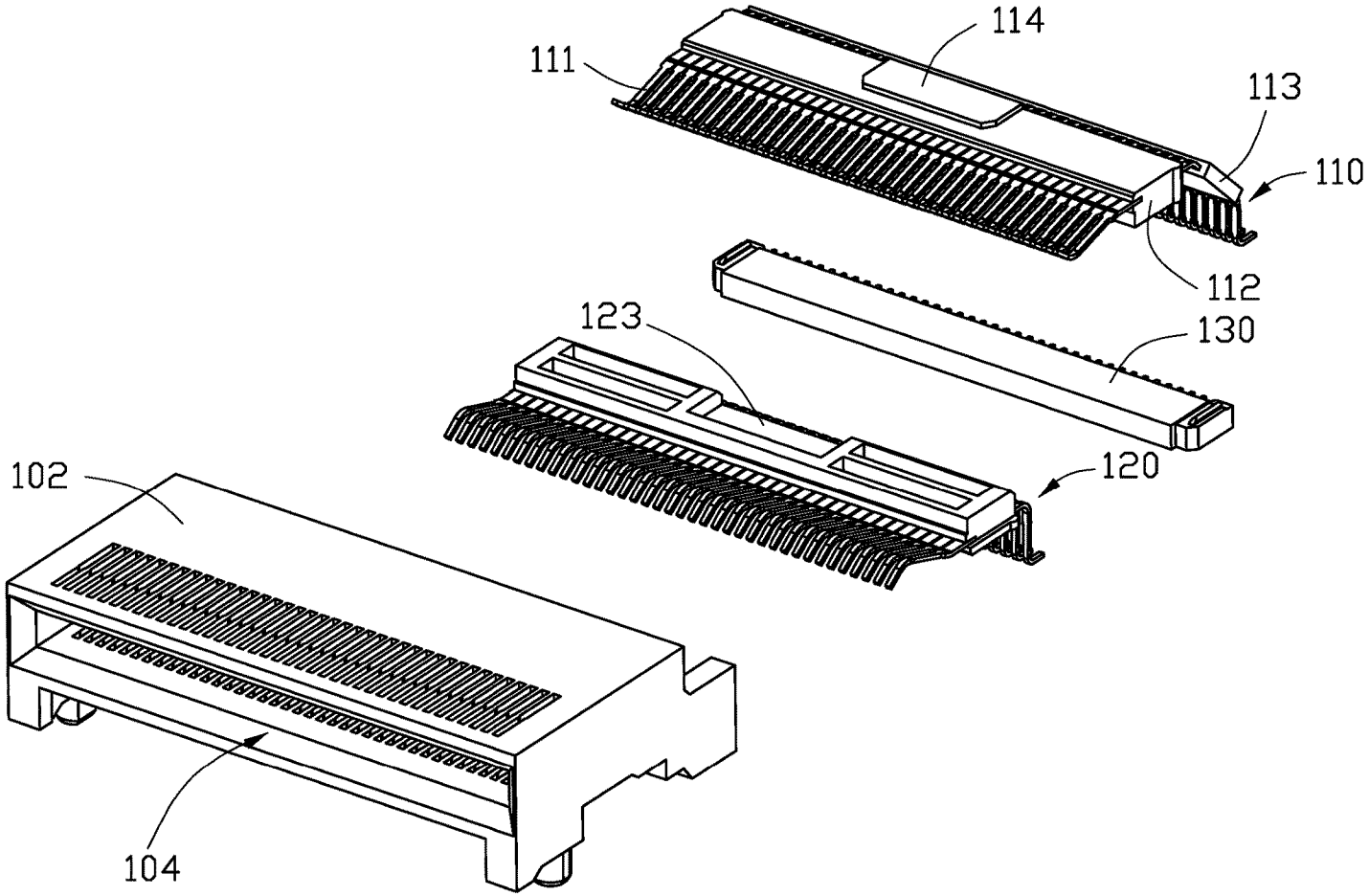
FIG. 5(A) is a further exploded perspective view of the receptacle connector of FIG. 4(A)
Figure 5B:
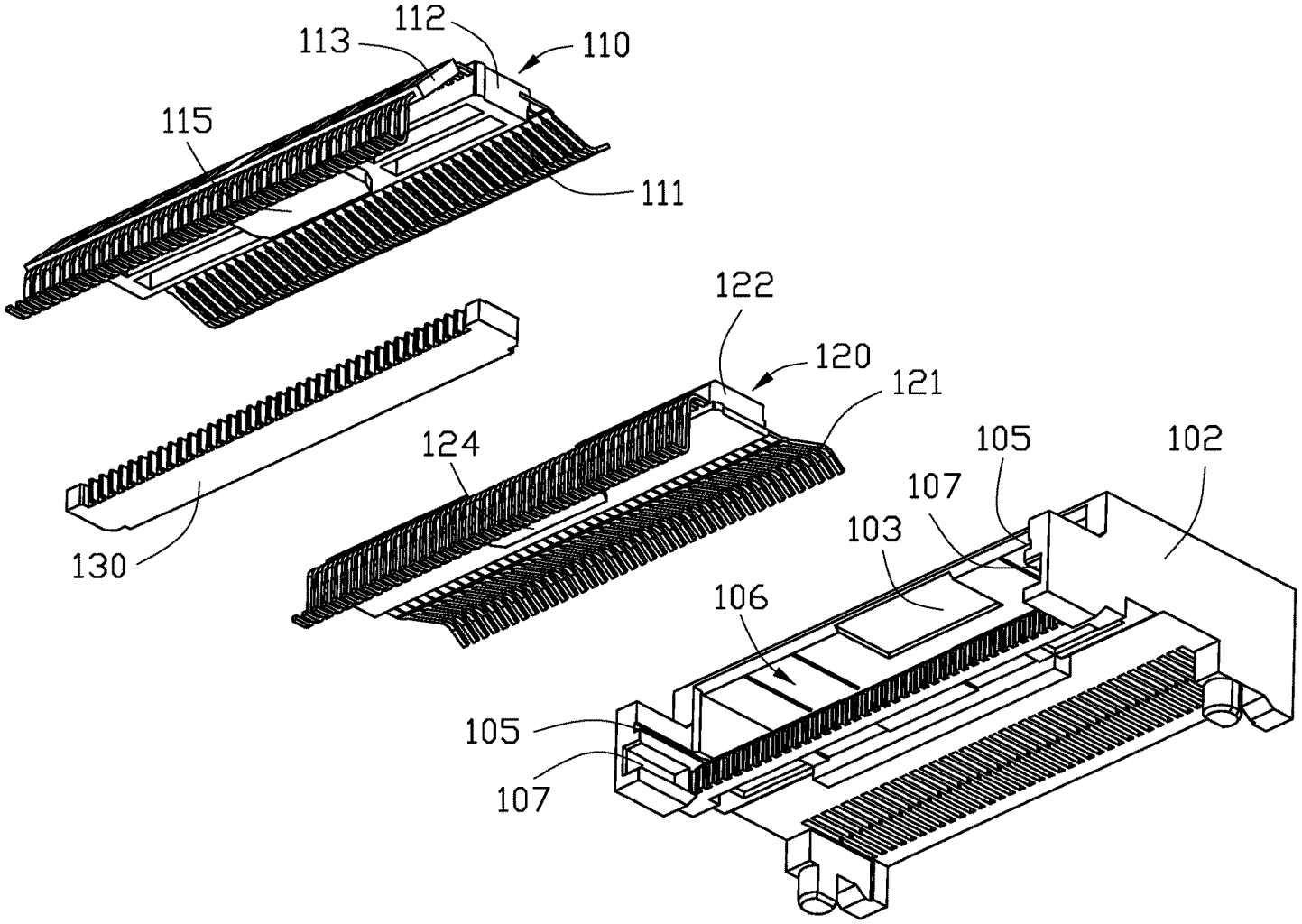
FIG. 5(B) is another exploded perspective view of the receptacle connector of FIG. 4(B)
Figure 6:
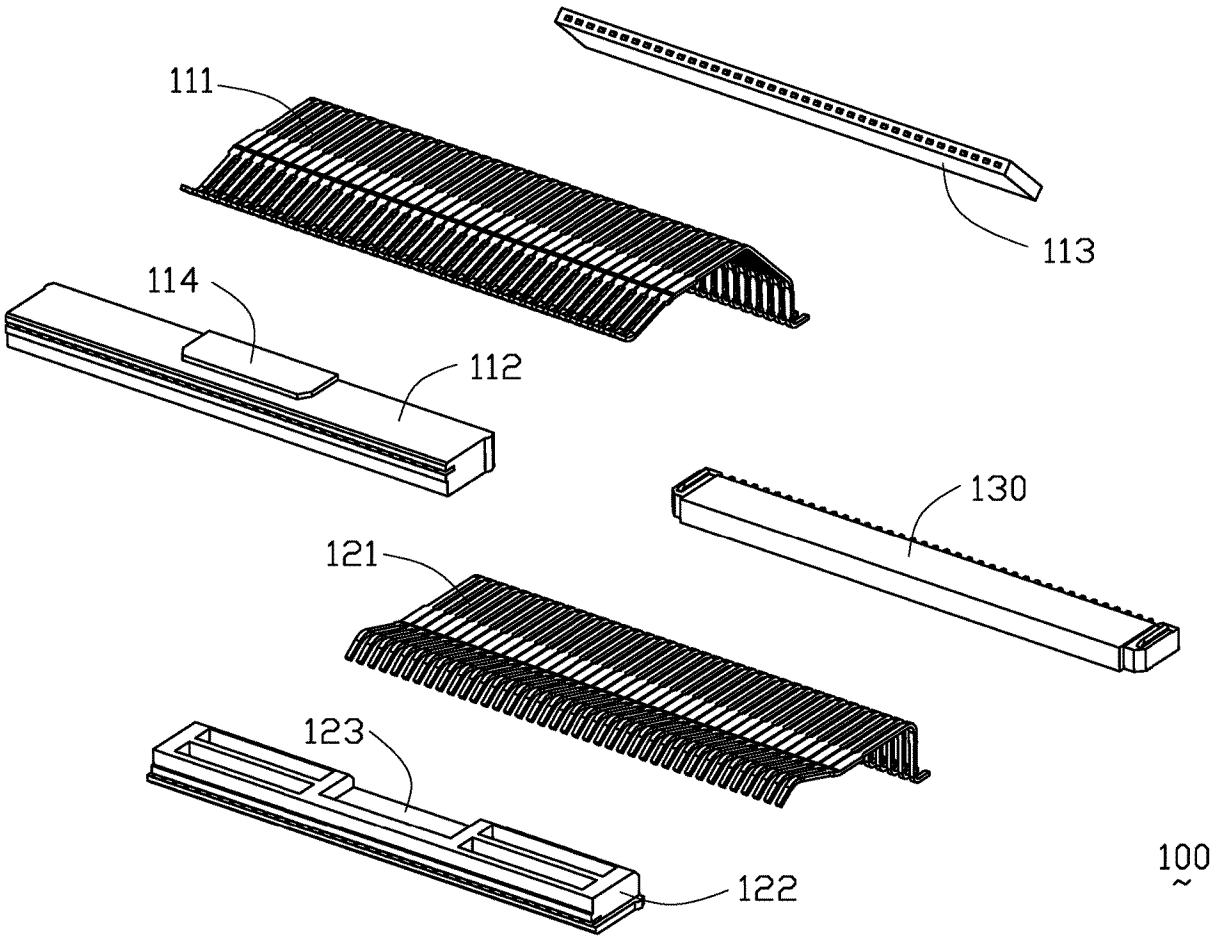
FIG. 6 is a further partially exploded perspective view of the receptacle connector of FIG. 5(A)
Figure 7:
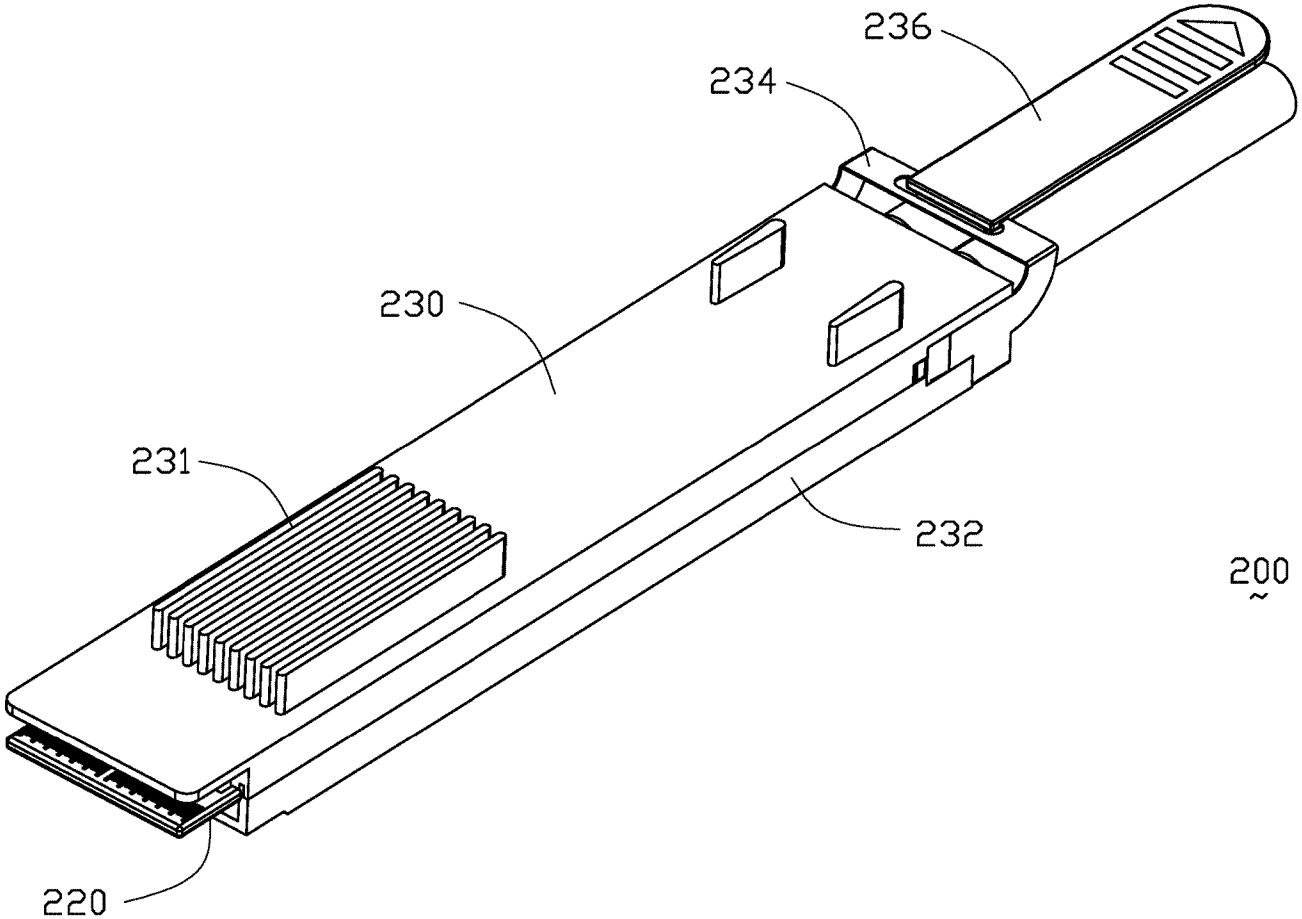
FIG. 7 is a perspective view of the plug connector of FIG. 1.
Figure 8:
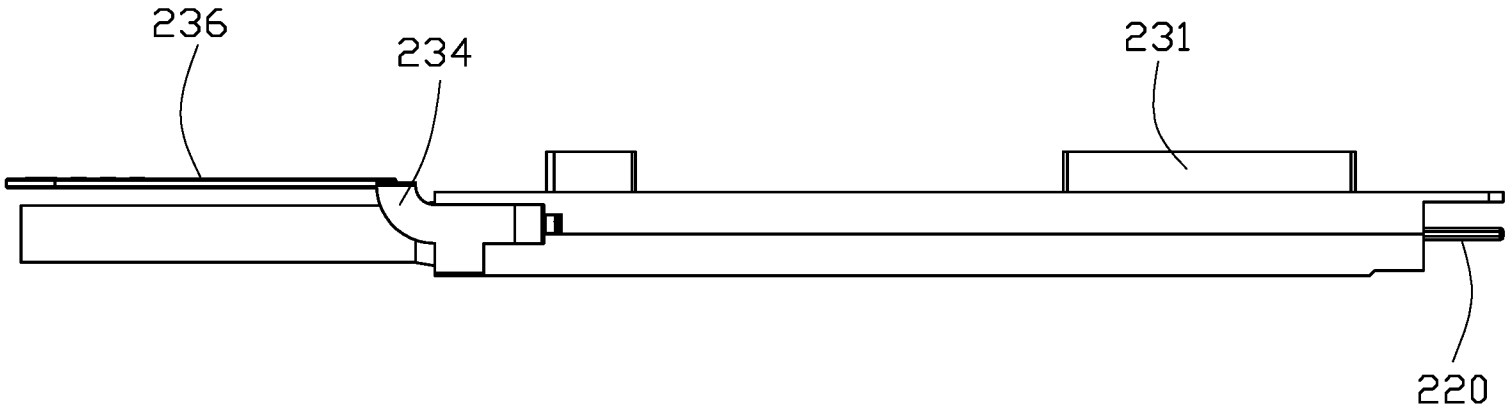
FIG. 8 is a side view of the plug connector of FIG. 7.
Figure 9:
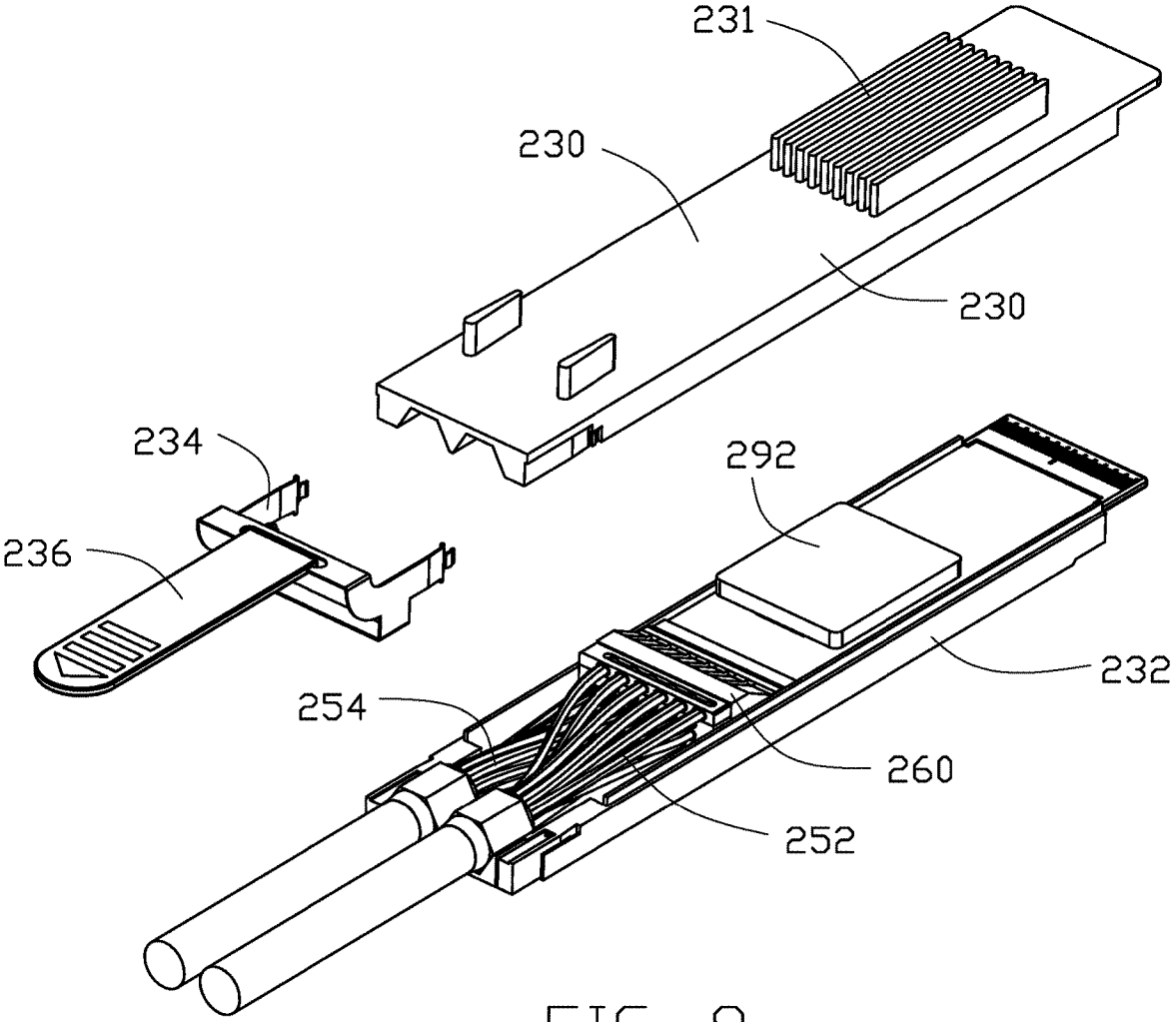
FIG. 9 is an exploded perspective view of the plug connector of FIG. 7.
Figure 10A:
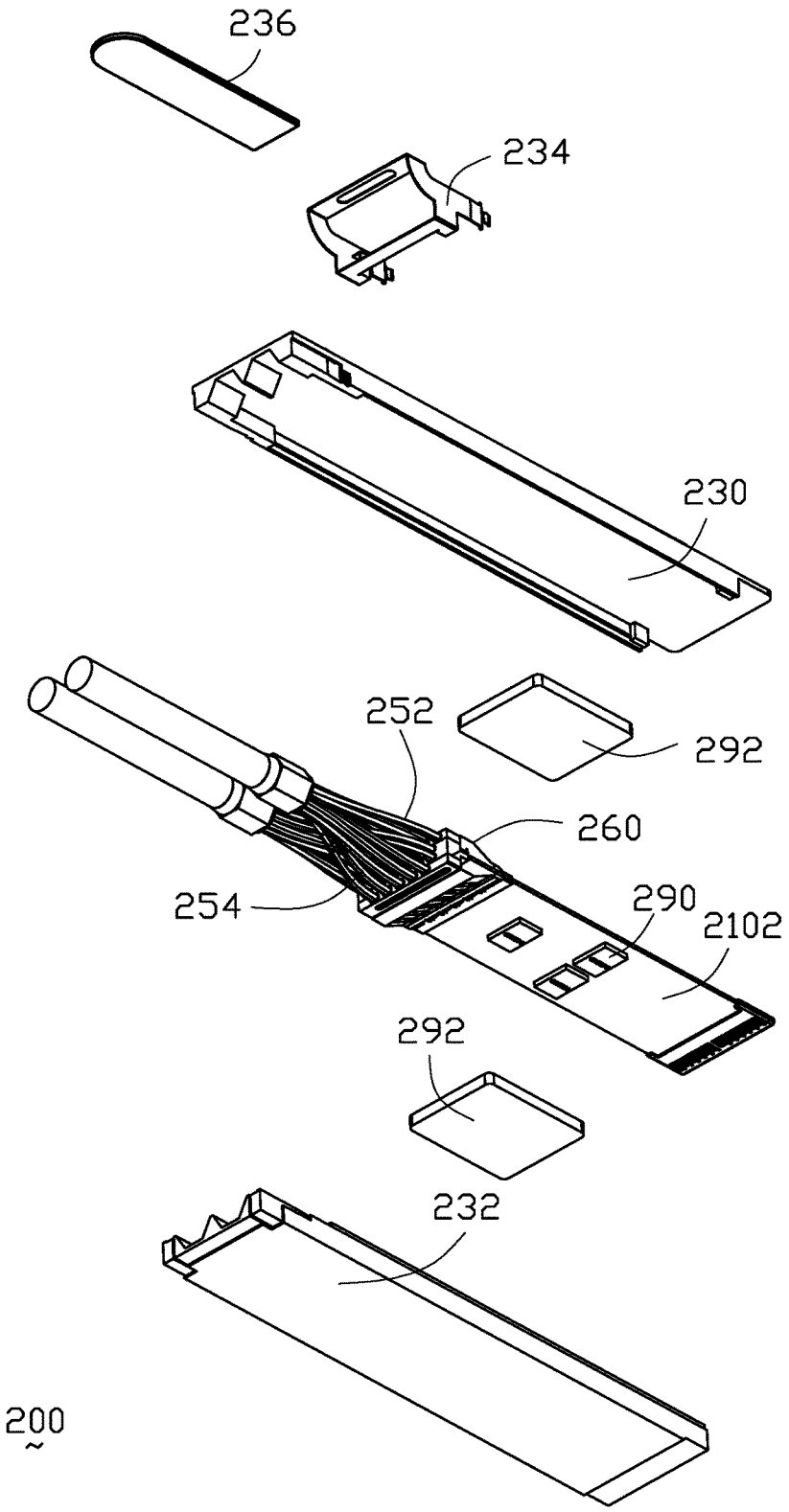
FIG. 10(A) is a further exploded perspective view of the plug connector of FIG. 7.
Figure 10B:
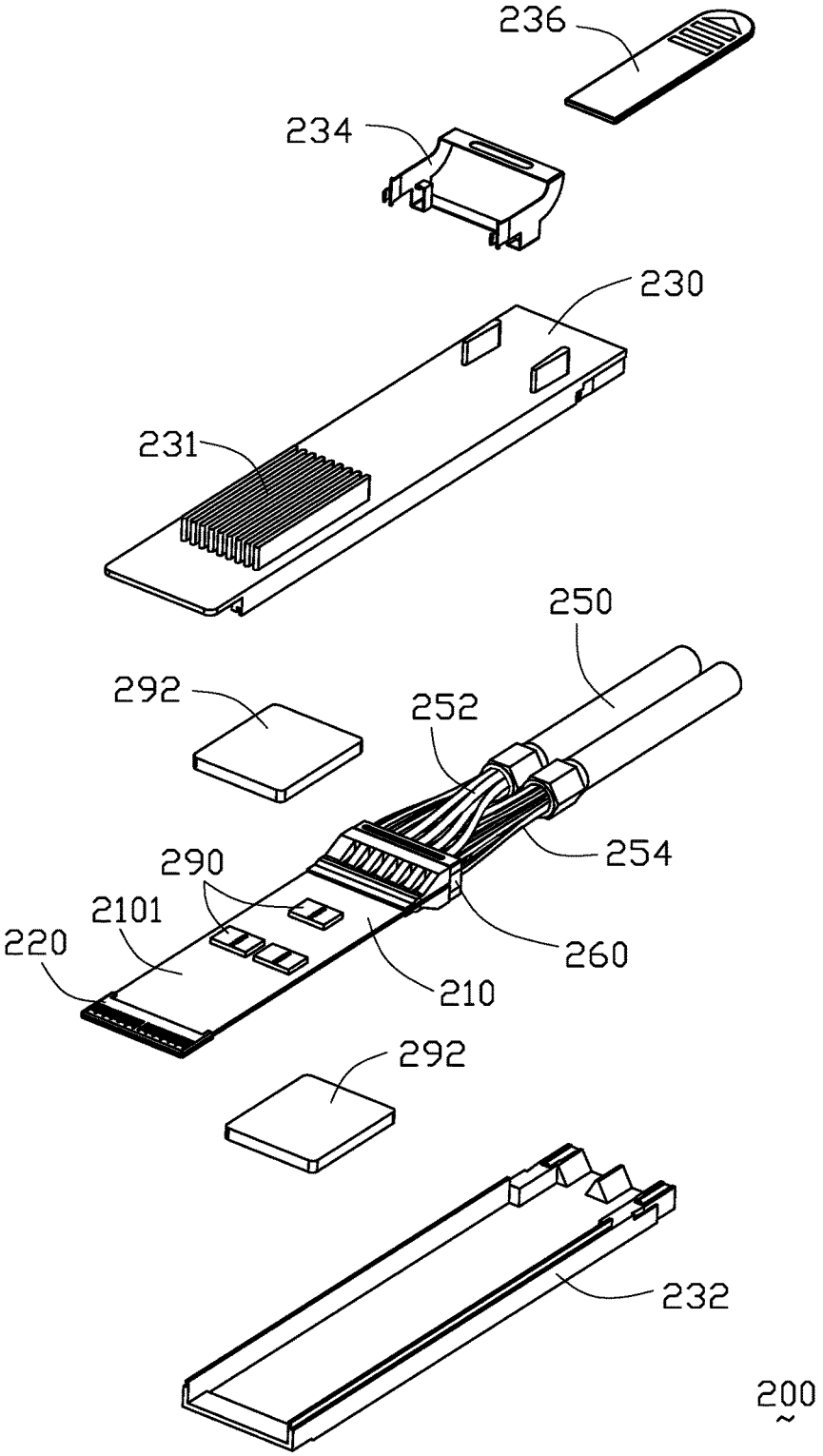
FIG. 10(B) is another further exploded perspective view of the plug connector of FIG. 7.
Figure 11A:
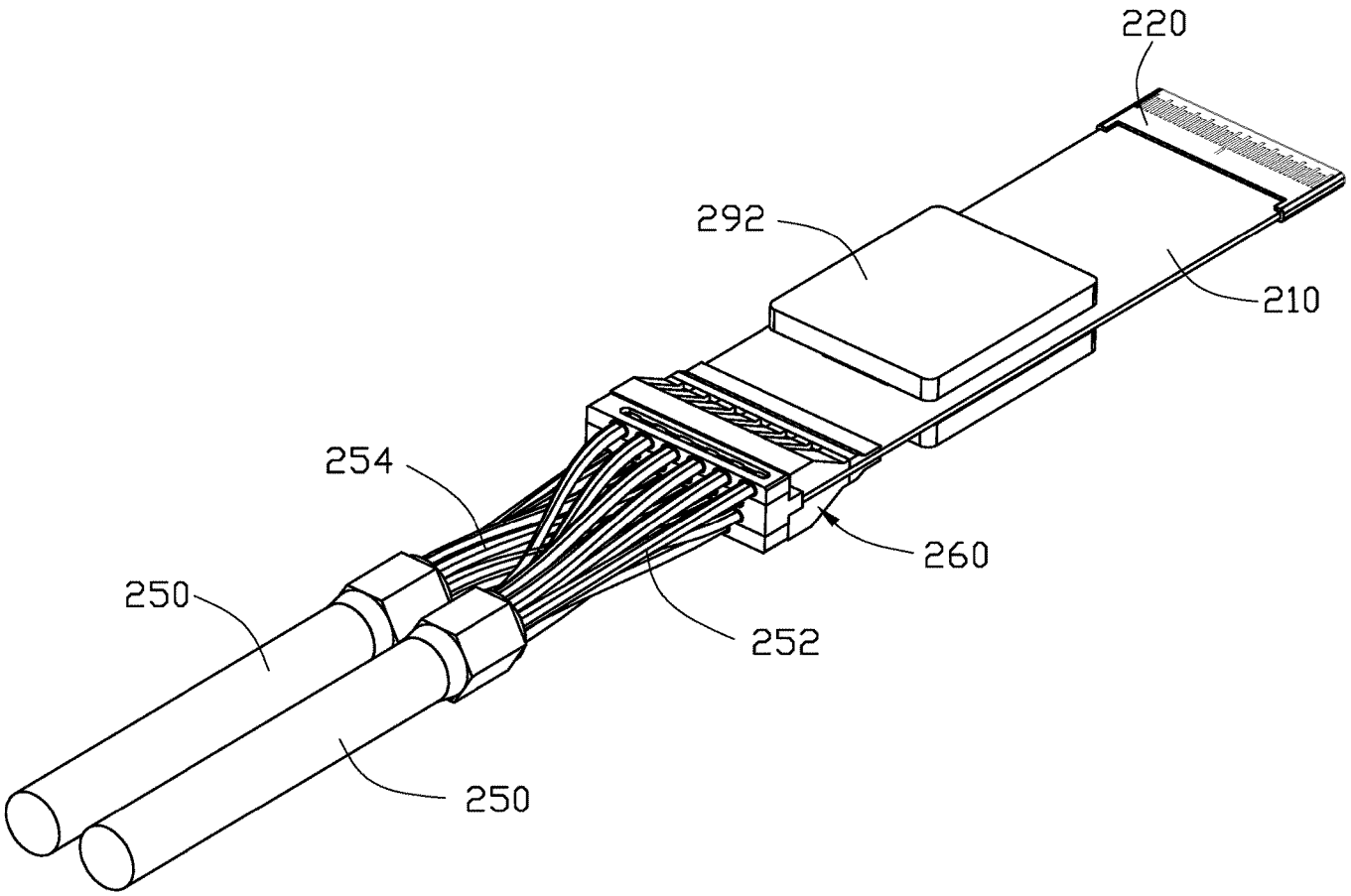
FIG. 11(A) is a perspective view of the plug connector of FIG. 7 by removing the cover and the associated latch and pull tape.
Figure 11B:
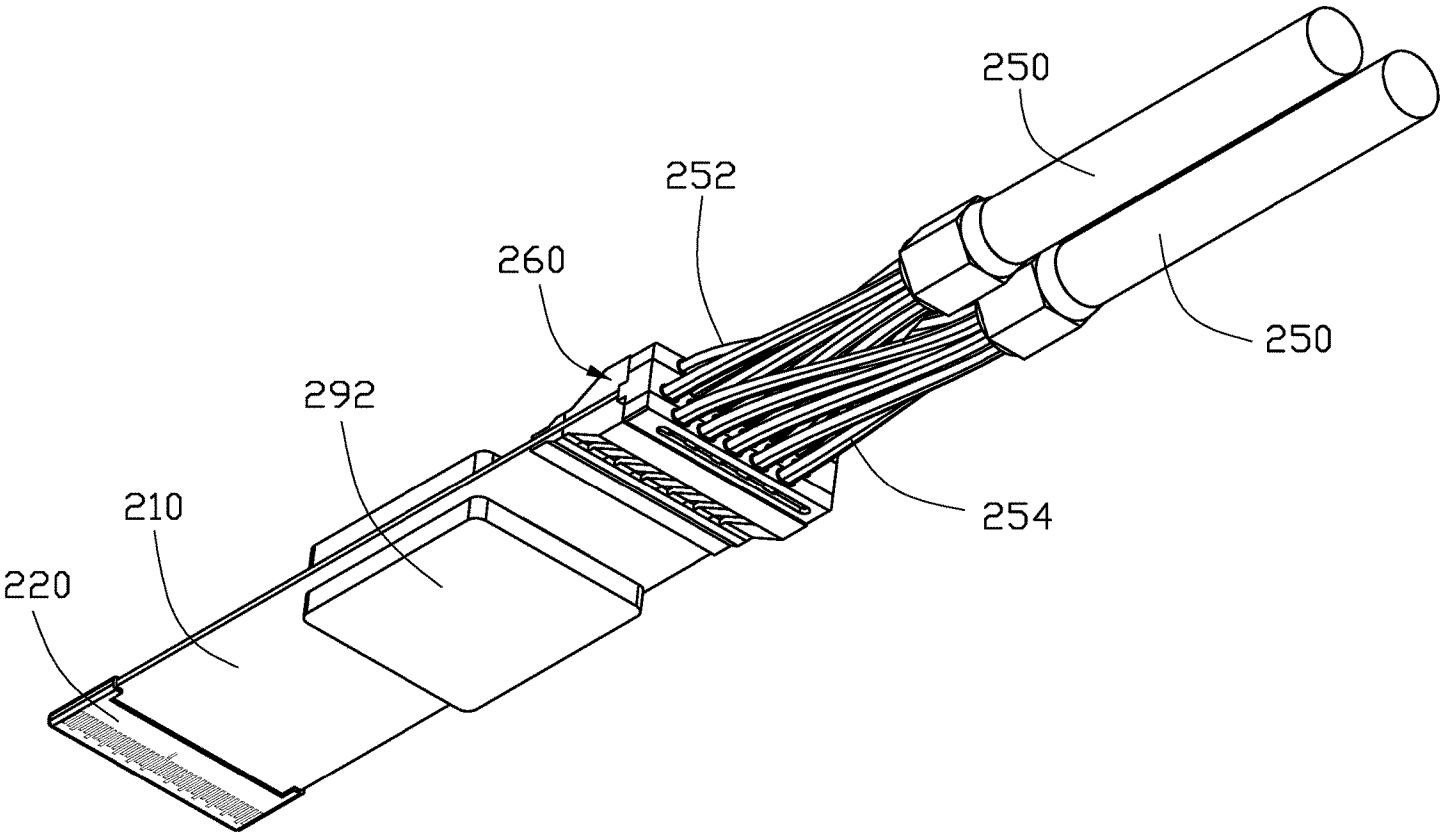
FIG. 11(B) is another perspective view of the plug connector of FIG. 11(A)
Figure 11C:
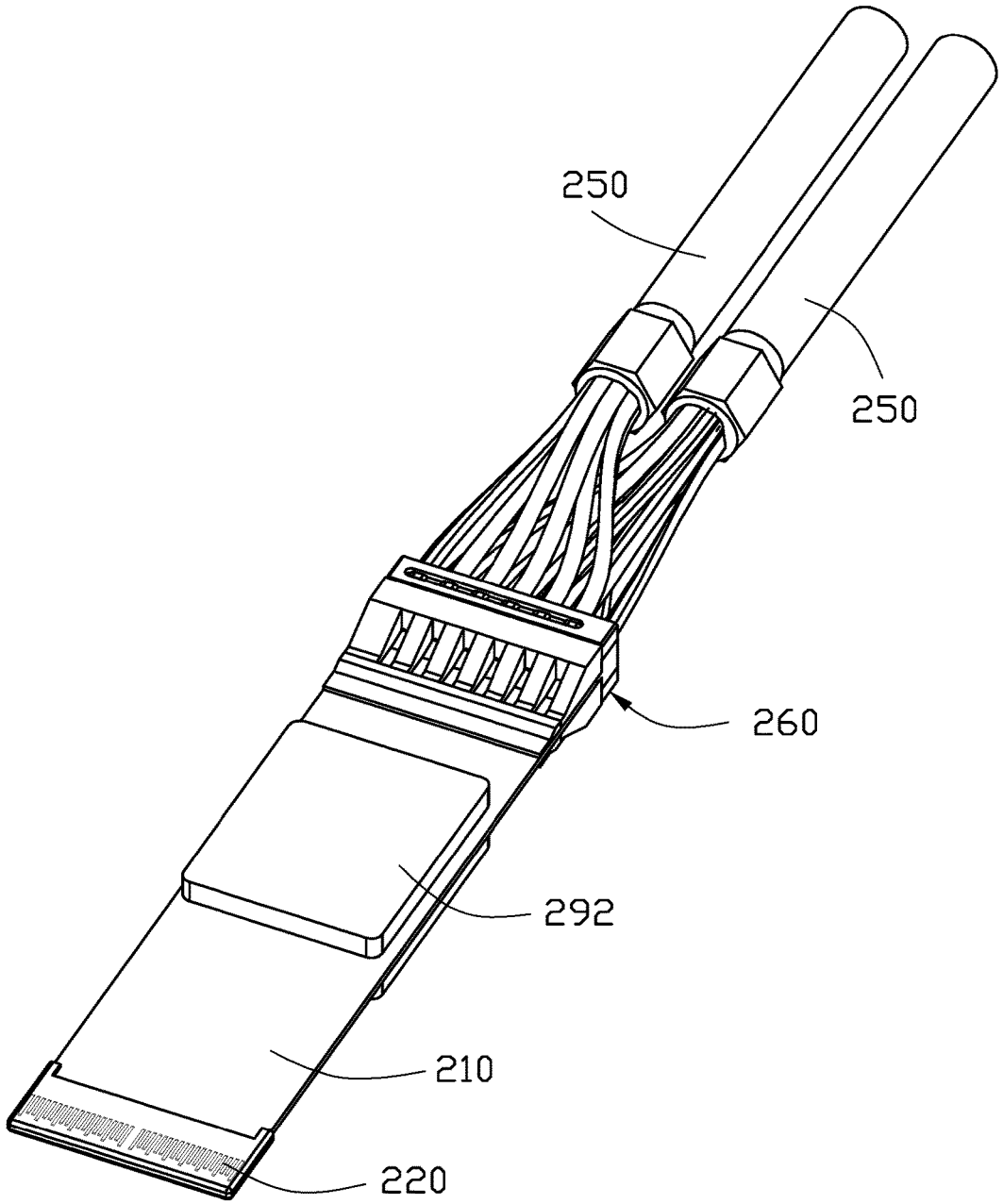
FIG. 11 (C) is another perspective view of the plug connector of FIG. 11(A)
Figure 12:
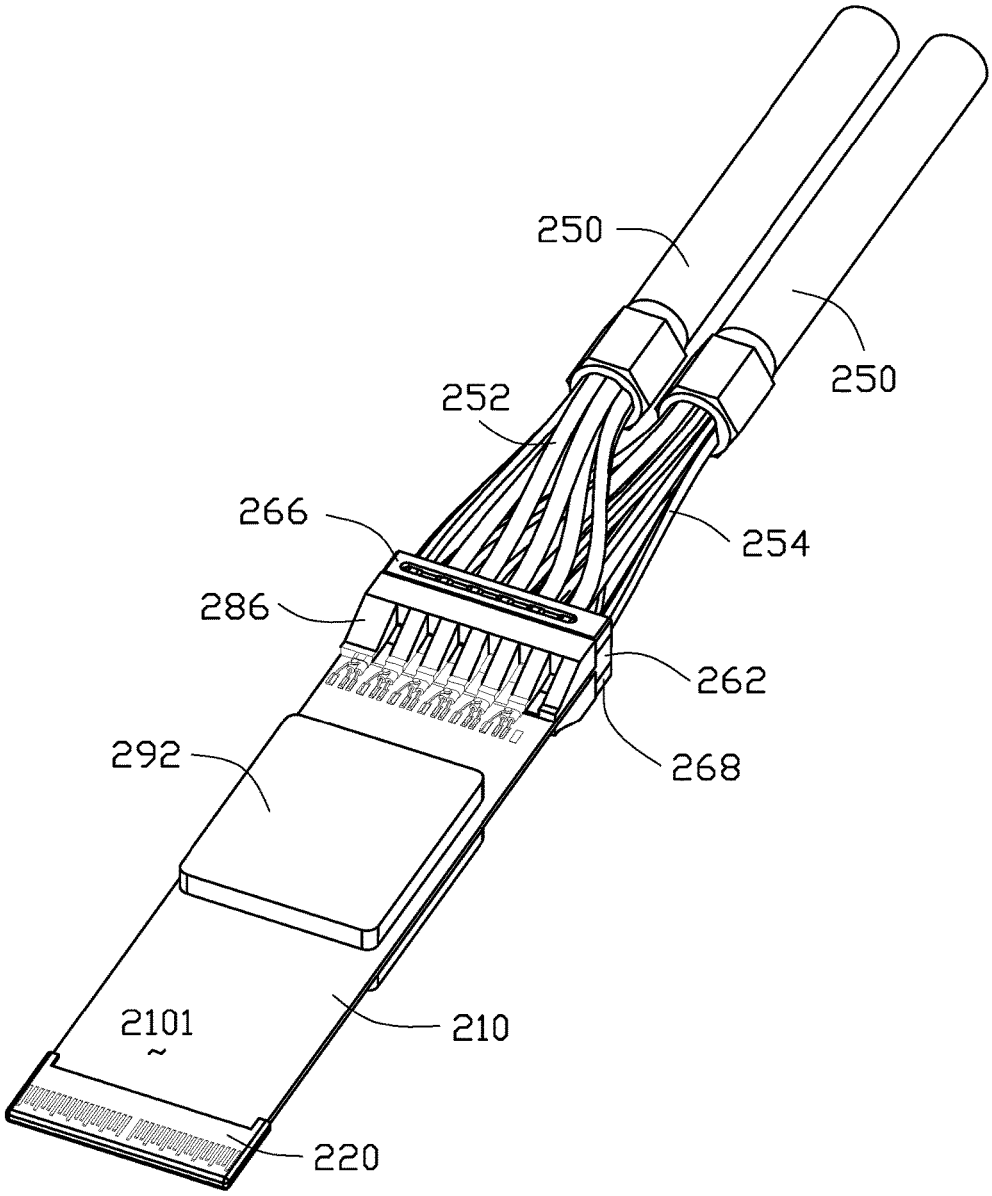
FIG. 12 is a perspective view of the plug connector of FIG. 11(A) by further removing the front protection glue therefrom.
Figure 13:
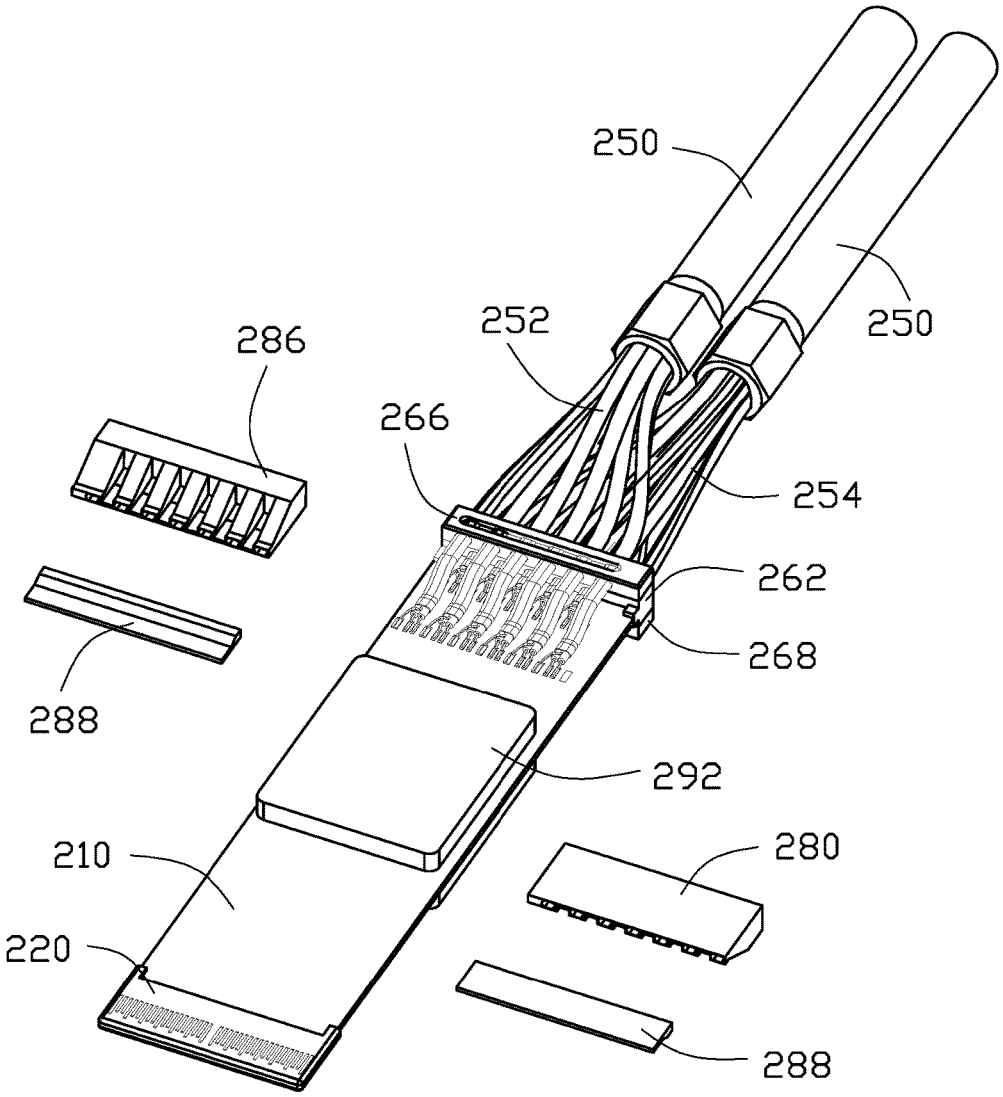
FIG. 13 is an exploded perspective view of the plug connector of FIG. 11(A)
Figure 14A:
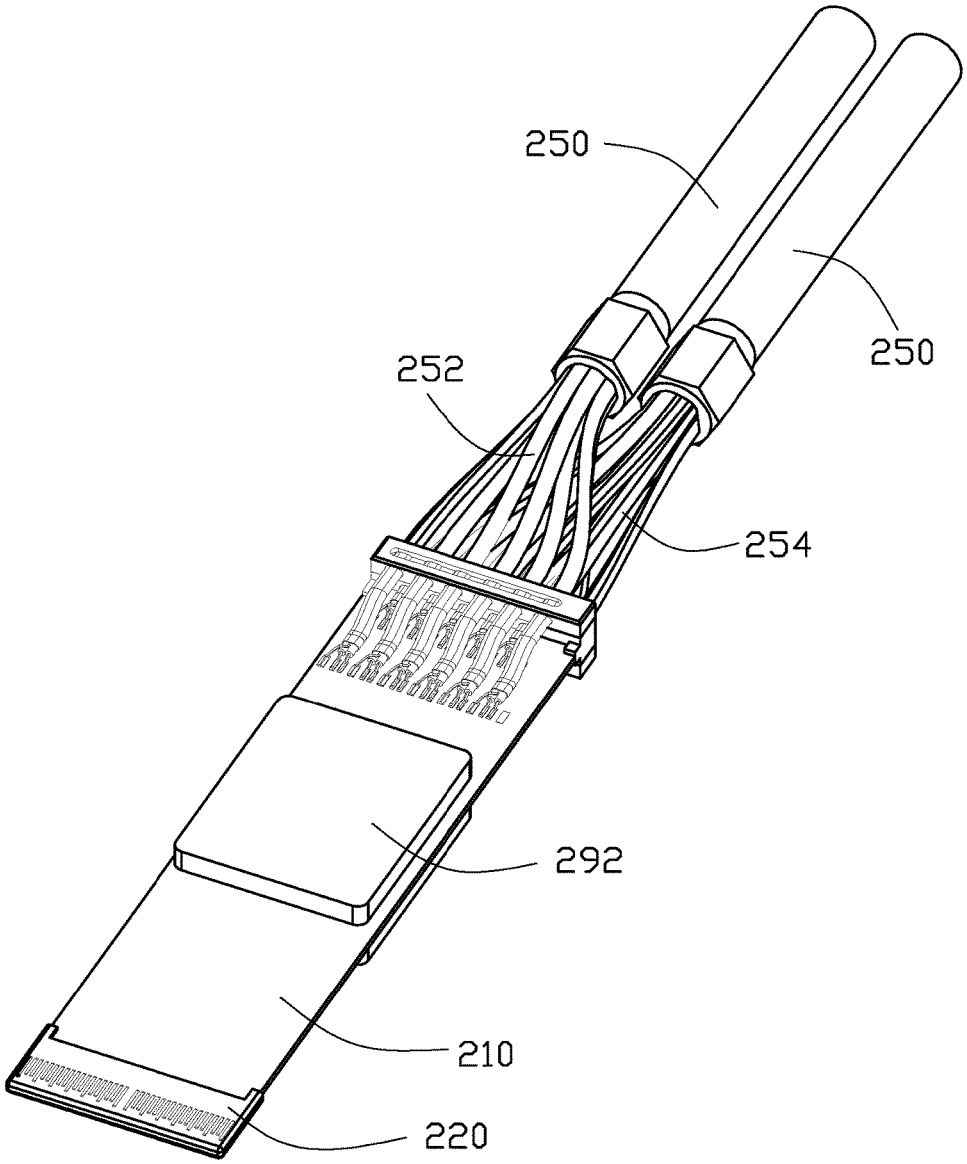
FIG. 14(A) is a perspective view of the plug connector of FIG. 13 by removing the front protection glue and the rear protection glue.
Figure 14B:
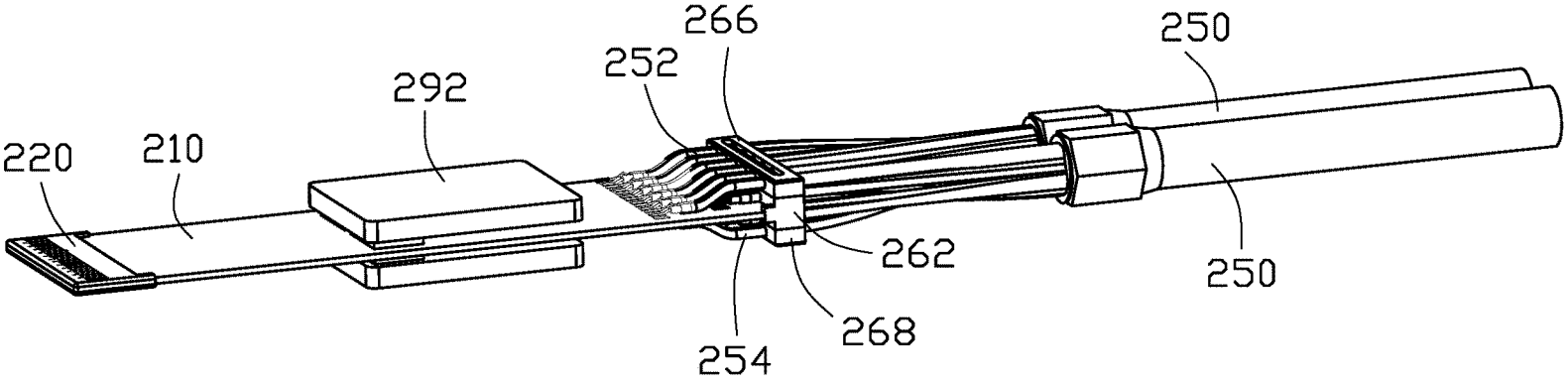
FIG. 14(B) is another perspective view of the plug connector of FIG. 14(A)
Figure 14C:
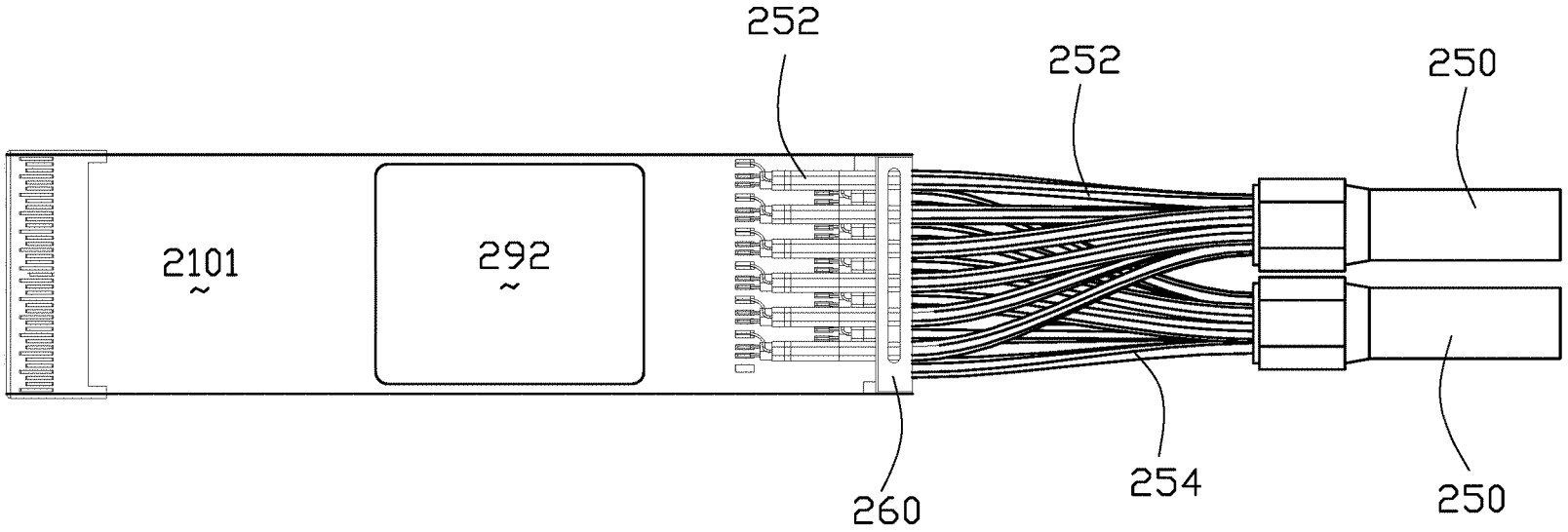
FIG. 14(C) is a perspective view of the plug connector of FIG. 14(A)
Figure 14D:
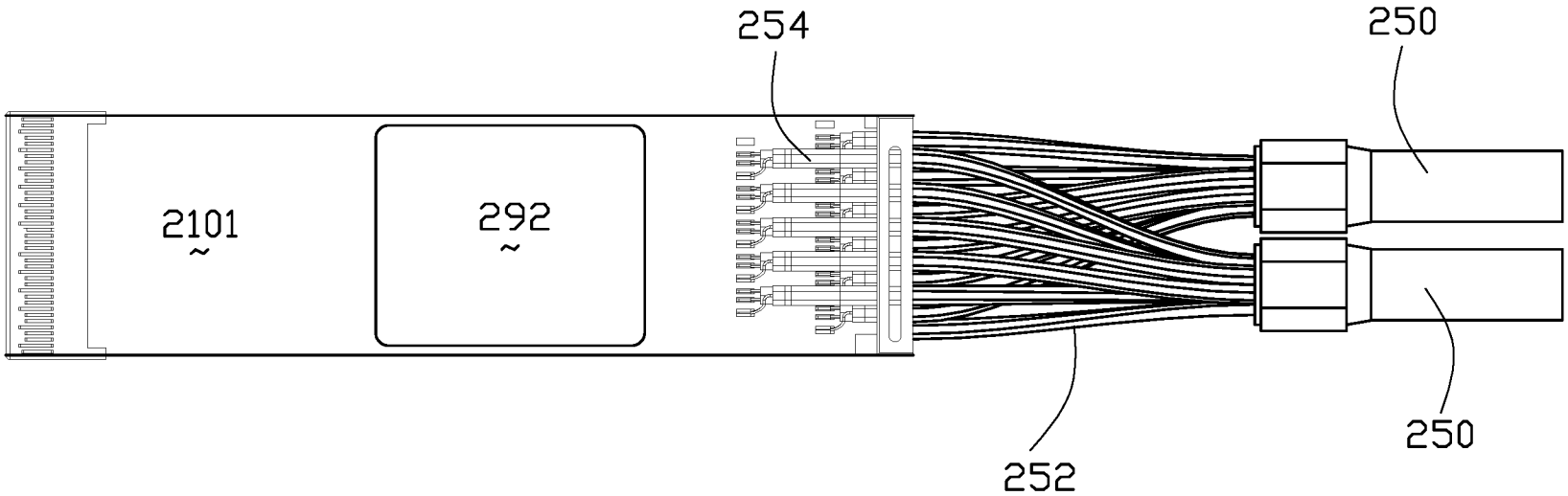
FIG. 14(D) is a perspective view of the plug connector of FIG. 14(A)
Figure 15:
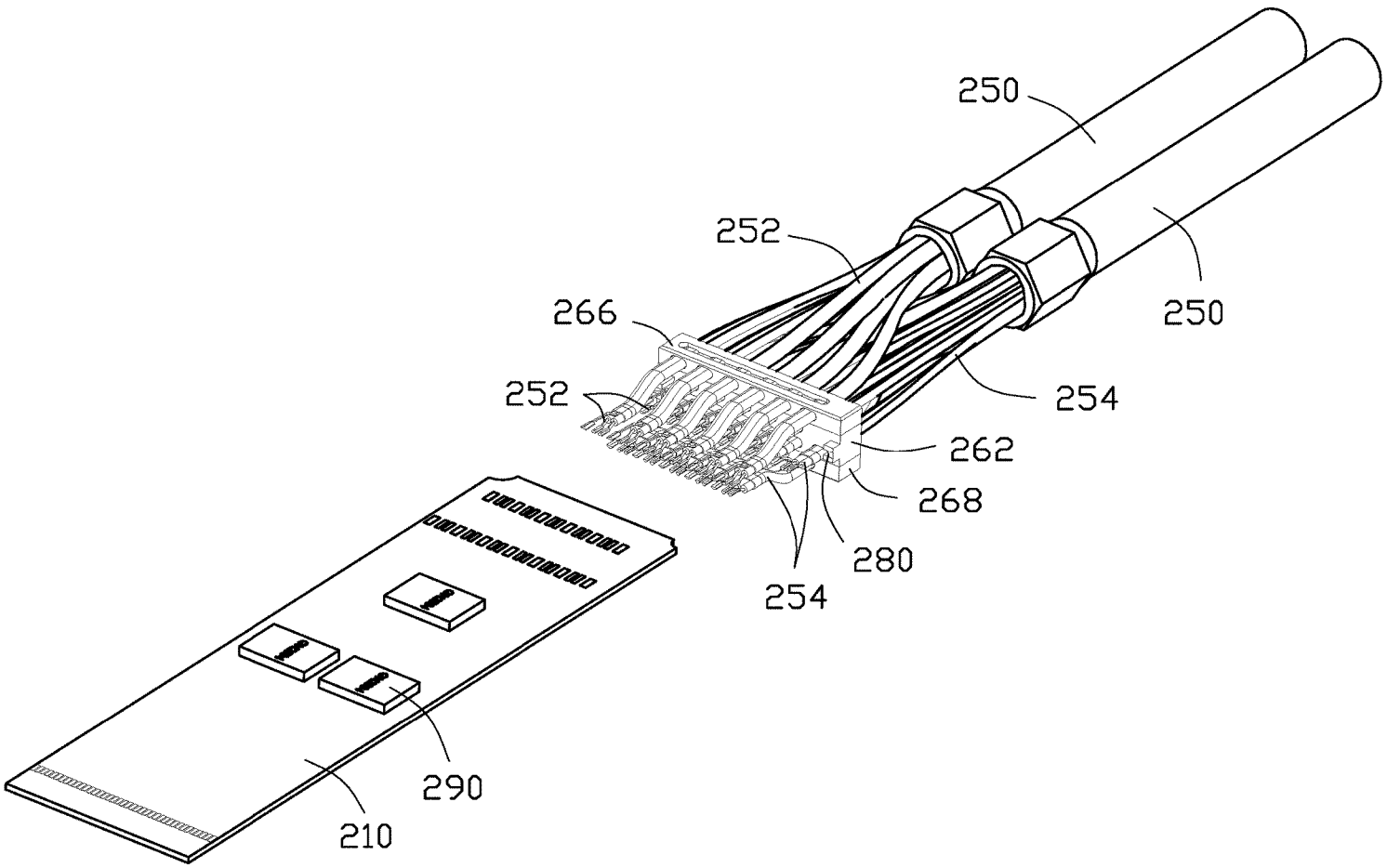
FIG. 15 is an exploded perspective view of the plug connector of FIG. 14(A) by removing the thermal interface material and the front terminal module.
Figure 16:
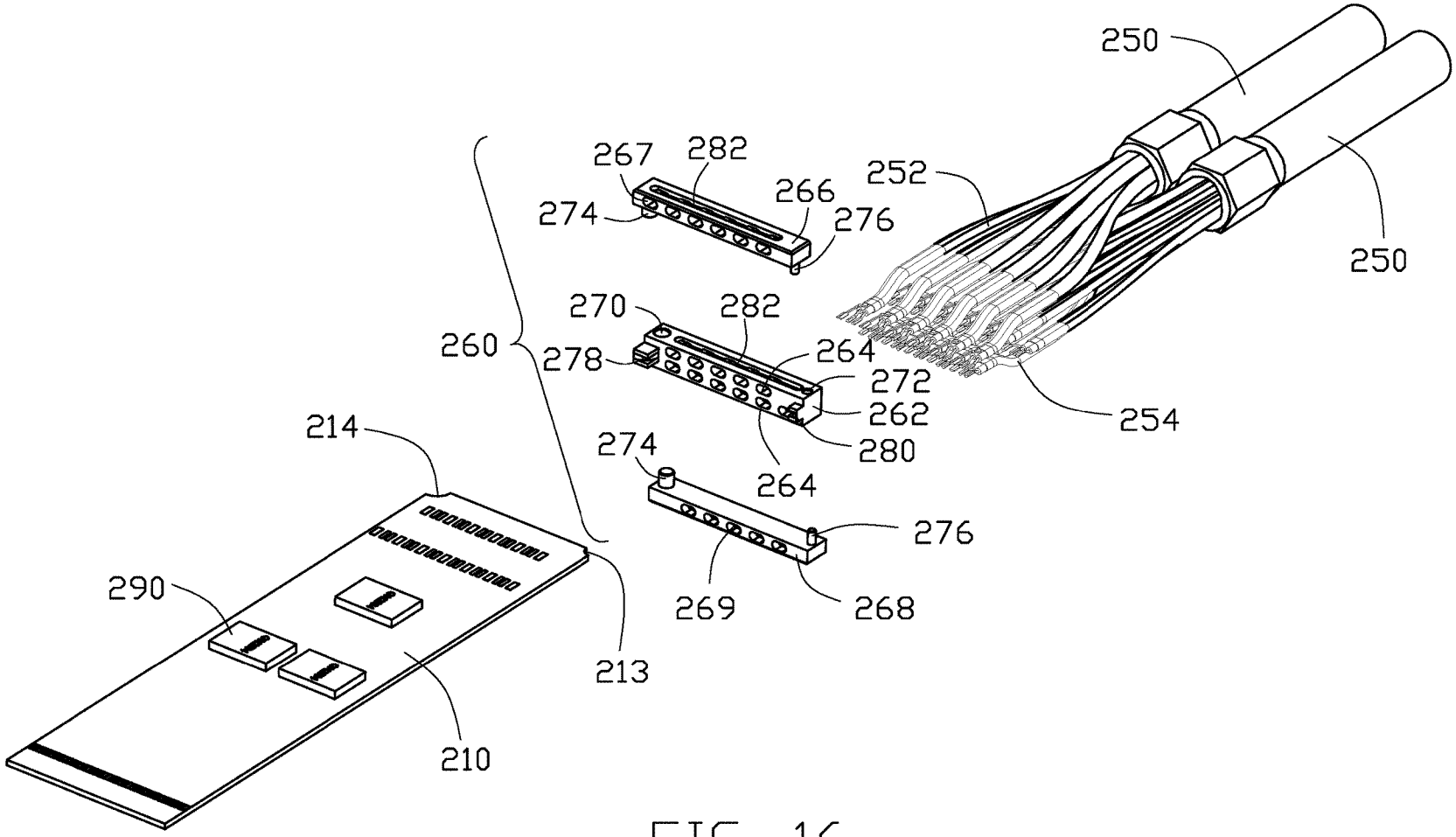
FIG. 16 is a further exploded perspective view of the plug connector of FIG. 15.
Figure 17:
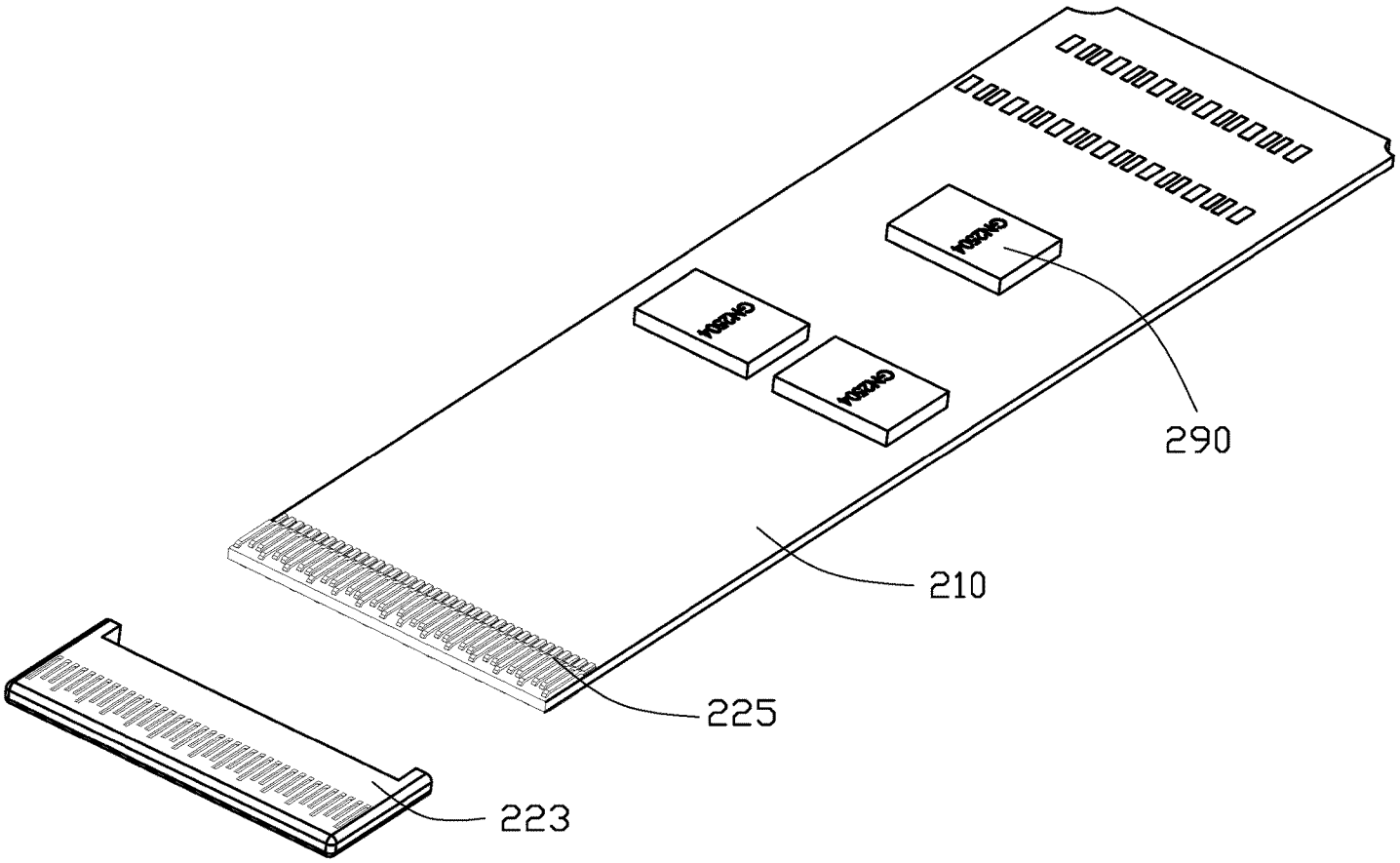
FIG. 17 is a further exploded perspective view of the plug connector of FIG. 14(A)
Figure 18:
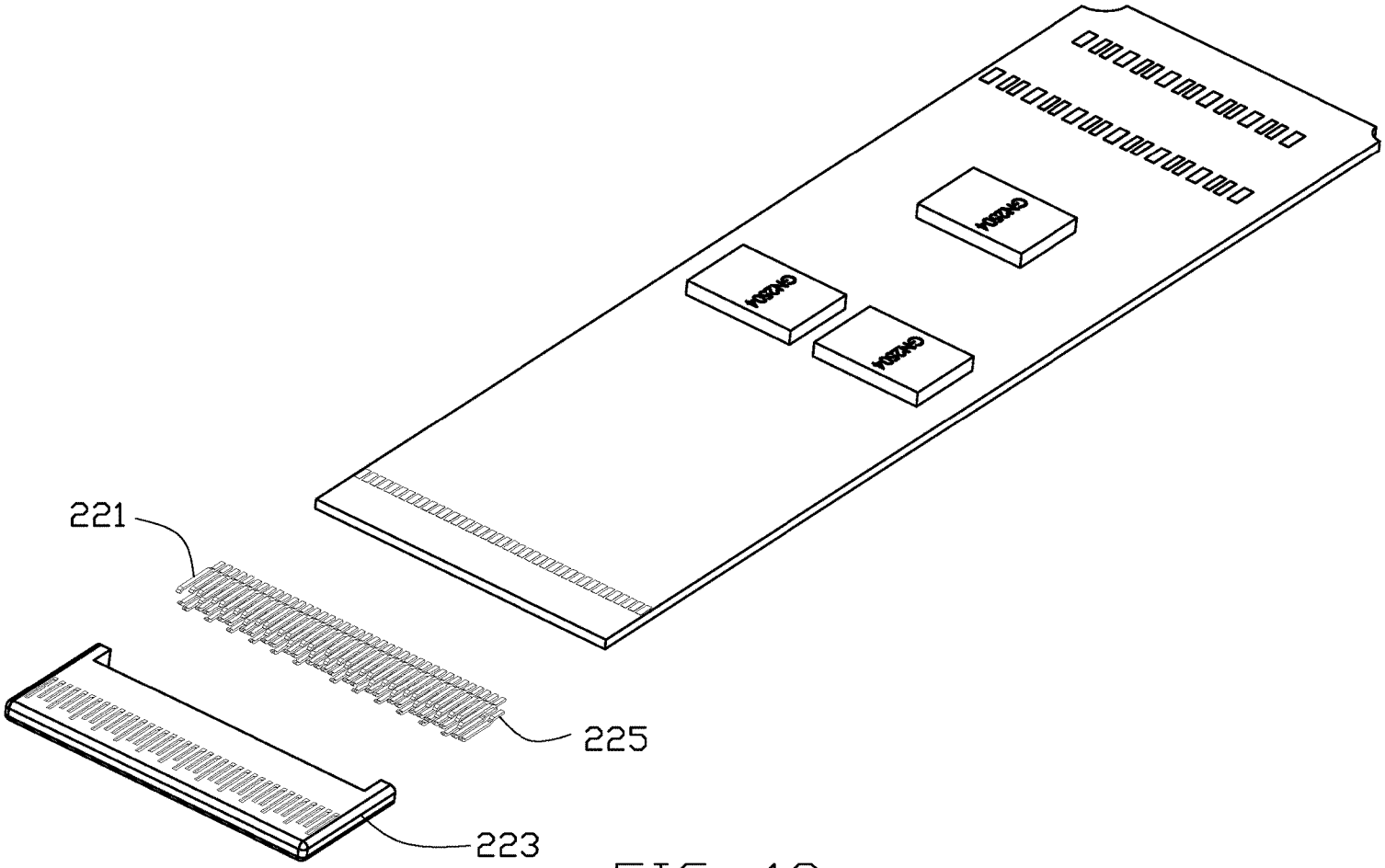
FIG. 18 is a further exploded perspective view of the plug connector of FIG. 17 by removing the thermal interface material and the cable.
Figure 19:
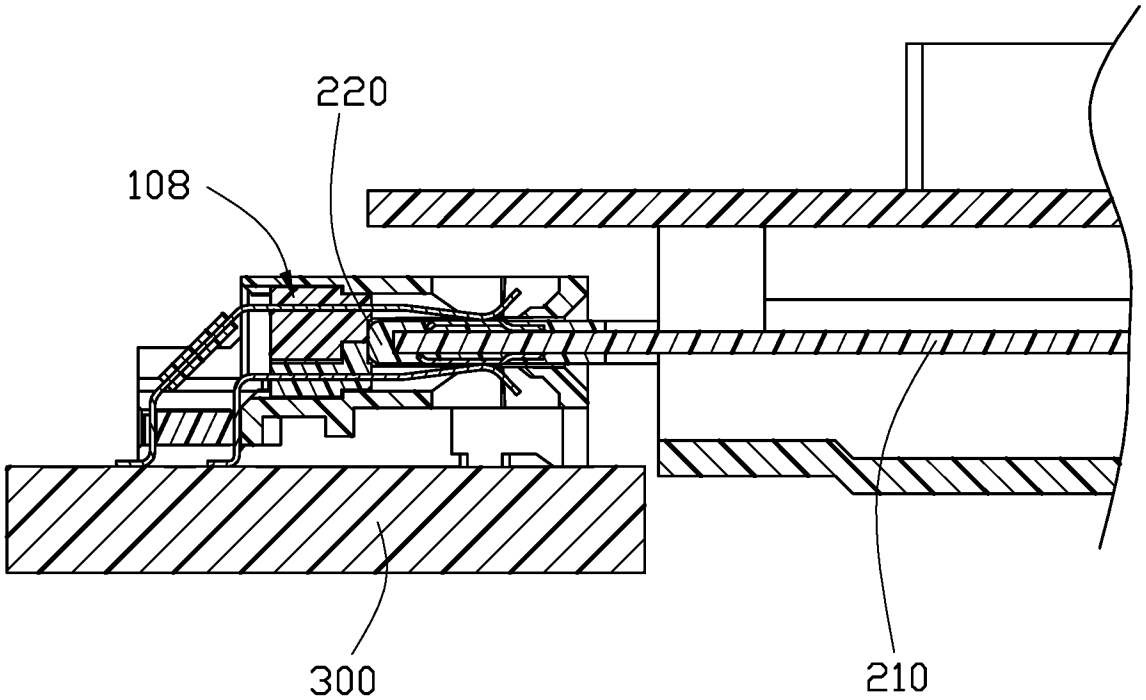
FIG. 19 is a cross-sectional view of the partial plug connector and the receptacle connector of FIG. 1 mated with each other.
Figure 20:
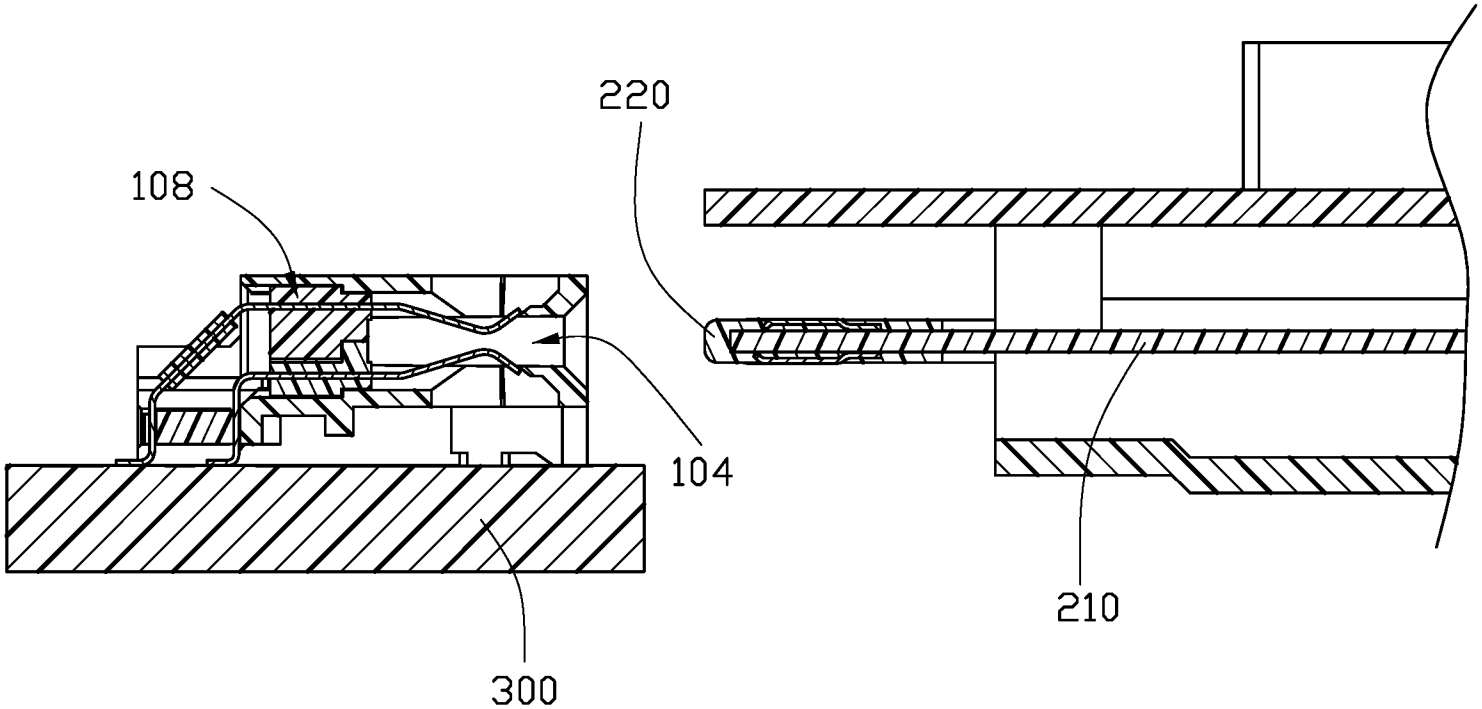
FIG. 20 is a cross-sectional view of the partial plug connector and the receptacle connector of FIG. 1 unmated with each other.
Figure 21:
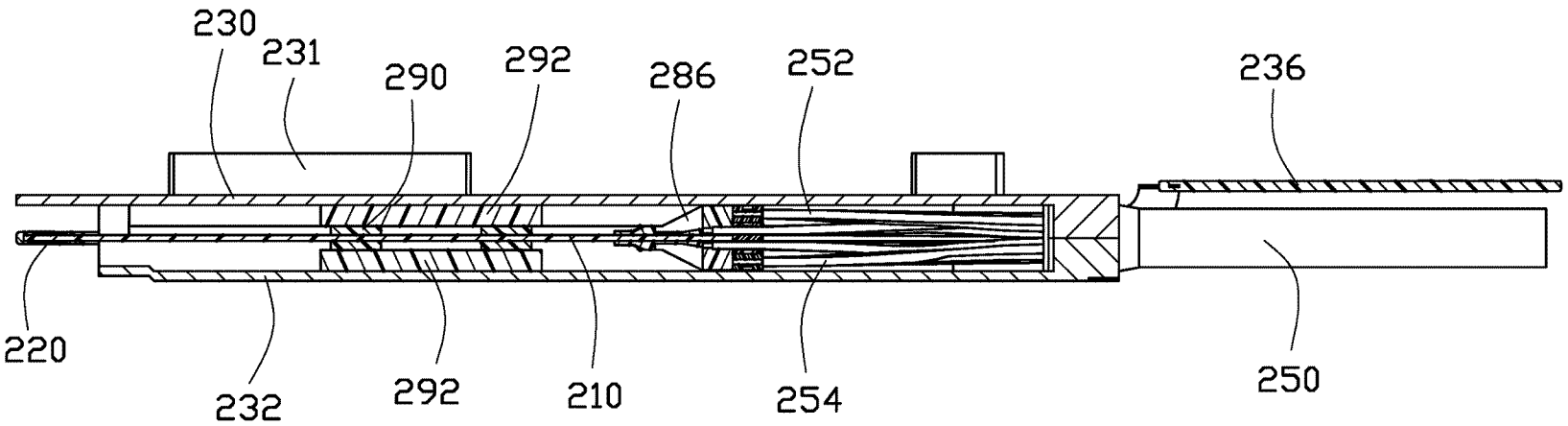
FIG. 21 is a cross-sectional view of the plug connector of FIG. 1.
Figure 21A:
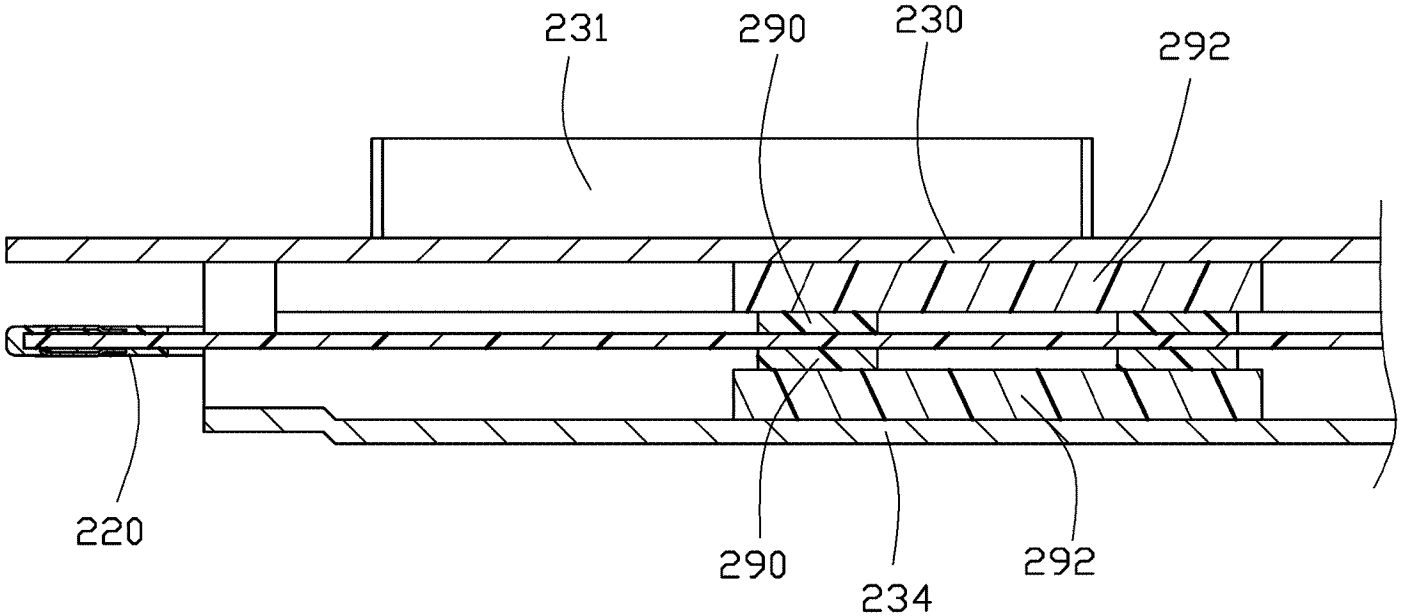
FIG. 21(A) is a cross-sectional view of a front half of the plug connector of FIG. 21.
Figure 21B:
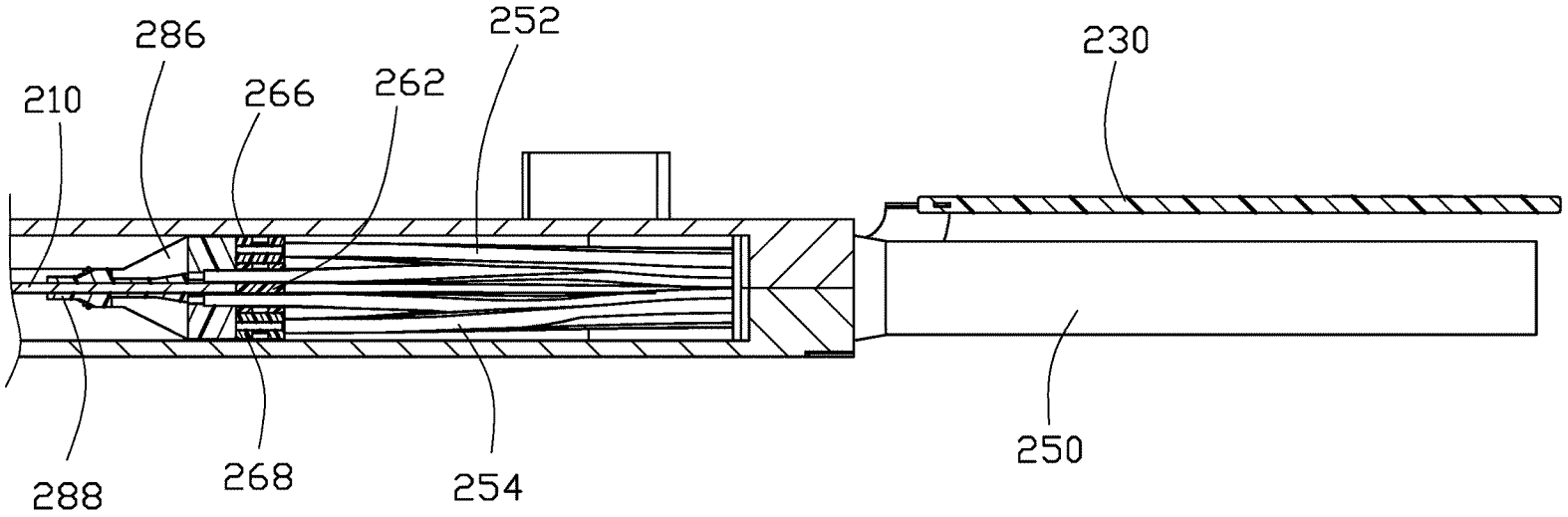
FIG. 21(B) is a cross-sectional view of a rear half of the plug connector of FIG. 21.
Figure 22A:
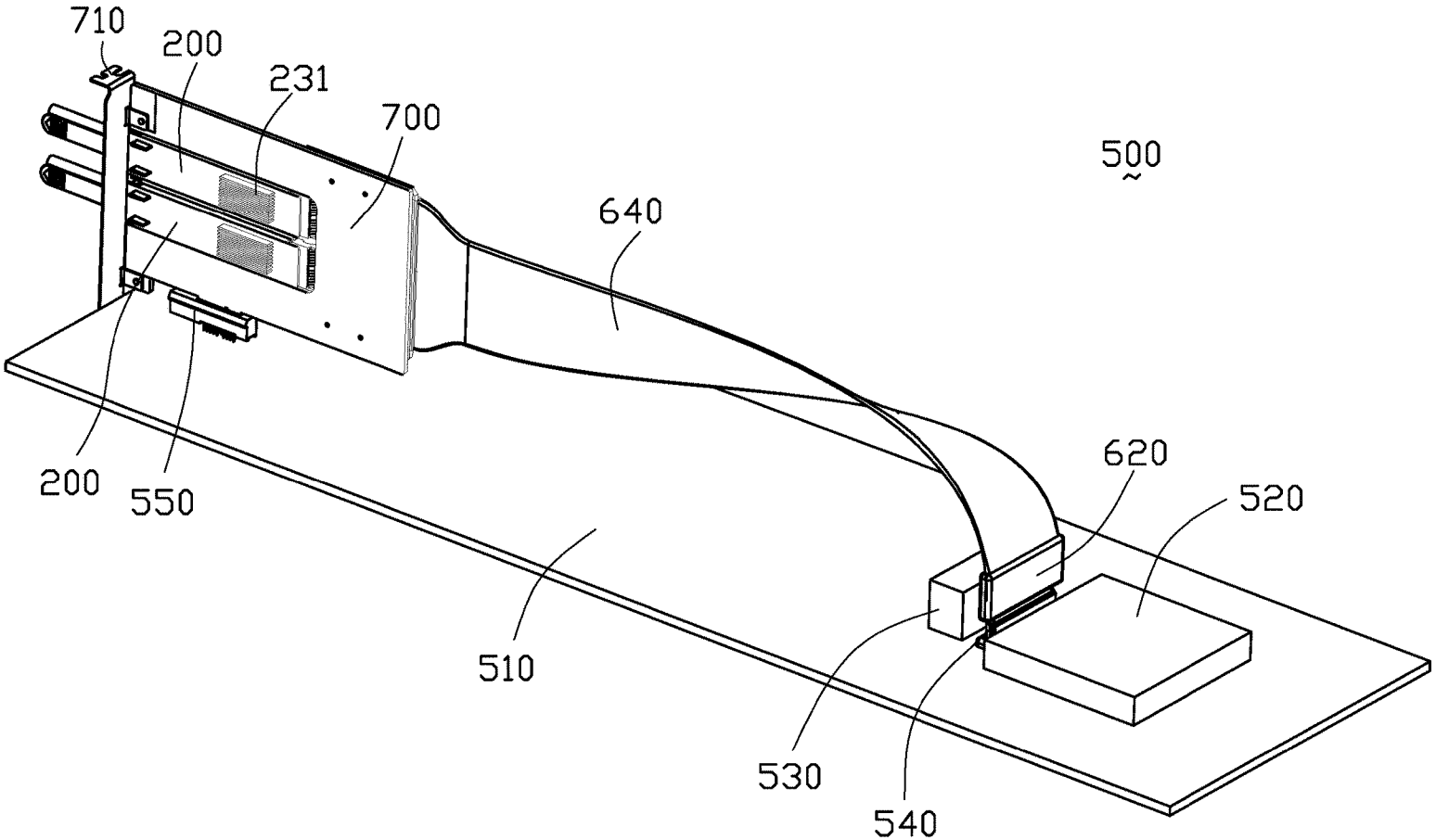
FIG. 22(A) is a perspective view of a first embodiment of the connection system using the mating plug connector and receptacle connector of FIG. 1.
Figure 22B:
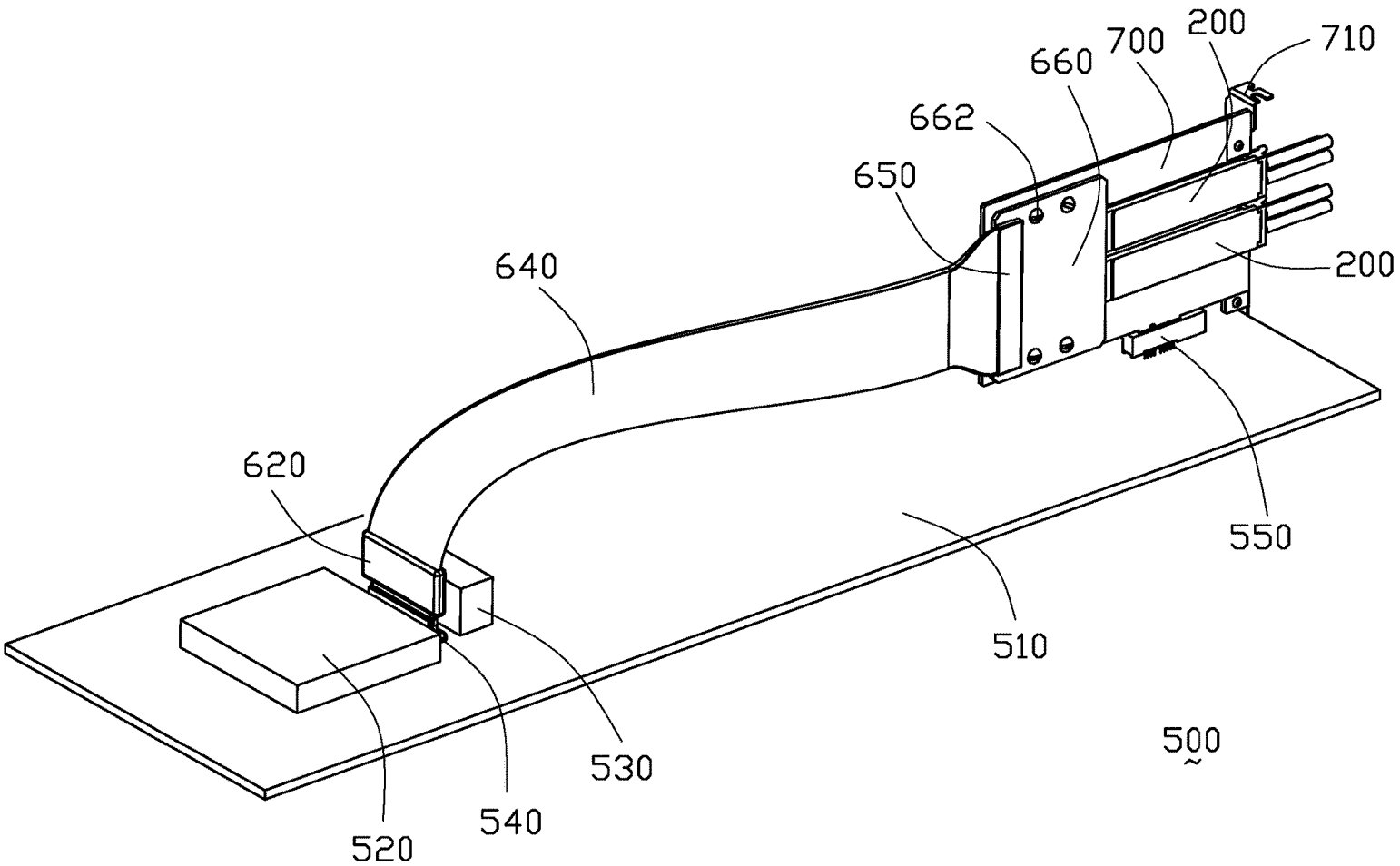
FIG. 22(B) is another perspective view of the connection system of FIG. 22(B)
Figure 23A:
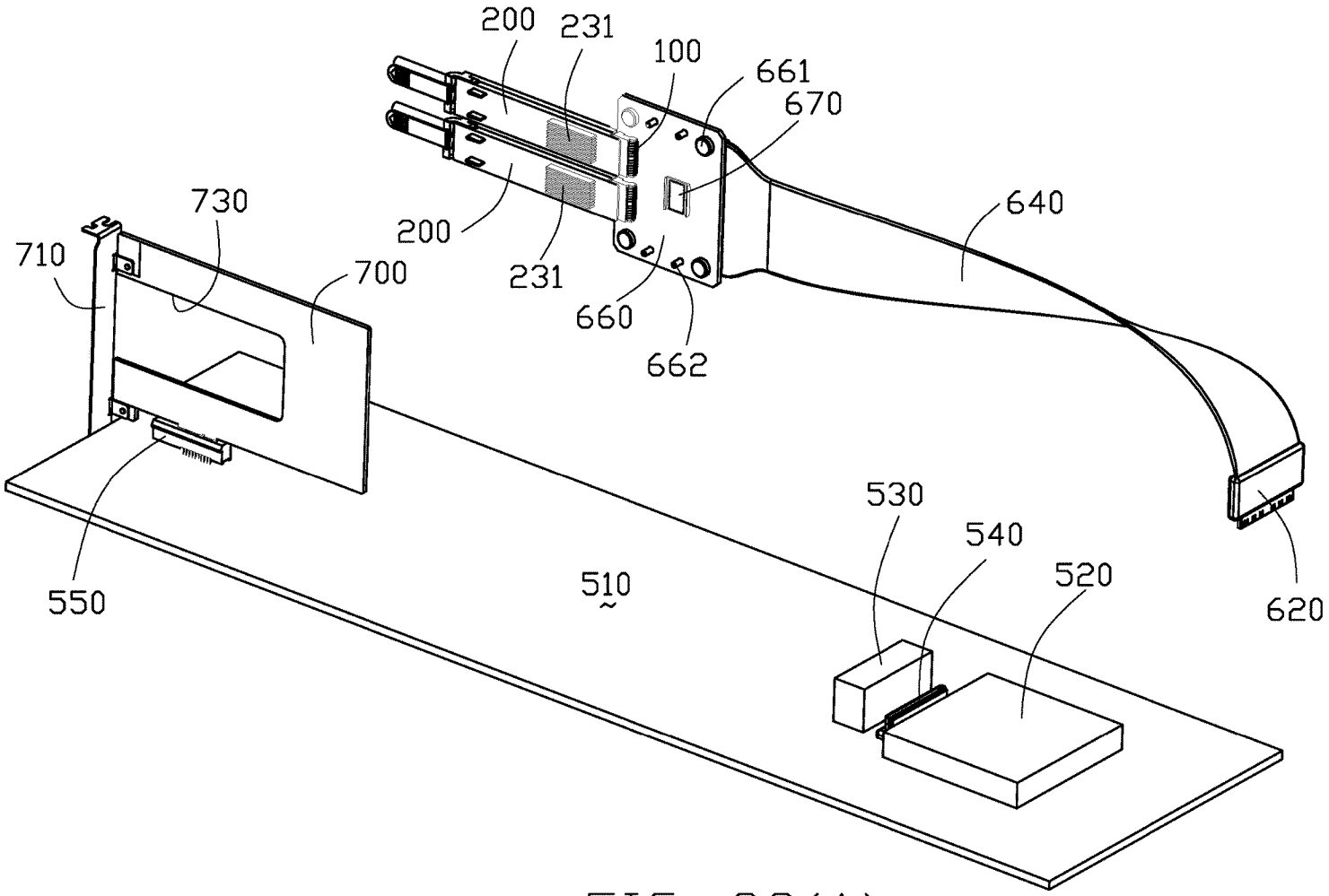
FIG. 23(A) is an exploded perspective view of the connection system of FIG. 22(A)
Figure 23B:
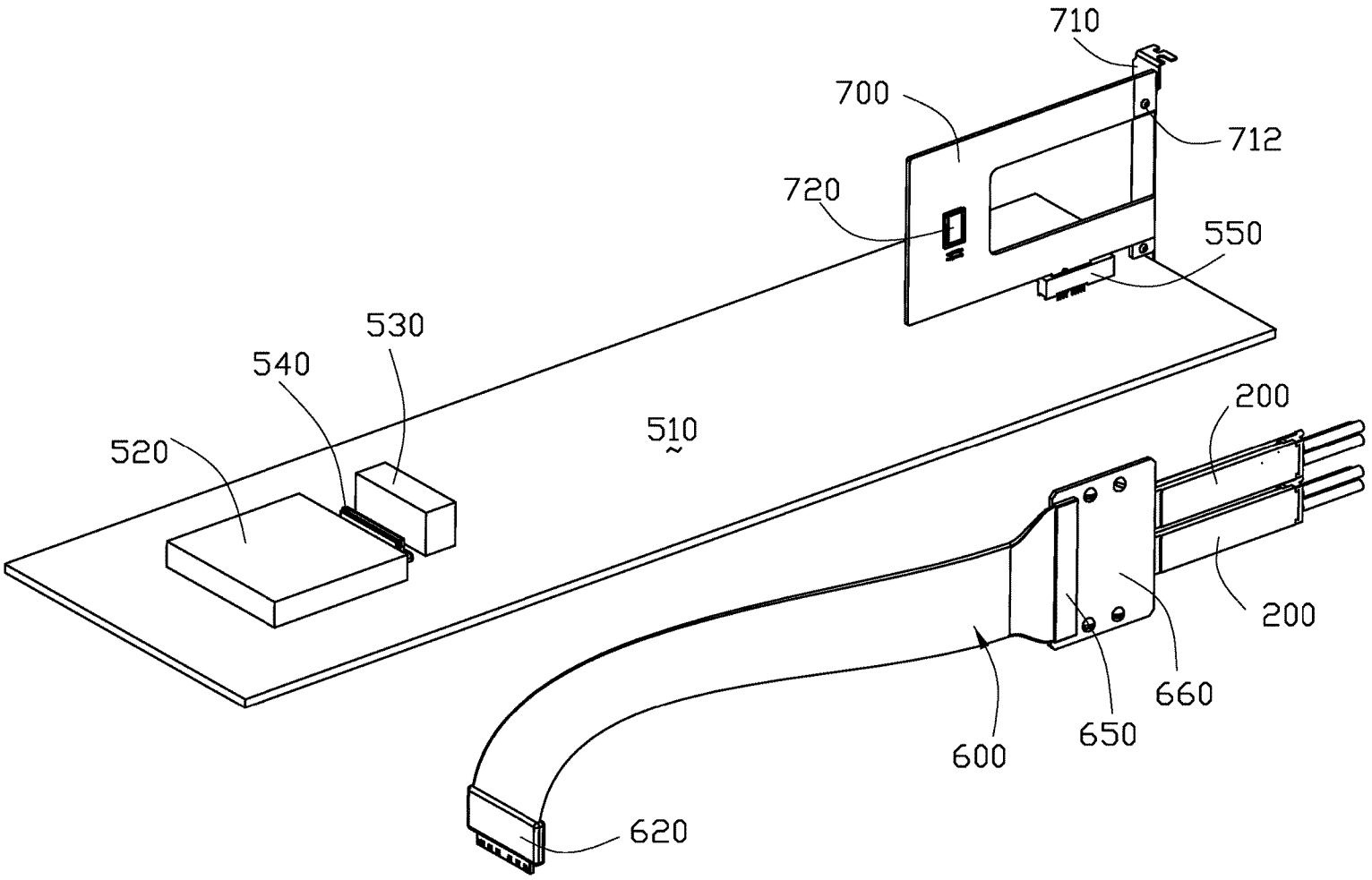
FIG. 23(B) is another exploded perspective view of the connection system of FIG. 23(A)
Figure 24A:
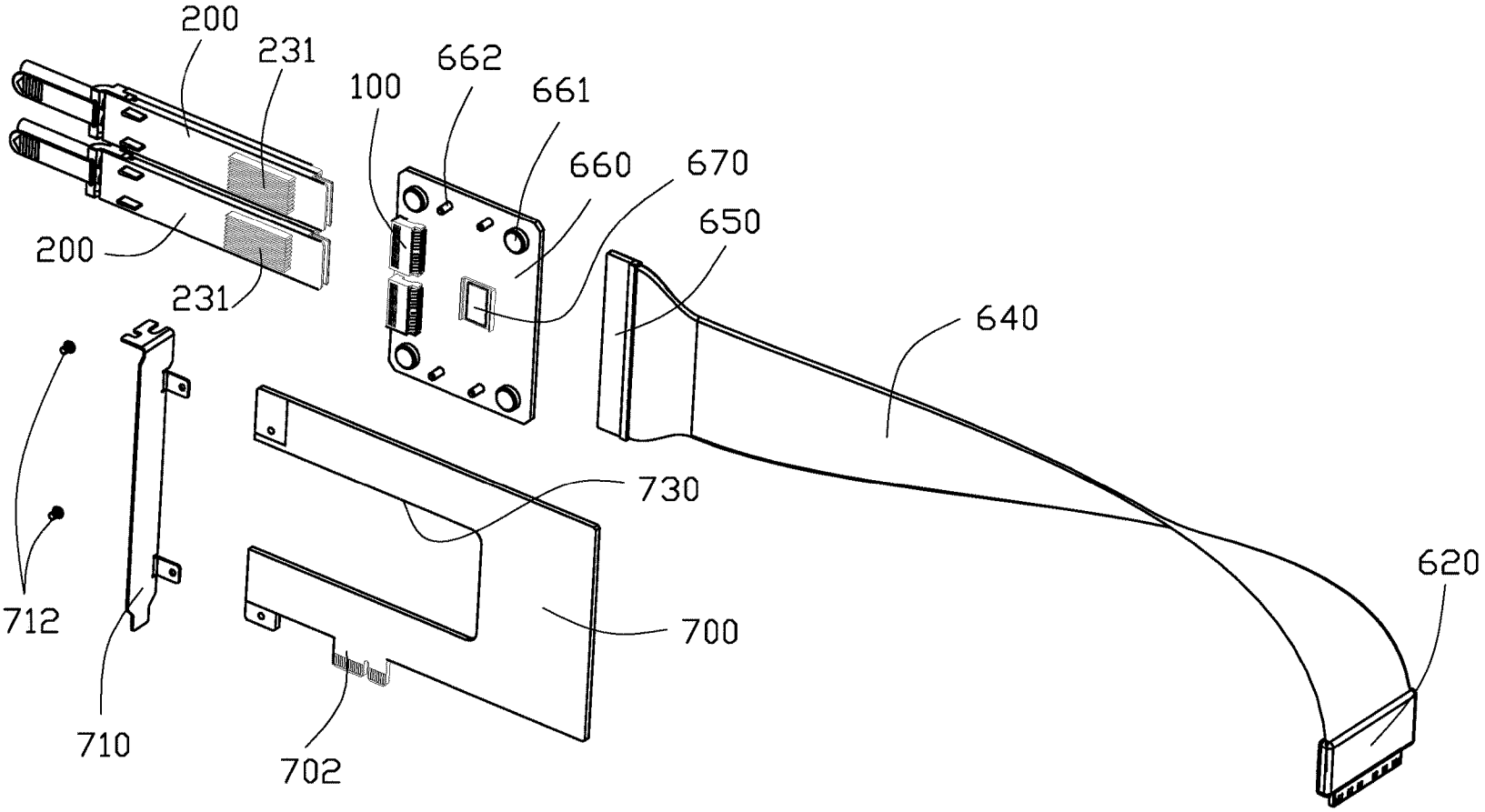
FIG. 24(A) is a further exploded perspective view of the connection system of FIG. 23(A)
Figure 24B:
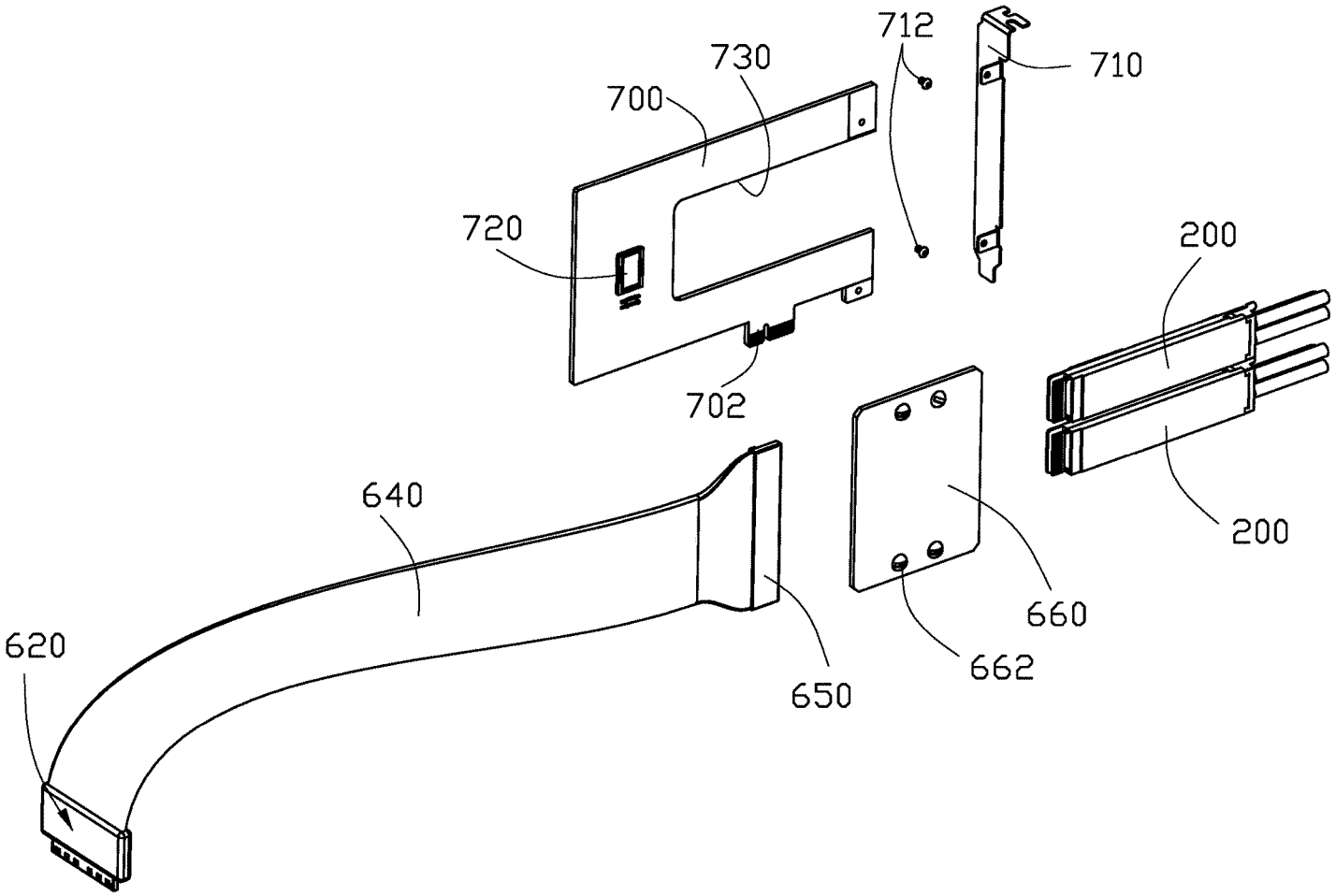
FIG. 24(B) is another further exploded perspective view of the connection system of FIG. 24(A)
Figure 25:
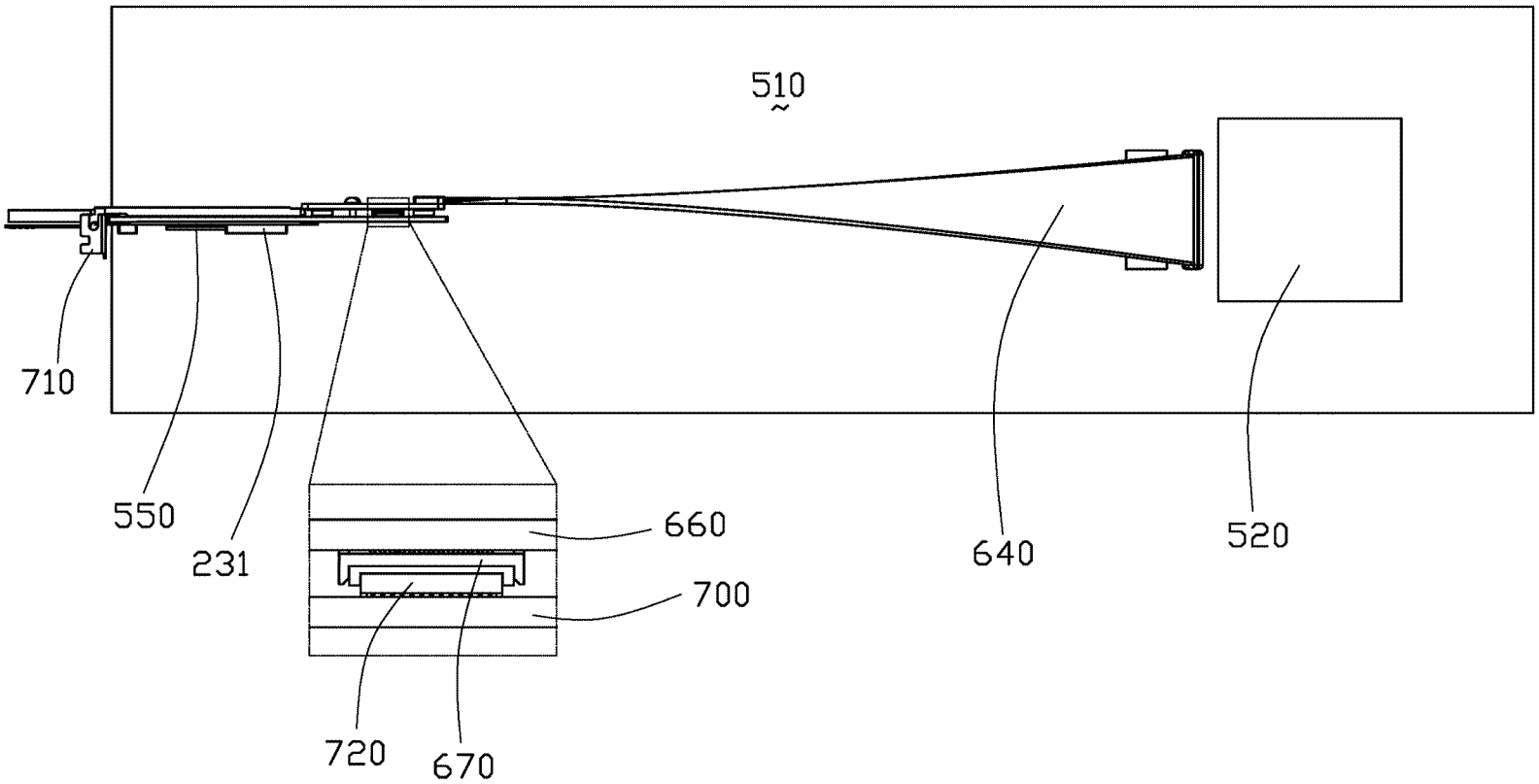
FIG. 25 is a top view of the connection system of FIG. 22(A)
Figure 25A:
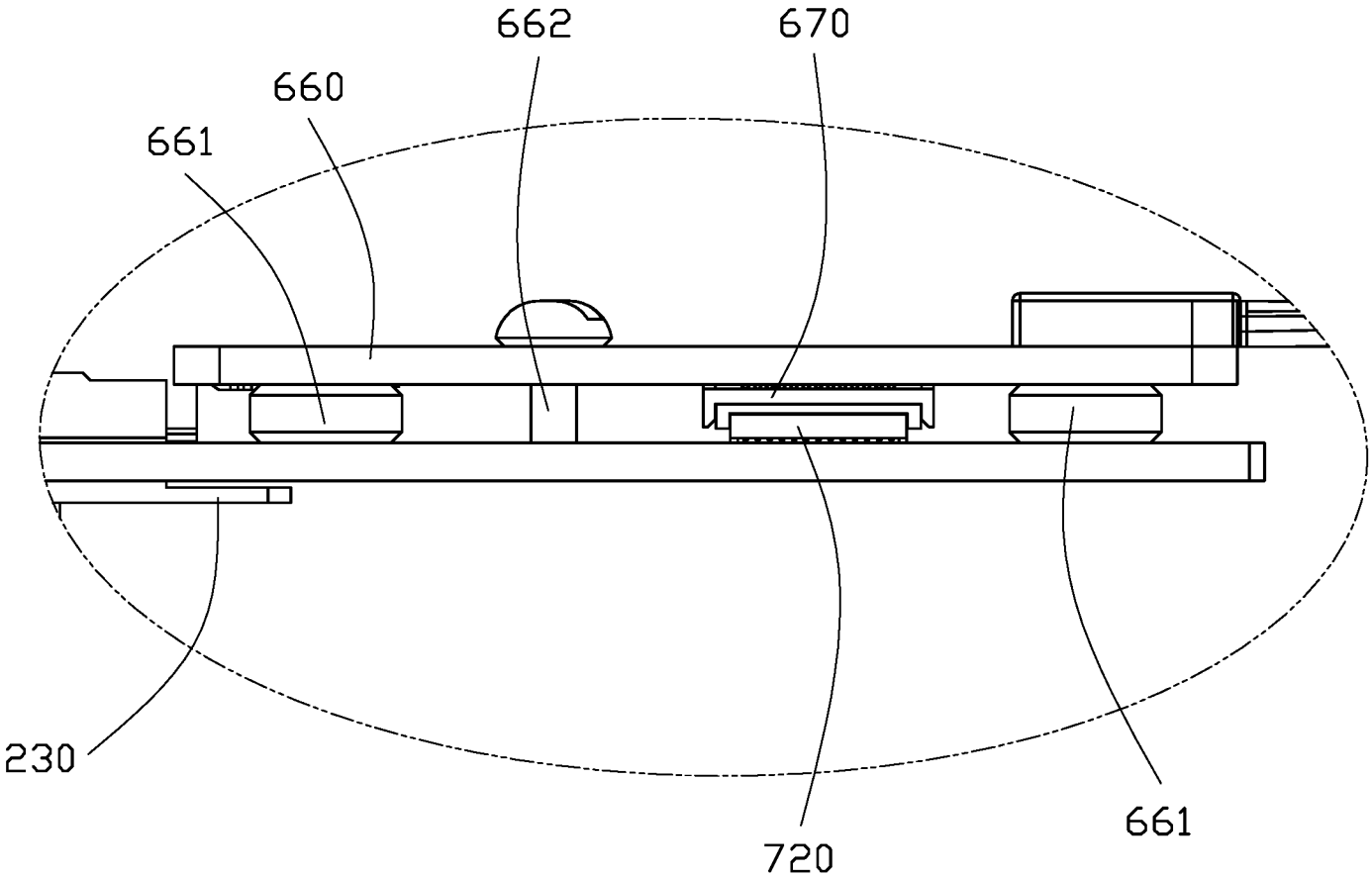
FIG. 25(A) is a partially enlarged view of the connection system of FIG. 25.
Figure 26:
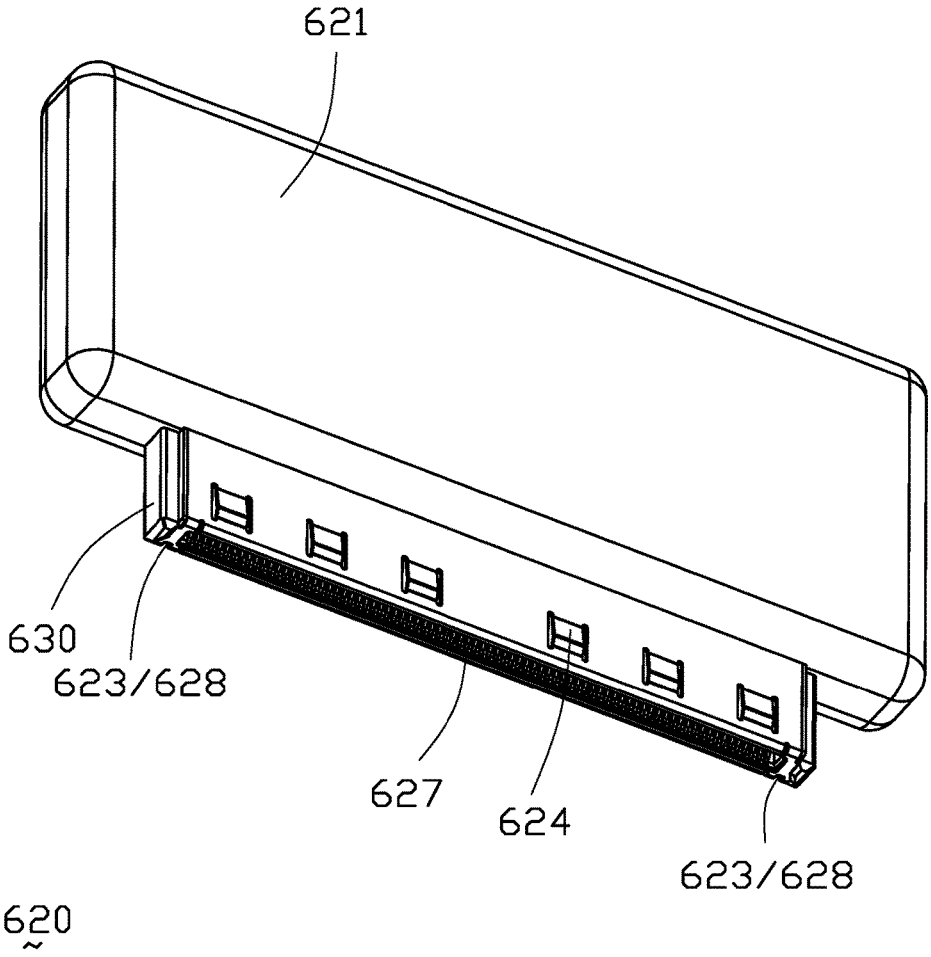
FIG. 26 is the perspective view of the plug connector used with the corresponding cable of the connection system of FIG. 22(A)
Figure 26A:
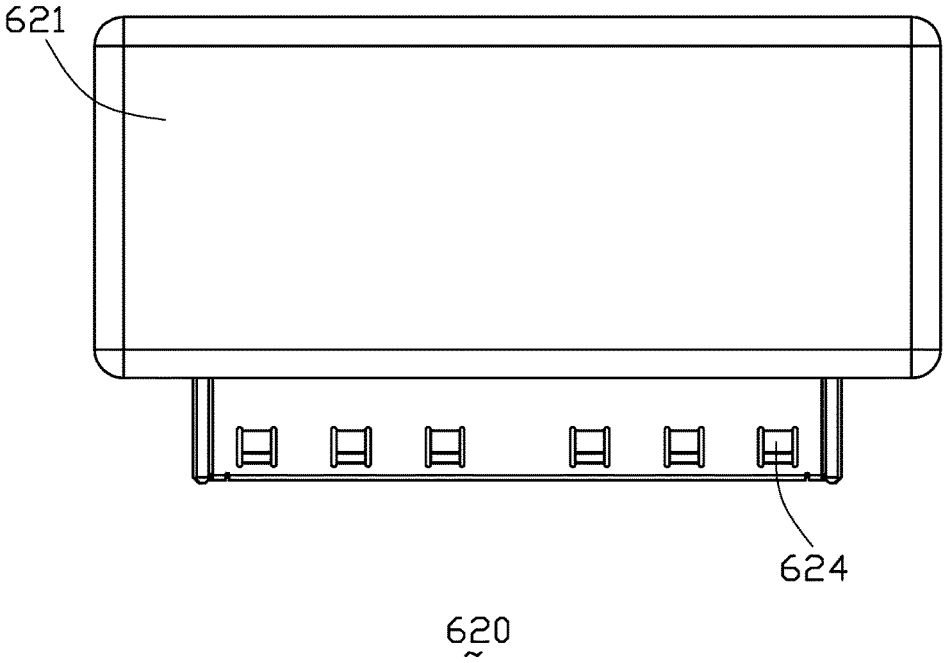
FIG. 26(A) is an elevational view of the plug connector of FIG. 26.
Figure 26B:
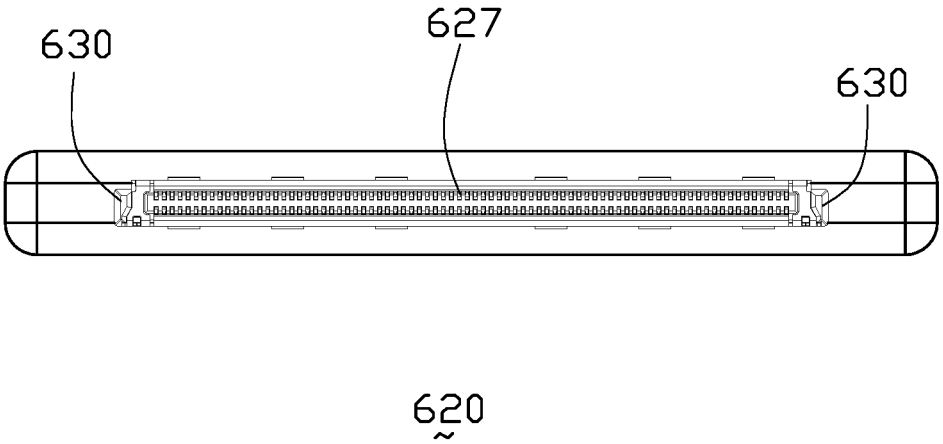
FIG. 26(B) is a bottom view of the plug connector of FIG. 26.
Figure 27:
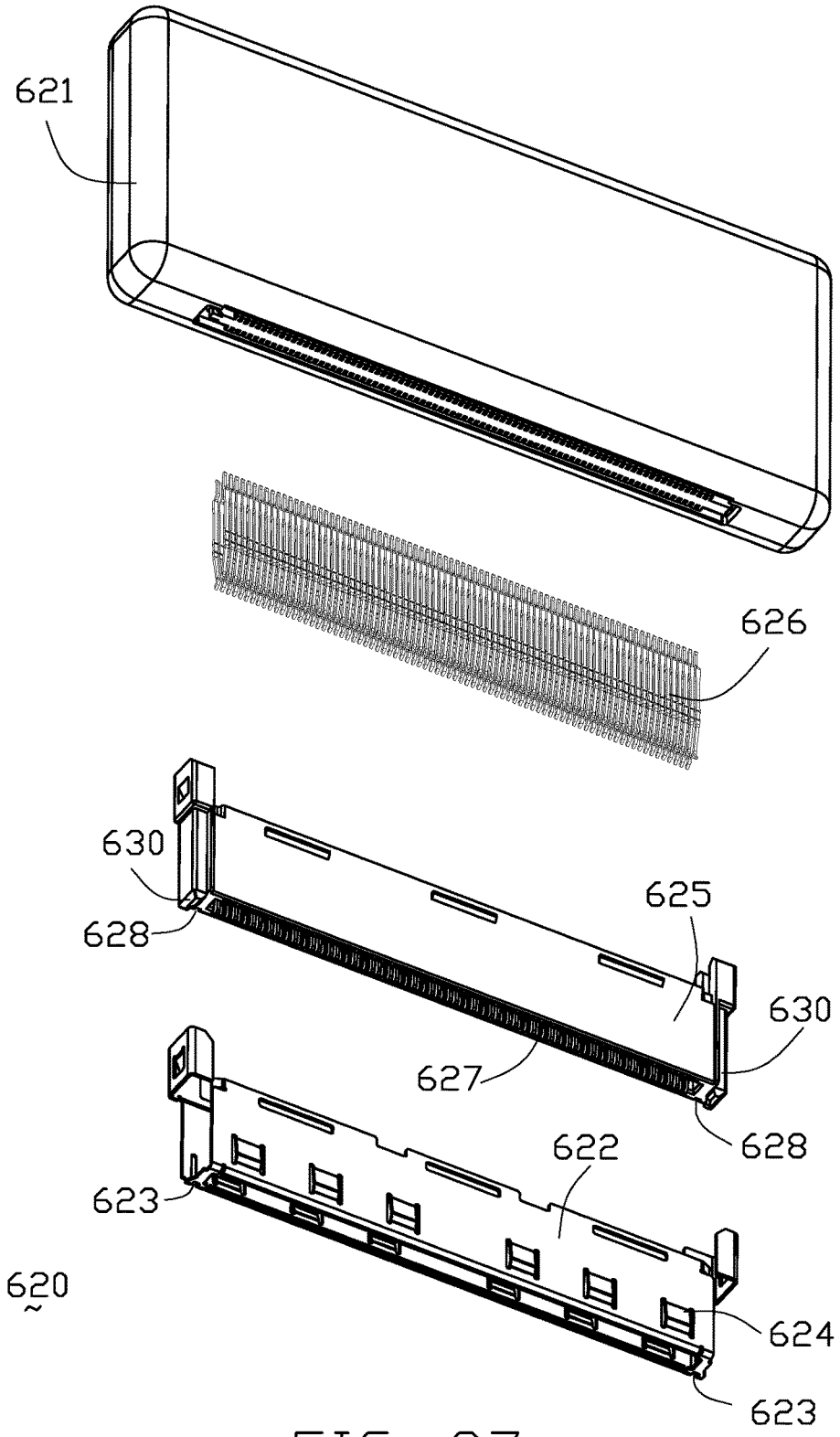
FIG. 27 is an exploded perspective view of the plug connector of FIG. 26.
Figure 28:
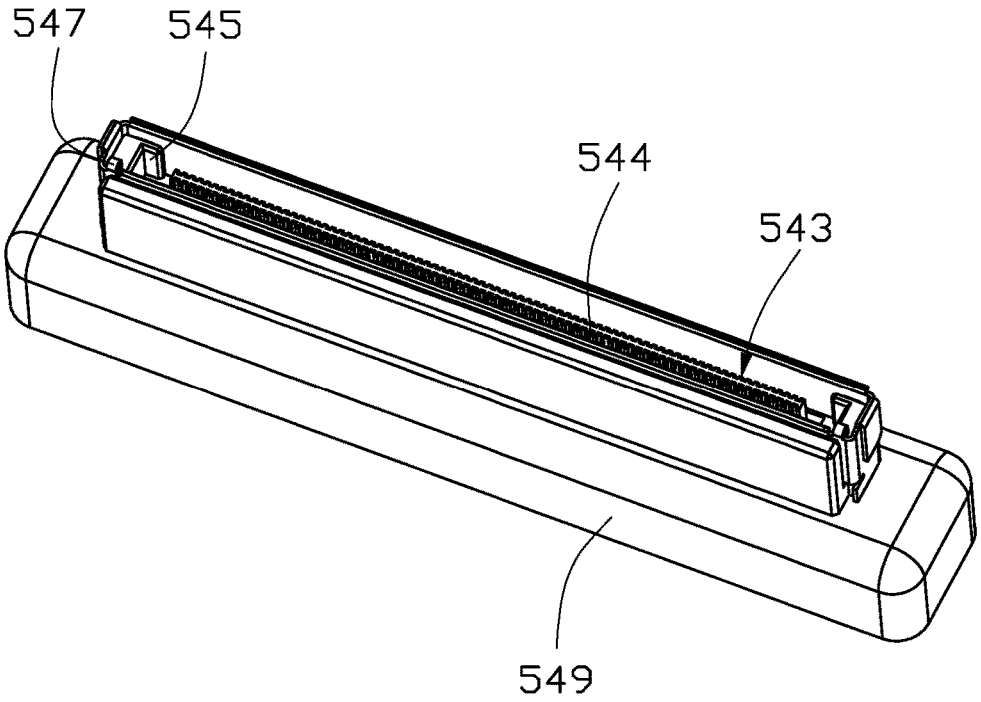
FIG. 28 is a perspective view of the receptacle connector used with the system board of the connection system of FIG. 22(A)
Figure 28A:
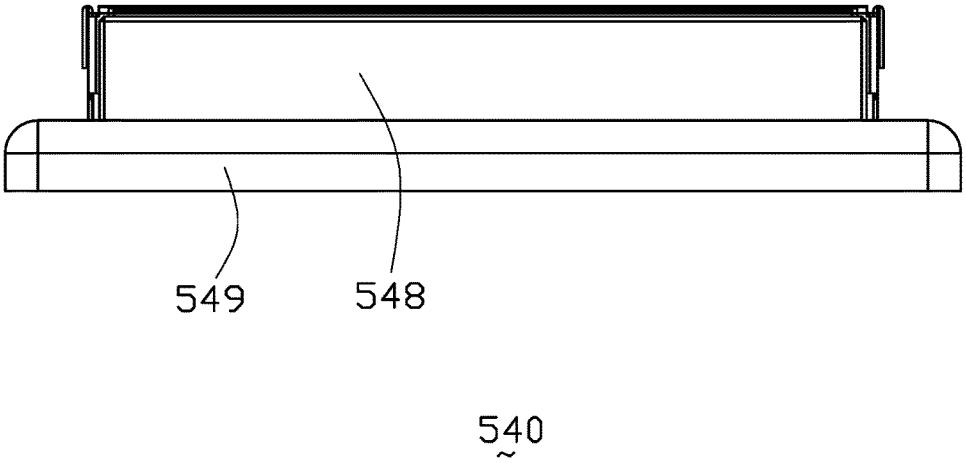
FIG. 28(A) is an elevational view of the receptacle connector of FIG. 28.
Figure 28B:
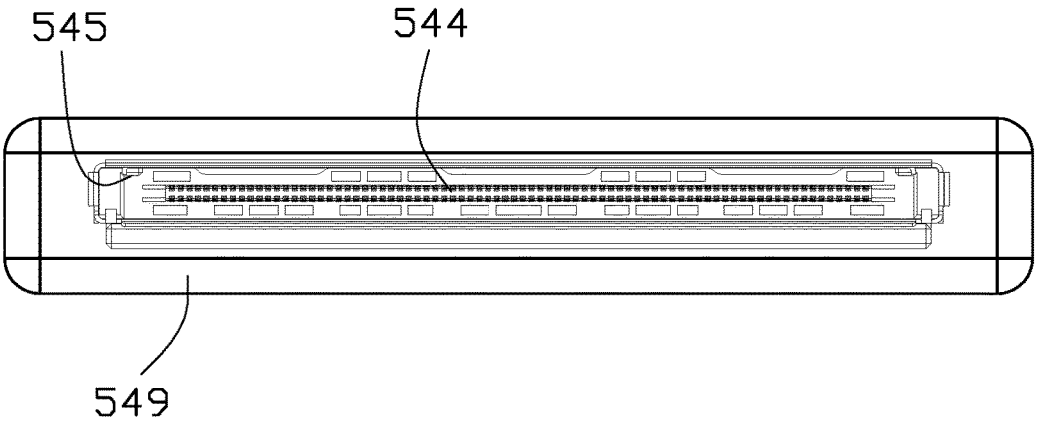
FIG. 28(B) is a top view of the receptacle connector of FIG. 28.
Figure 29:
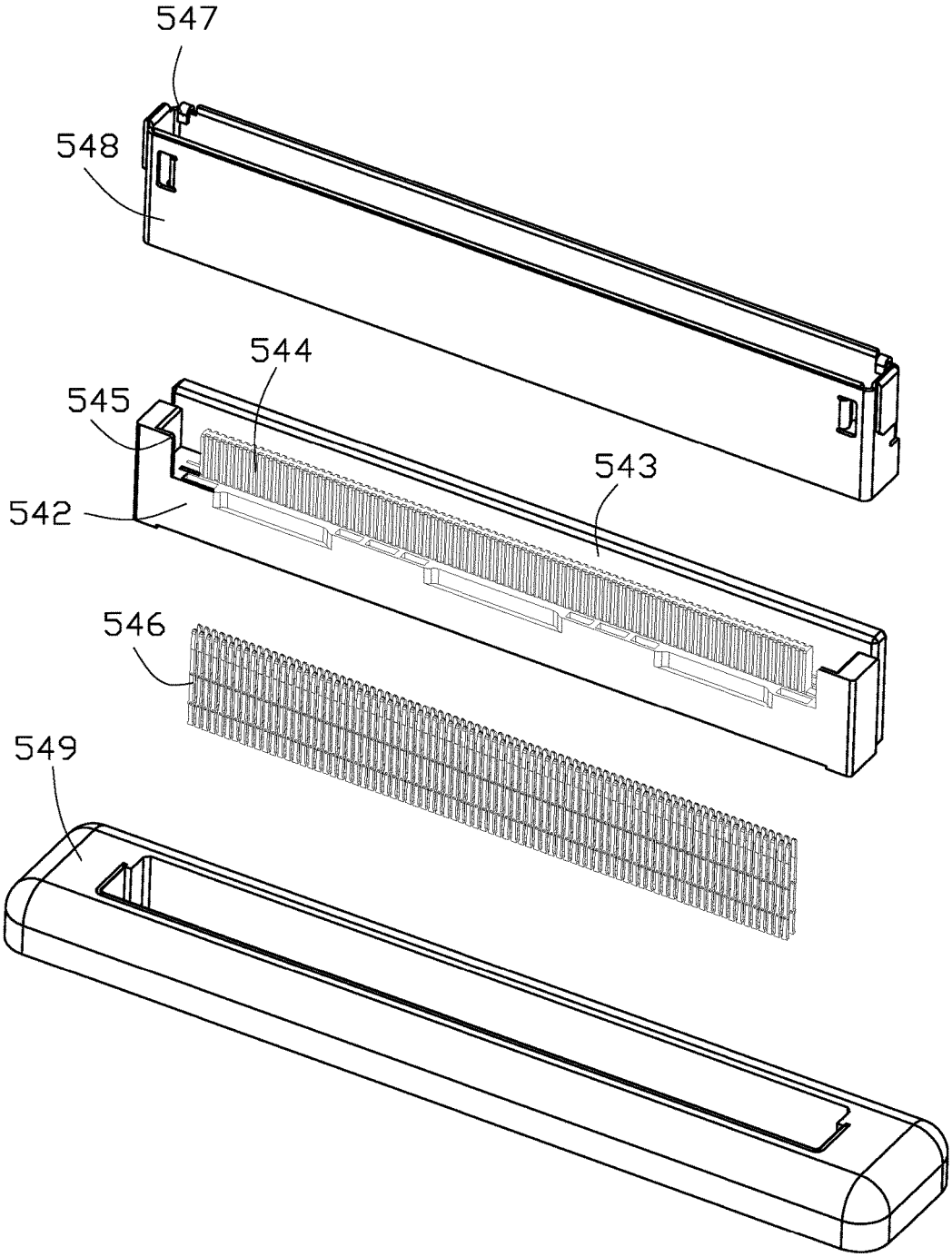
FIG. 29 is an exploded perspective view of the receptacle connector of FIG. 28.
Figure 30A:
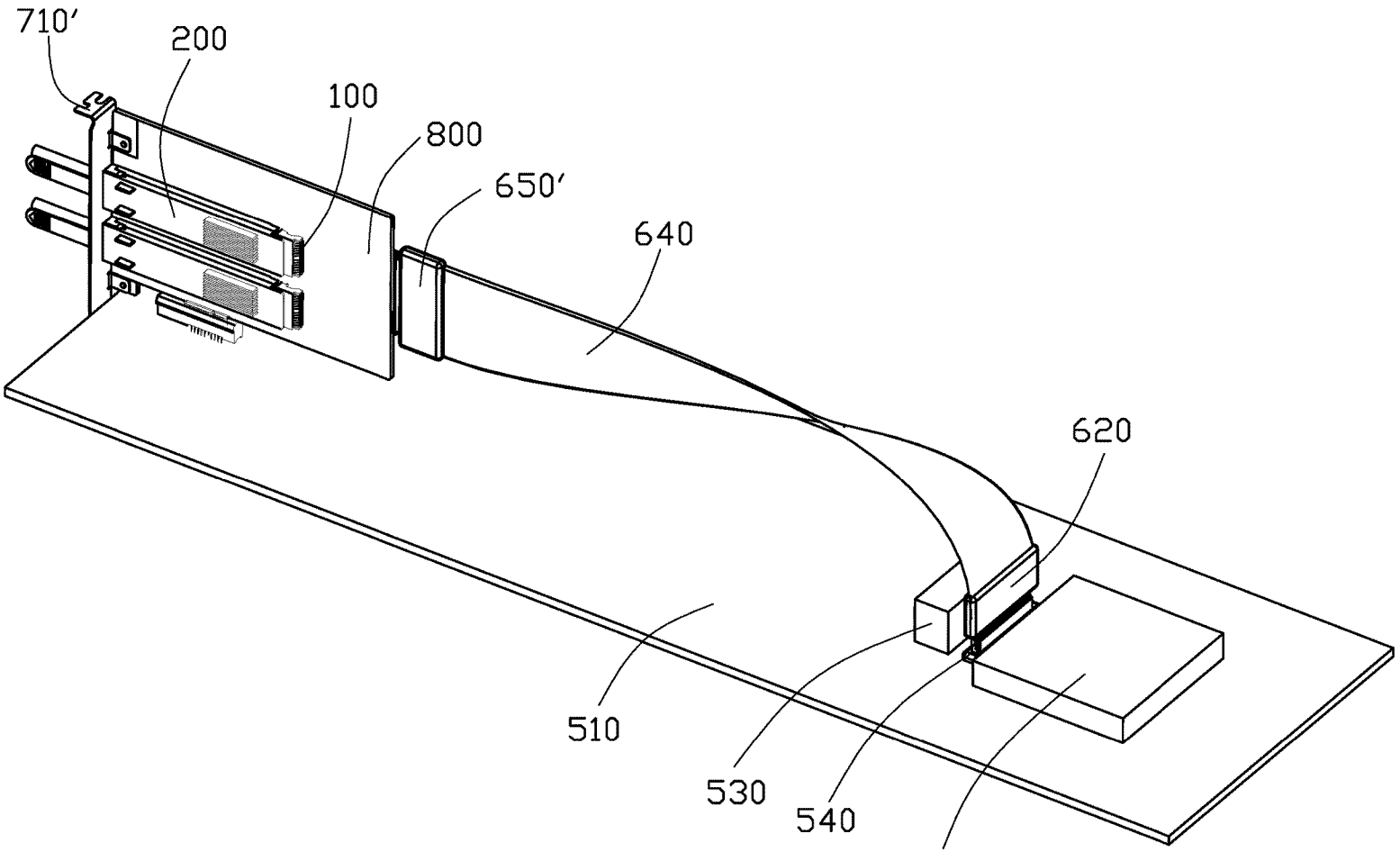
FIG. 30(A) is a perspective view of another embodiment of the connection system using the mated plug connector and receptacle connector of FIG. 1.
Figure 30B:
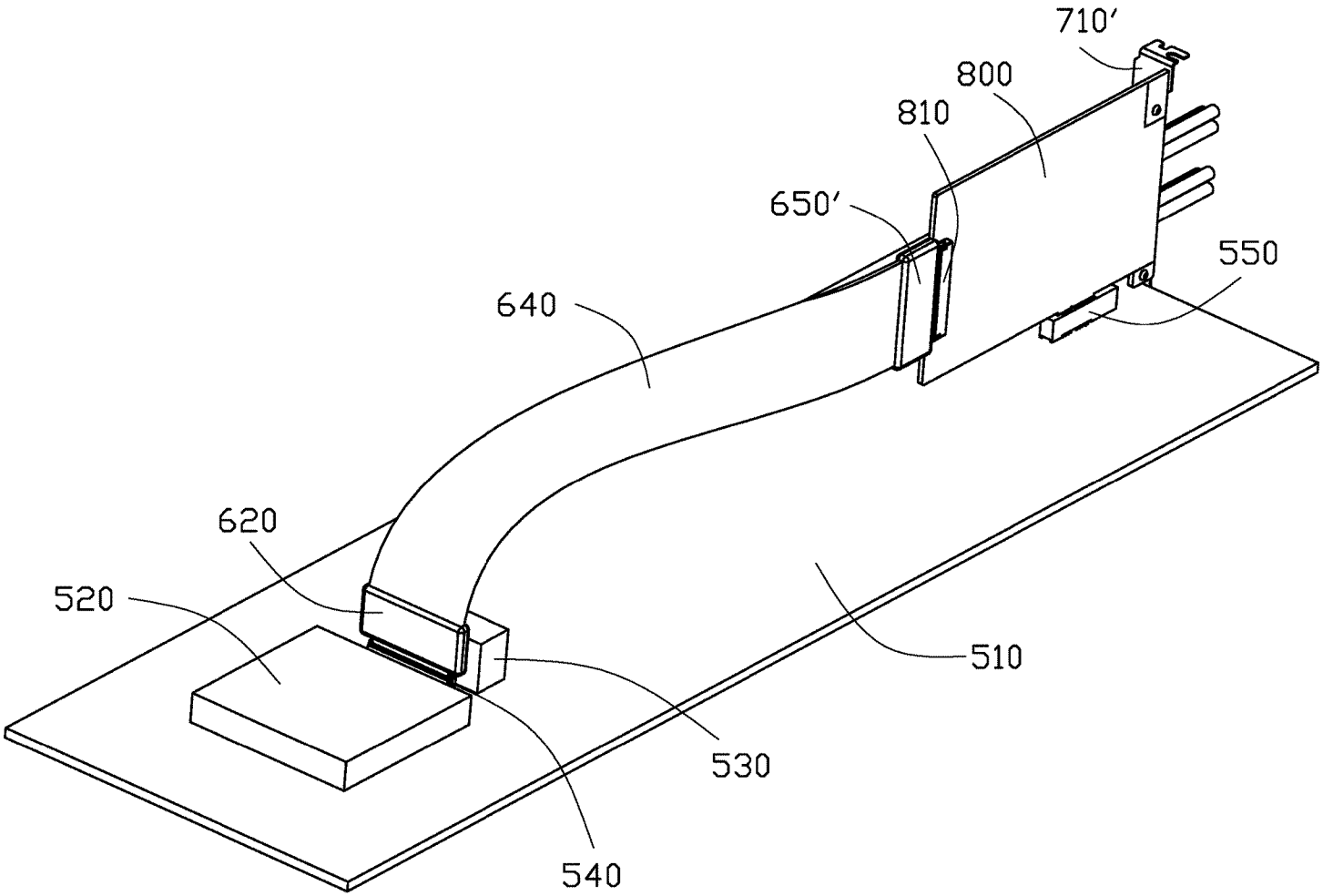
FIG. 30(B) is another perspective view of the connection system of FIG. 26.
Figure 31A:
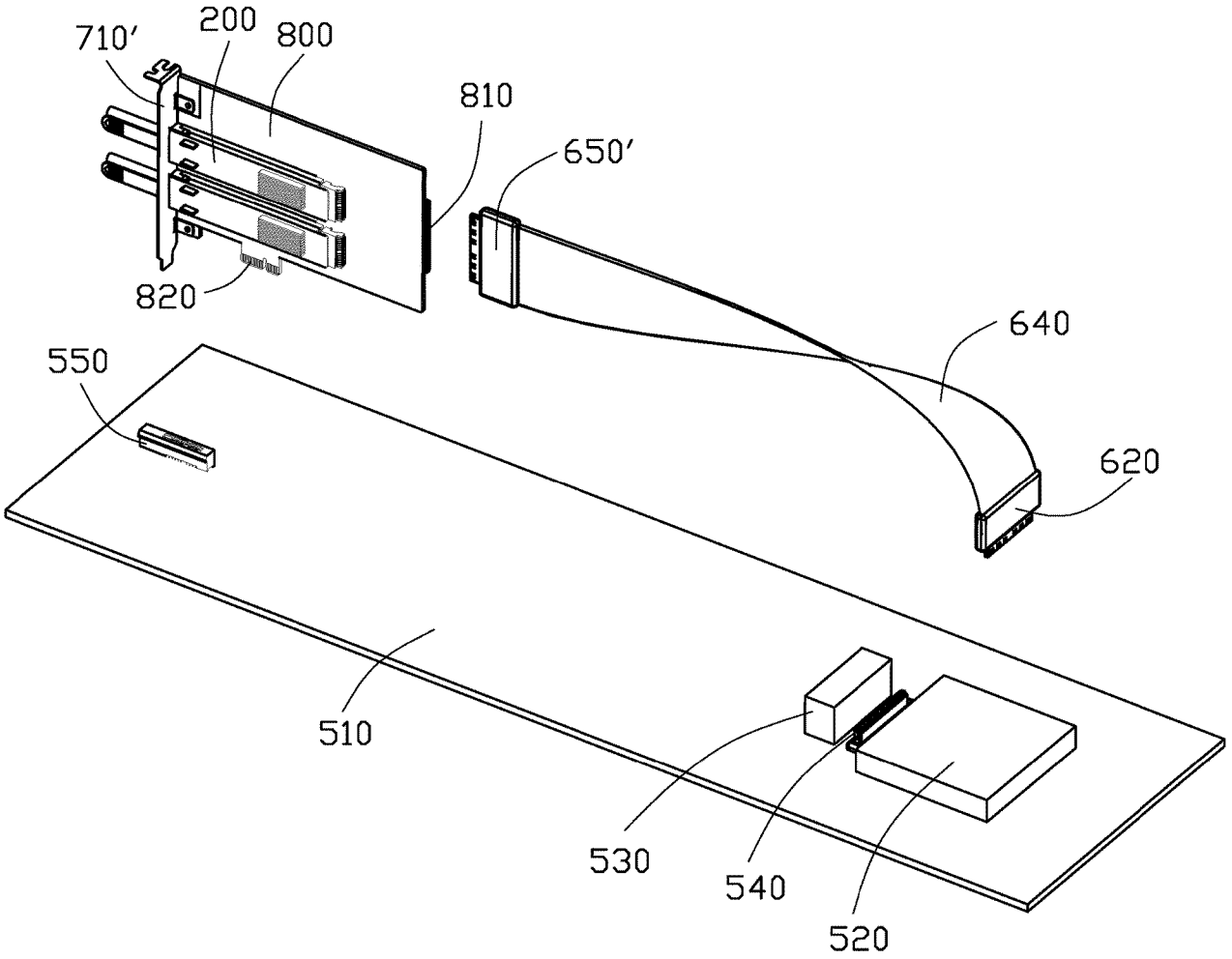
FIG. 31(A) is an exploded perspective view of the connection system of FIG. 30(A)
Figure 31B:
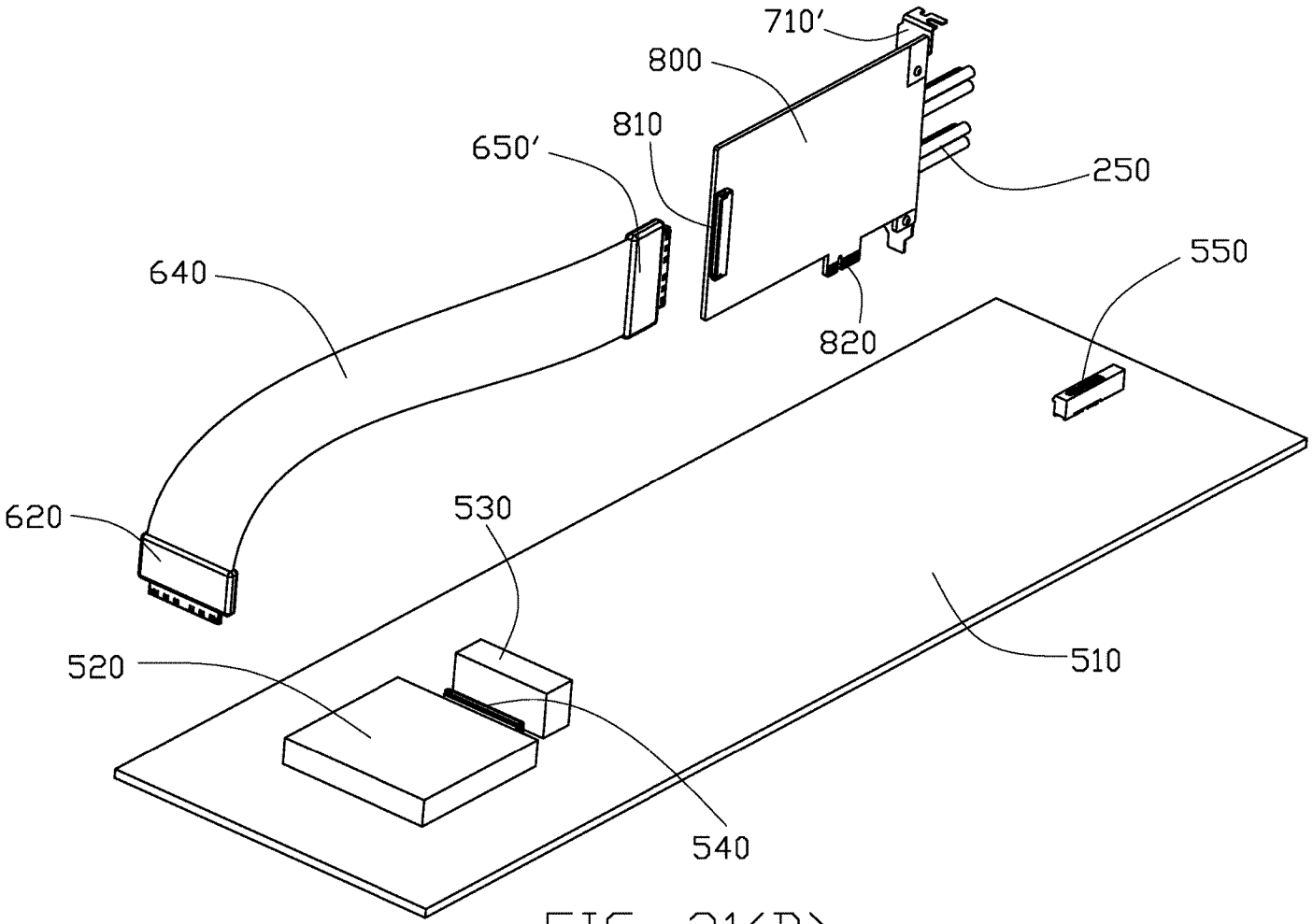
FIG. 31(B) is another exploded perspective view of the connection system of FIG. 30(A)
Figure 32A:
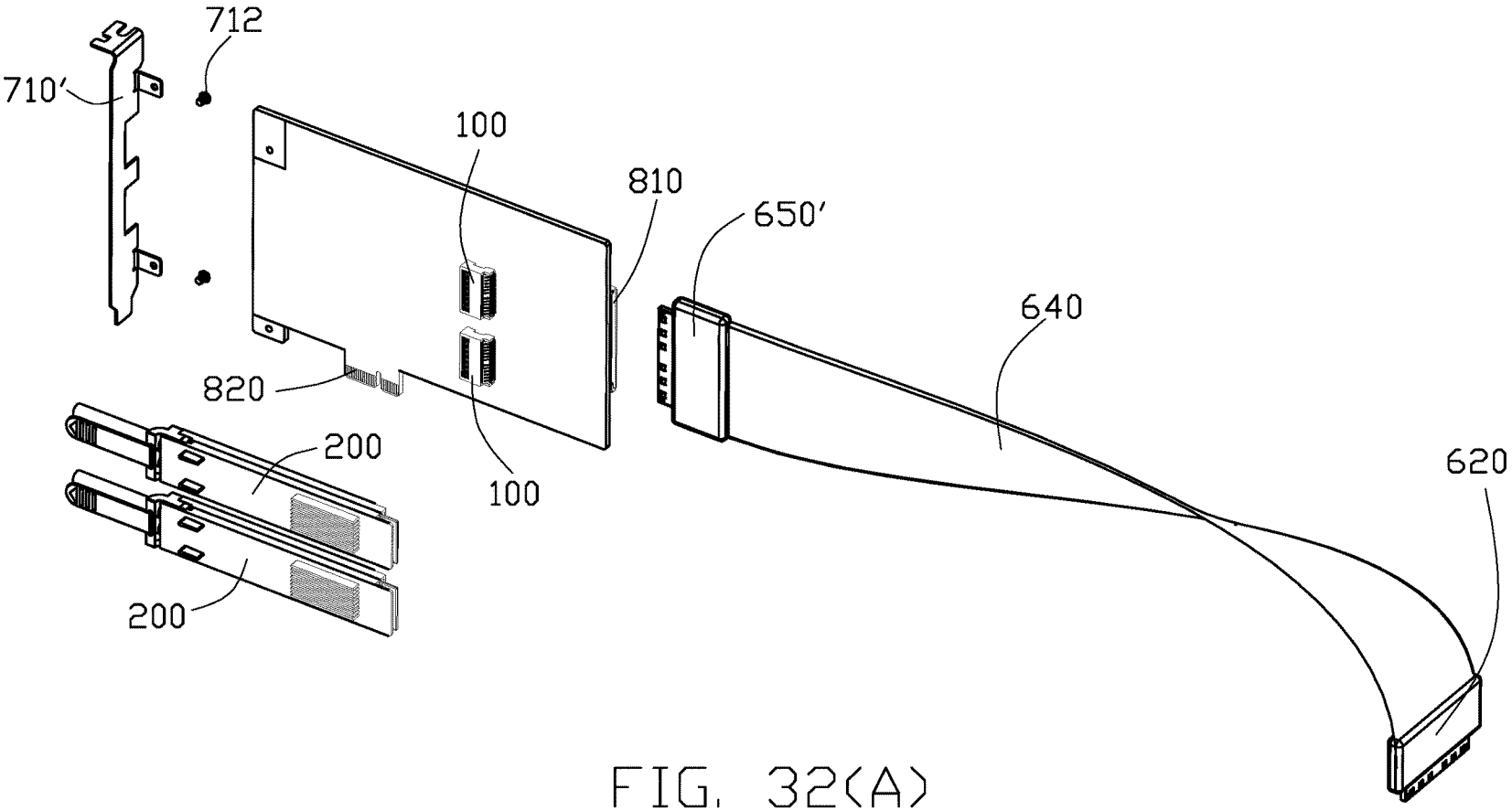
FIG. 32(A) is a further exploded perspective view of the connection system of FIG. 30(A)
Figure 32B:
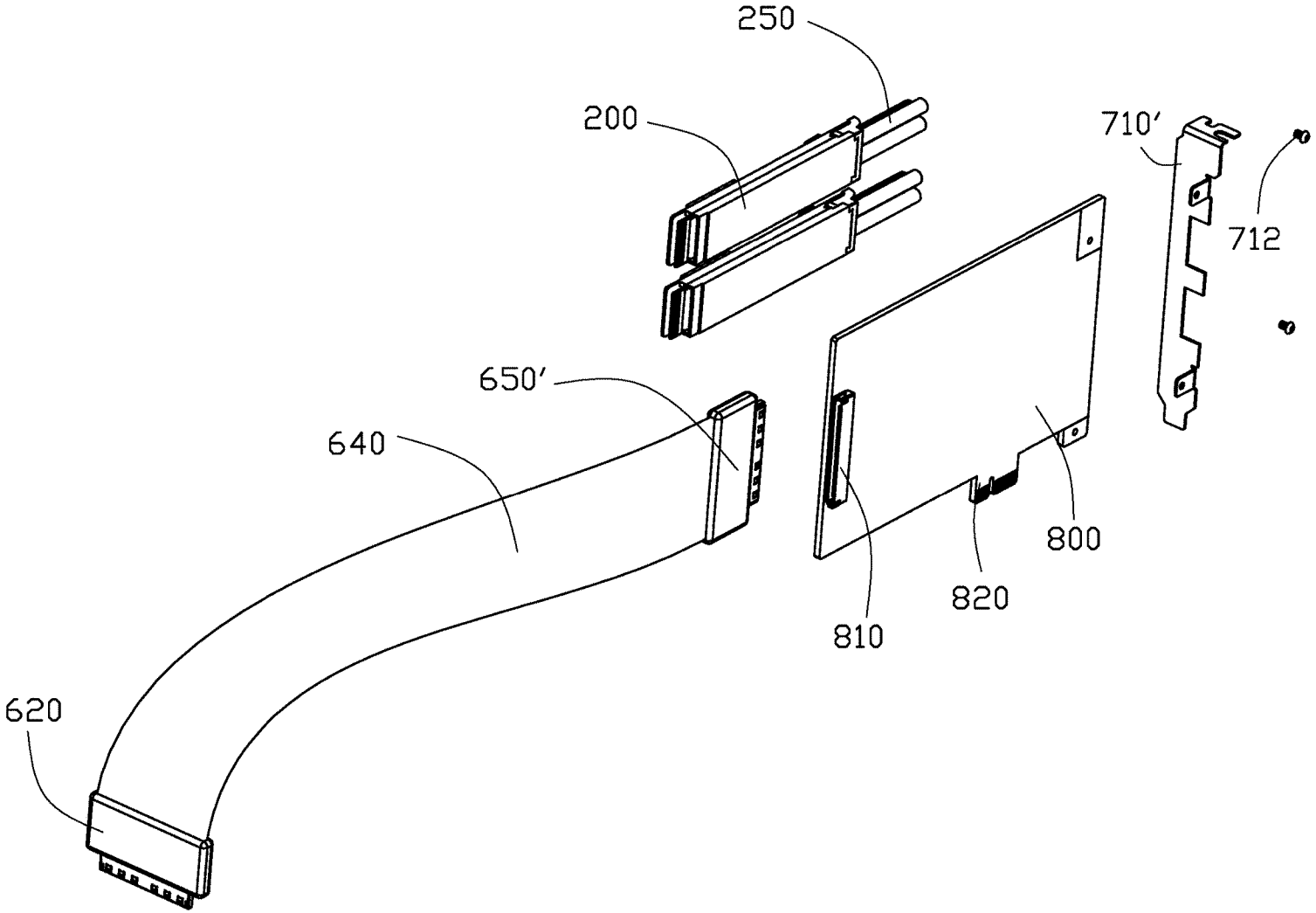
FIG. 32(B) is another further exploded perspective view of the connection system of FIG. 30(A)
Figure 33:
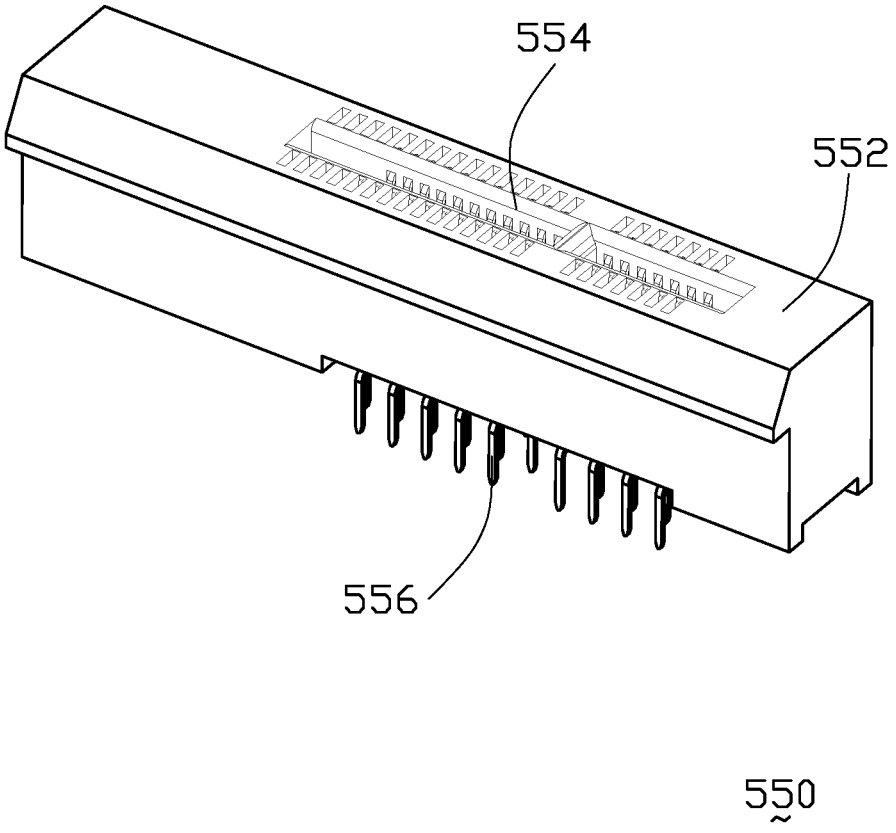
FIG. 33 is a perspective view of the card edge connector interfaced between the add-on card and the system board of the connection system of FIG. 22(A)
Figure 34:
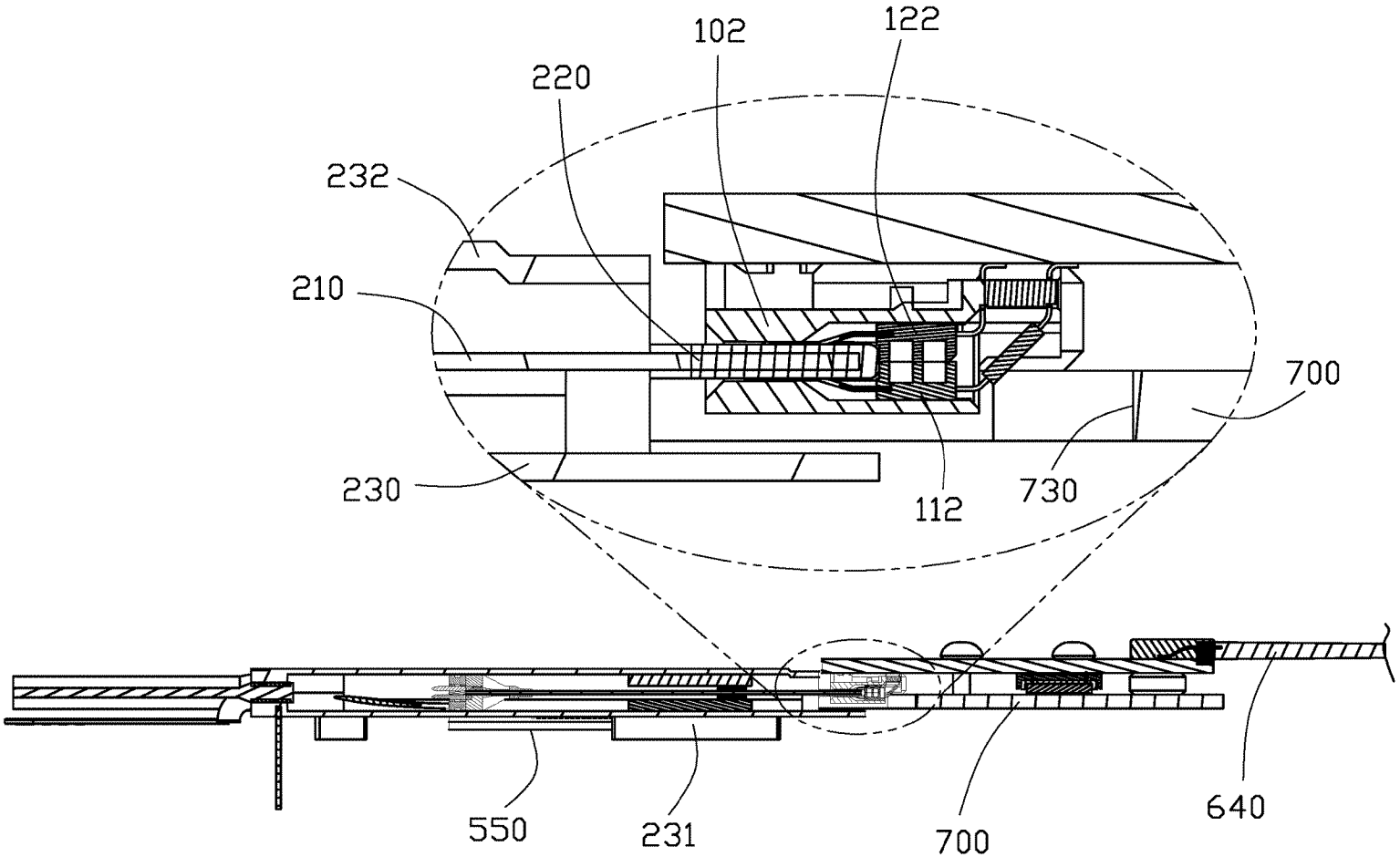
FIG. 34 is a top view of the connection system of FIG. 22(A)
Figure 35:
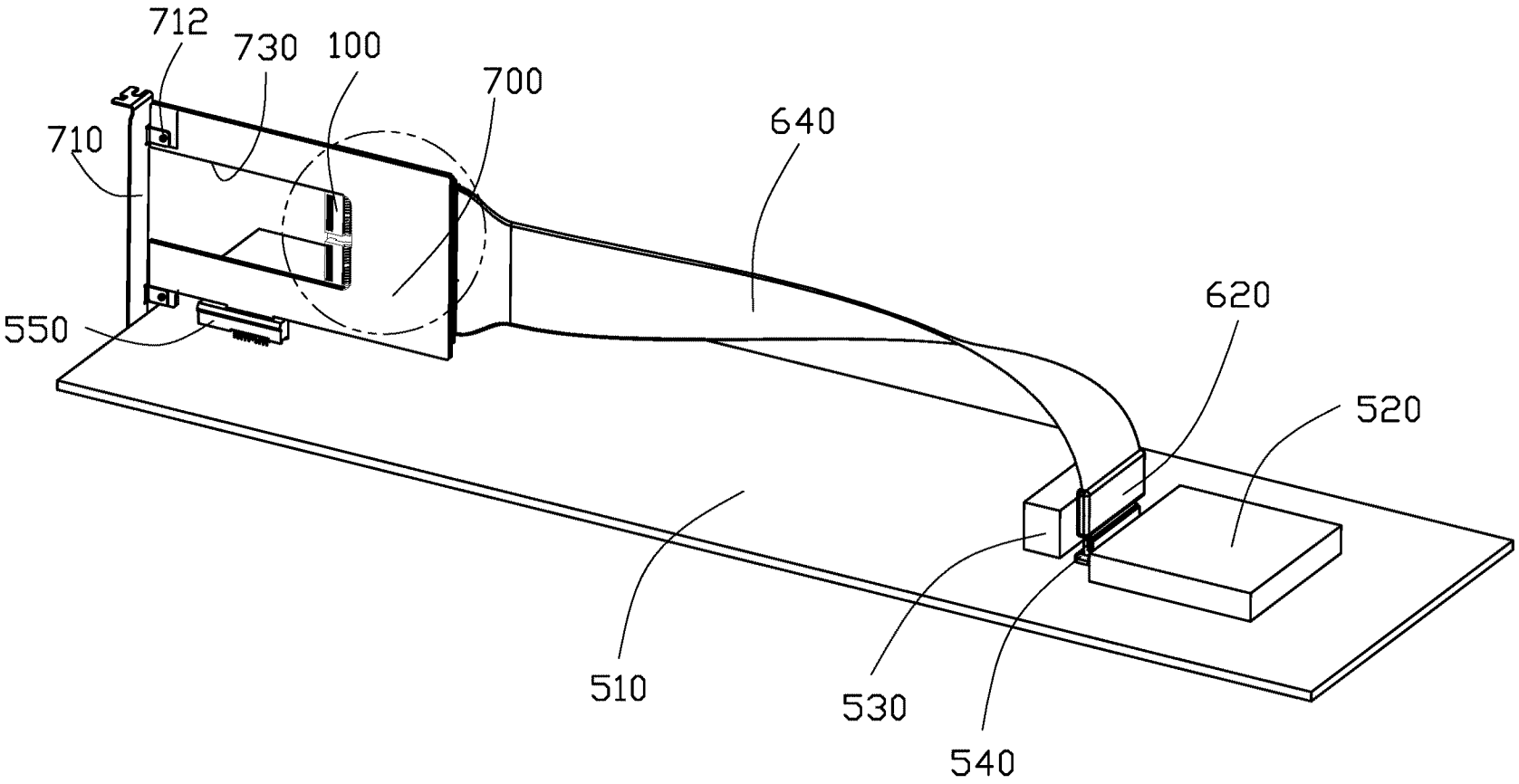
FIG. 35 is a perspective view of the connection system of FIG. 22(A) without the cable connector.
Figure 35A:
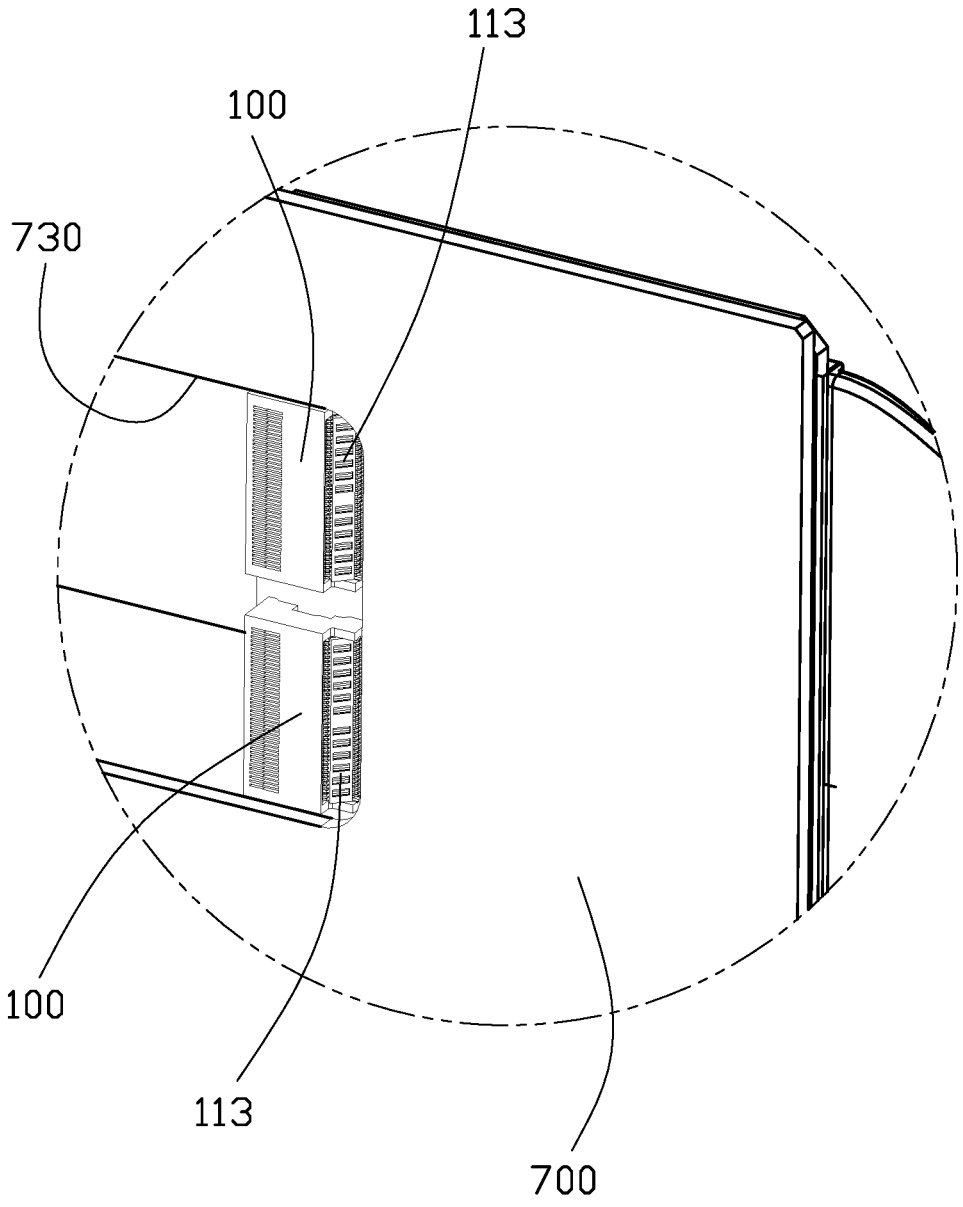
FIG. 35(A) is a partially enlarged perspective view of the connection system of FIG. 35.
Figure 36A:
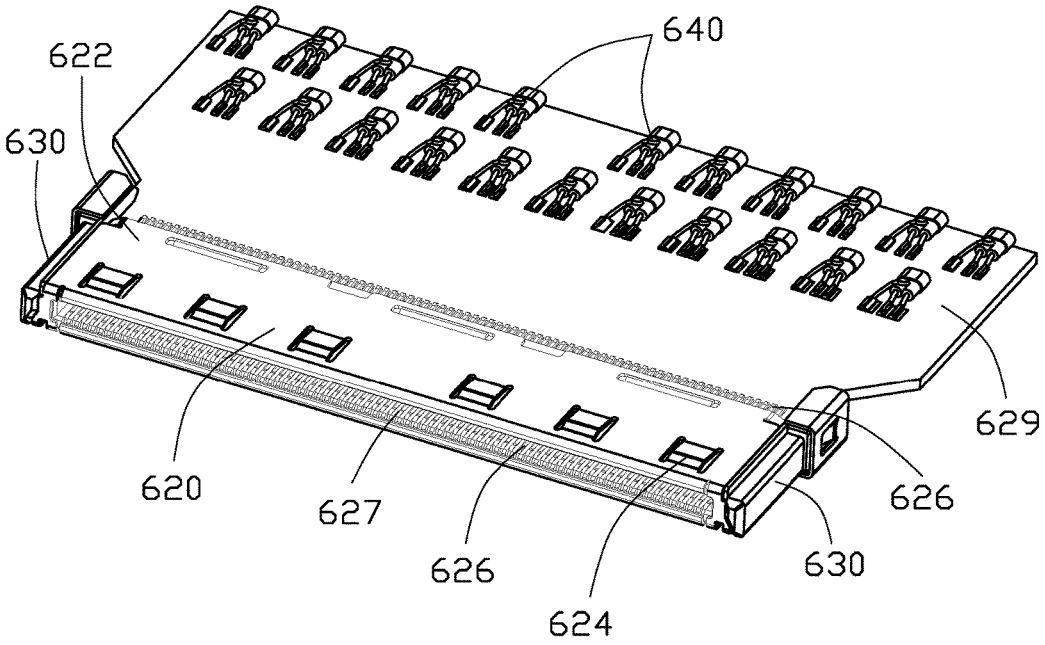
FIG. 36(A) is a perspective view showing an internal part of the plug connector of FIG. 26.
Figure 36B:
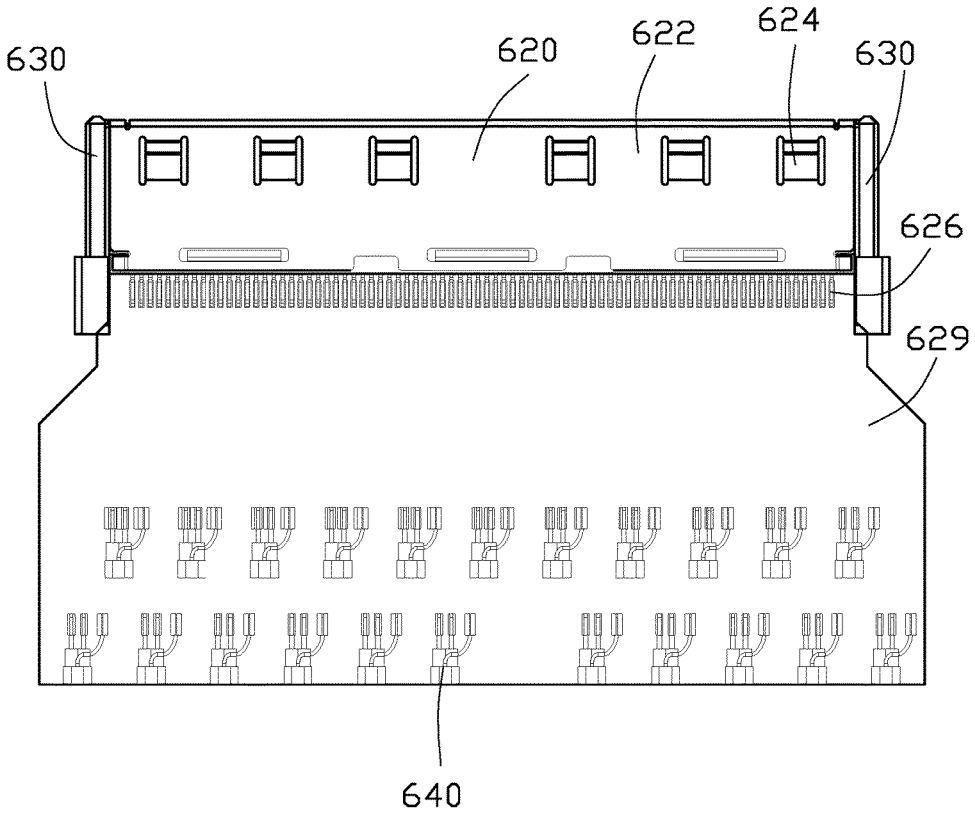
FIG. 36 (B) is a plan view of the internal part of the plug connector of FIG. 36(A)
Figure 37:
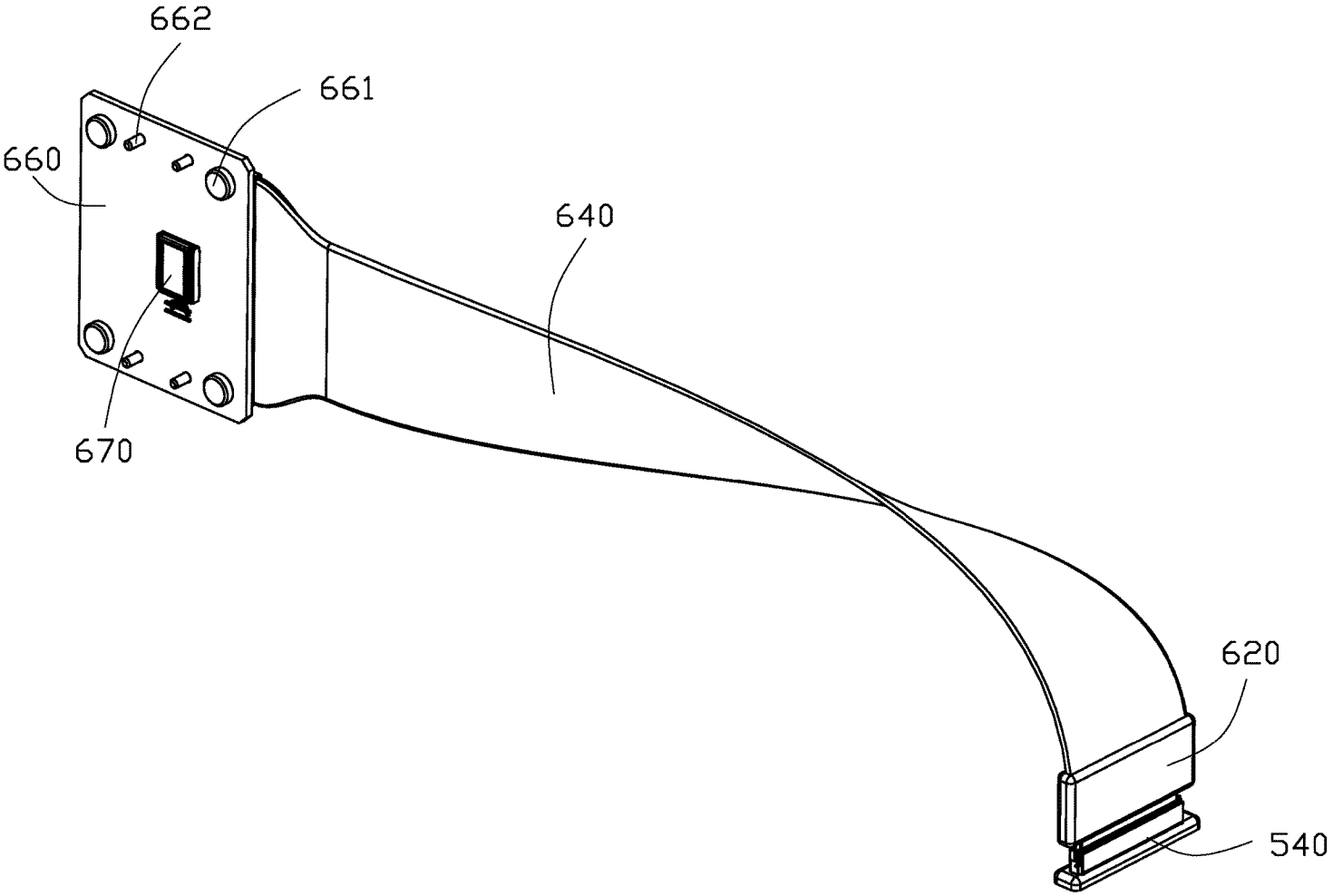
FIG. 37 is a perspective view of the add-on card and the corresponding cable connected thereon of FIG. 22(A)
Figure 38:
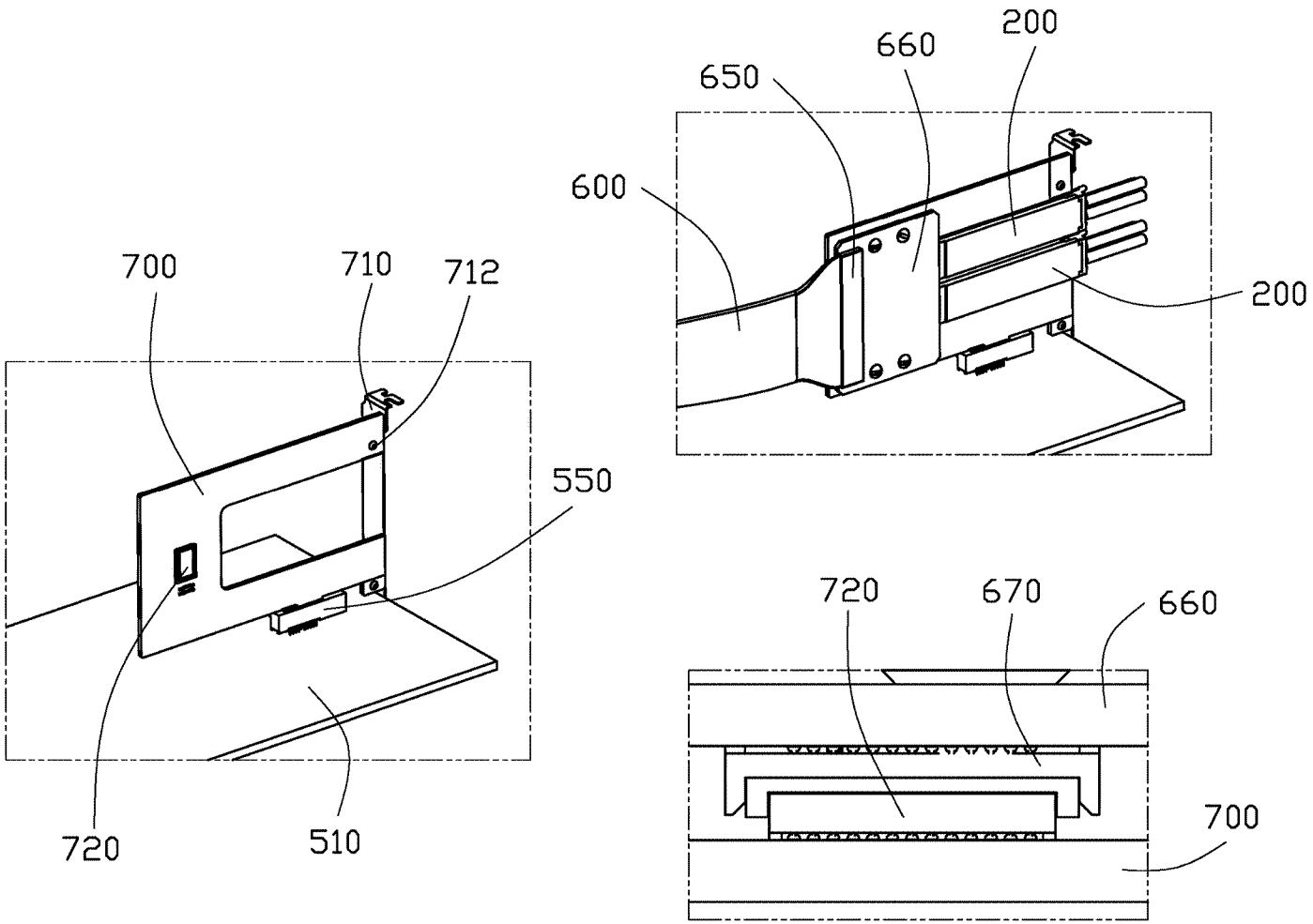
FIG. 38 is a perspective view of the add-on card and the associated module card of FIG. 22(A)
Figure 39:
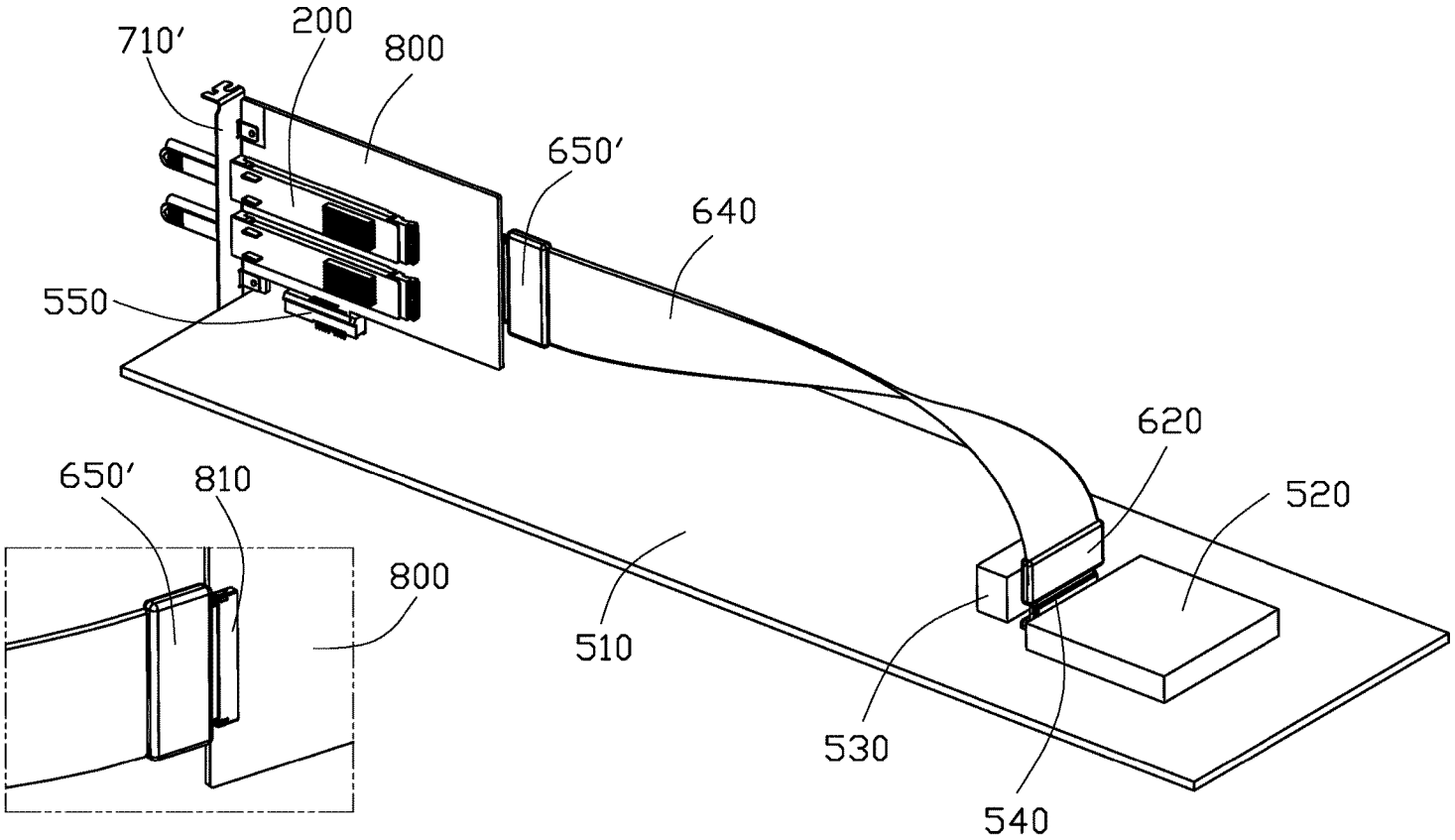
FIG. 39 is a perspective view of the connection system of FIG. 30(A)

Referring to FIGS. 1-21(B), an electrical connector assembly 1 includes a receptacle connector 100 and a plug connector 200, i.e., 25 Gb/s SMP9 connector, adapted to mated with each other. The receptacle connector 100 adapted to be mounted upon a printed circuit board 300, includes an insulative housing 102 forming a front mating cavity 104 and a rear receiving space 106 therein. A terminal module assembly 108 is inserted into the receiving space 106 from a rear side of the housing. The terminal module assembly 108 includes an upper terminal module 110 and a lower terminal module 120 stacked with each other. The upper terminal module 110 includes a plurality of upper contacts 111 retained by an upper insulator 112 and a tail insulator 113 via an insert-molding process wherein the contacting sections of the upper contacts 111 extend into the front mating cavity 104. The lower terminal module 120 includes a plurality of lower contacts 121 retained by a lower insulator 122 via another insert-molding process wherein the contacting sections of the lower contacts 211 extend into the front mating cavity 104 opposite to the contacting sections of the upper contacts 111 in the vertical direction. The upper insulator 112 forms an upper protrusion 114 received in the corresponding recess 103 in an upper interior face of the housing 102, and a lower protrusion 115 received in the corresponding recess 123 in the lower insulator 122. The lower insulator 122 forms a lower protrusion 124 received in the corresponding recess 104 in a lower interior face of the housing 102. A pair of lateral projections 125 are formed on two opposite lateral sides of the lower insulator 122 for receipt within the corresponding grooves 105 in the housing 102. A spacer 130 is located between the upper terminal module 110 and the lower terminal module 120 to have the upper contacts 111 and the lower contacts 121 spaced from each other. The housing 102 forms a pair of channels 107 in the housing 102.

The plug connector 200 includes an internal printed circuit board 210, a contact module 220 disposed upon a front region of the printed circuit board 210 to form a mating tongue thereof for insertion into the front mating cavity 104 of the receptacle connector 100, and cables 250 mechanically and electrically connected to a rear region of the printed circuit board 210. A plurality of electronic components 290 mounted upon a middle region of the printed circuit board 210, and a thermal interface material 292 seated thereupon. A die-casting cover includes a top cover 230 and a bottom cover 232 are assembled together to form therebetween an space receiving the printed circuit board 210 therein. A latch structure 234 is attached to the cover and a pull tape 236 is linked on the rear end of the latch structure 224 for pulling the latch structure during unlatching the plug connector from the corresponding cage (not shown) in which the receptacle connector 100 is received.

The contact module 220 includes a plurality of contacts 221 embedded within an insulator 223 via an insert-molding process wherein the contact tail 225 of the contacts 221 are soldered upon the corresponding pads of the printed circuit board 210. A fin structure 231 is formed on the top cover 230. The thermal interface material 292 contacts an inner surface of the cover and sandwiched between the cover and the corresponding electronic components 290 in the vertical direction.

Each of the cables 250 includes a plurality of TX differential pairs 252 arranged in front and rear rows and soldered upon the upper surface 2101 of the printed circuit board 210, and a plurality of RX differential pairs 254 arranged in front and rear rows and soldered upon the bottom surface 2102 of the printed circuit board 210. The TX differential pairs 252 arranged in front row are offset with the TX differential pairs 252 arranged in the rear row along transverse direction. The RX differential pairs 254 arranged in front row are offset with the RX differential pairs 254 arranged in the rear row along transverse direction. A wire organizer assembly 260 includes a middle part 262 with upper and lower rows of holes 264, an upper part 266 with one row of holes 267, and a lower part 268 with one row of holes 269. The TX differential pairs 252 in the front row extend through the corresponding holes 267, and the TX differential pairs 252 in the rear row extend through the corresponding holes 264 in the upper row; the RX differential pairs 254 in the front row extend through the corresponding holes 269, and the RX differential pairs 254 in the rear row extend through the corresponding holes 264 in the lower row. The middle part 262 forms retaining holes 270, 272 to receive the corresponding retaining posts 274, 276 on the upper part 266 and the lower part 268. The middle part 262 further includes differently sized protrusions inside of the channel structures 278, 280 for compliance with the differently sized cutouts 214, 213 in the printed circuit board 210. Each of the upper part 266, the middle part 262 and the lower part 258 further forms a groove 282 for receiving glue therein.

To assemble the cable 250 to the printed circuit board 210 is as follows. The TX differential pairs 252 and the RX differential pairs 252 extend through the corresponding holes 264 and fixed therein by the glue applied into the middle part 262 via the groove 282. The middle part 262 is aligned and assembles to the printed circuit board 210 via the channel structures 278, 280. with the TX and RX differential pairs respectively soldered upon the upper surface 2101 and the lower surface 2102 of the printed circuit board 210. The upper part 266 and the lower part 268 are assembled upon the middle part 262. The remaining TX differential pair 252 and RX differential pairs 254 extend through the corresponding holes 267, 269. The rear glue protection 286 is applied upon the printed circuit board 210 to protectively fasten the TX and RX differential pairs 252, 254 and cover the soldering area of the TX and RX differential pairs 252, 254 in the rear row. The TX and RX differential pairs 252, 254 in the front row are soldered upon the printed circuit board 210. The front glue protection 288 is applied upon the printed circuit board 210 to protectively fasten the TX and RX differential pairs 252, 254 in the front row and the corresponding soldering area. It is noted that in this embodiment, the holes 264 are staggered with the holes 267, 269.

Referring to FIGS. 22(A)-44, the connection system 500 includes a main printed circuit board 510 with a CPU (Central Processing Unit) 520 mounted on one region, and a card edge connector 550 mounted on the opposite region. An electrical connector 540 is mounted upon the main printed circuit board 510 beside the CPU 520, and a keep-out-zone structure 530 is located beside the connector 520.

A jumper cable assembly includes a cable 640 with a first electrical connector 620 at a first end to connect to the connector 540, and a second electrical connector 650 at a second end to connect to a module card 660. Specifically referring to FIGS. 26-29, the first connector 620 includes an insulative housing 625 forming a receiving slot 627, and a pair of alignment slots 628 and the keyed structure 630 on two opposite ends. A metallic shell 622 encloses the housing 625 and forms a plurality of spring tangs 624 and a pair of alignment slits 623 corresponding to the alignment slots 628. A plurality of terminals 626 are disposed in the housing 625 with contacting sections extending into the receiving slot 627. A main body 621 is essentially located behind the housing 625 to form an internal room with therein a paddle card 629 on which the cable 640 is mounted via assistance of the wire organizer (not labeled) as shown in 36(A) and 36(B). Correspondingly, the connector 540 adapted to be mated with the first connector 620, includes an insulative housing 542 forming a receiving cavity 543 with a mating tongue 544 therein for reception within the receiving slot 627 during mating, and a pair of keyed structures 545 at two opposite ends for coupling to the corresponding key structures 630 during mating. A metallic shell 548 encloses the housing 542 with a pair of alignment tabs 547 received within the corresponding alignment slots/slits 628 and 623 during mating. A plurality of terminals 546 are disposed in the housing 542 with contacting sections exposed upon the mating tongue 544. A main body 549 is essentially located behind the housing 542 and seated upon the main printed circuit board 510.

Figure 40:
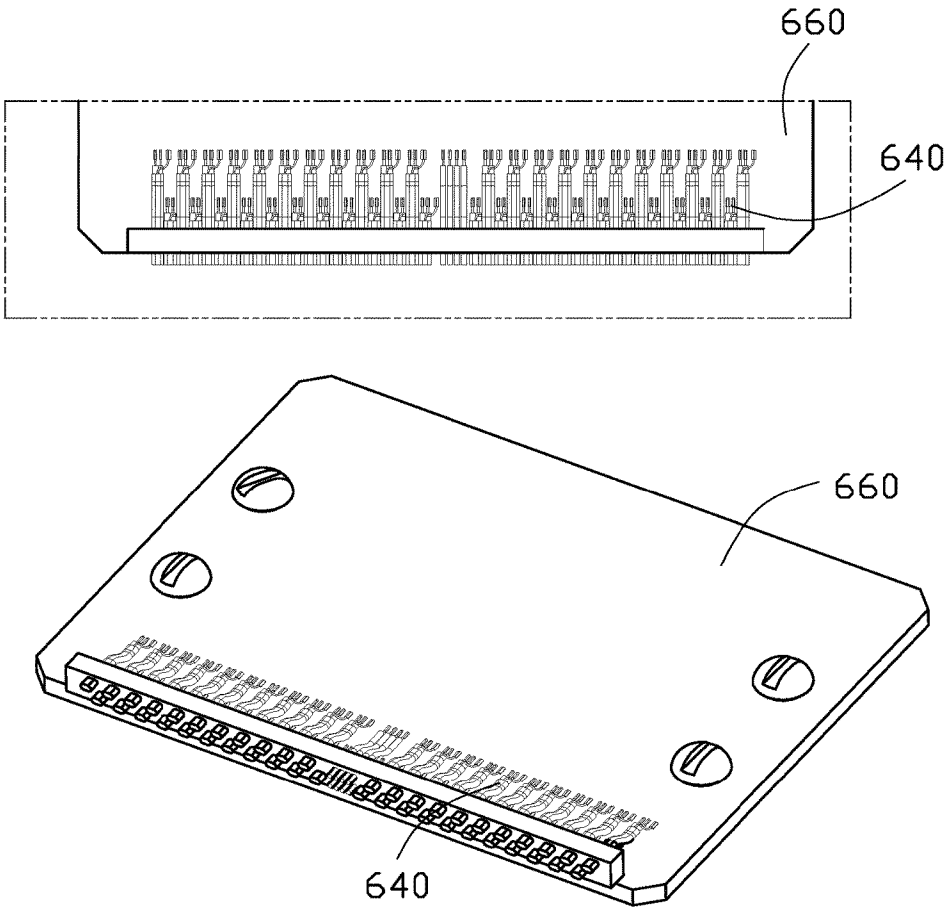
FIG. 40 shows the connection between the cable and the module card of FIG. 22(A)

The second connector 650 is essentially a wire organizer to have the corresponding wires of the cable 640 extend therethrough at the different levels and positions for properly soldering to the module card 660 as shown in FIG. 40.

Figure 41A:
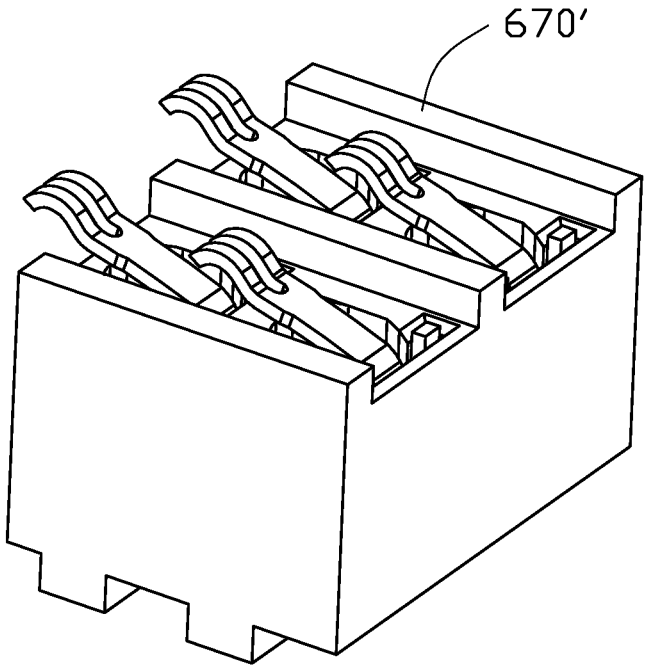
FIG. 41(A) is a perspective view of the alternate LGA interposer socket.
Figure 41B:
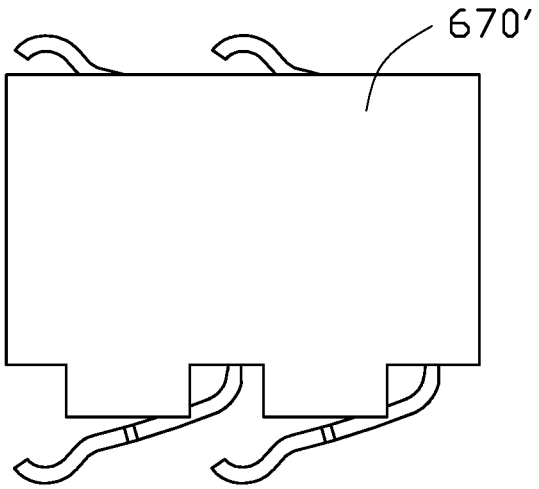
FIG. 41(B) is a side view of the alternate LGA interposer socket of FIG. 38(A)
Figure 42:
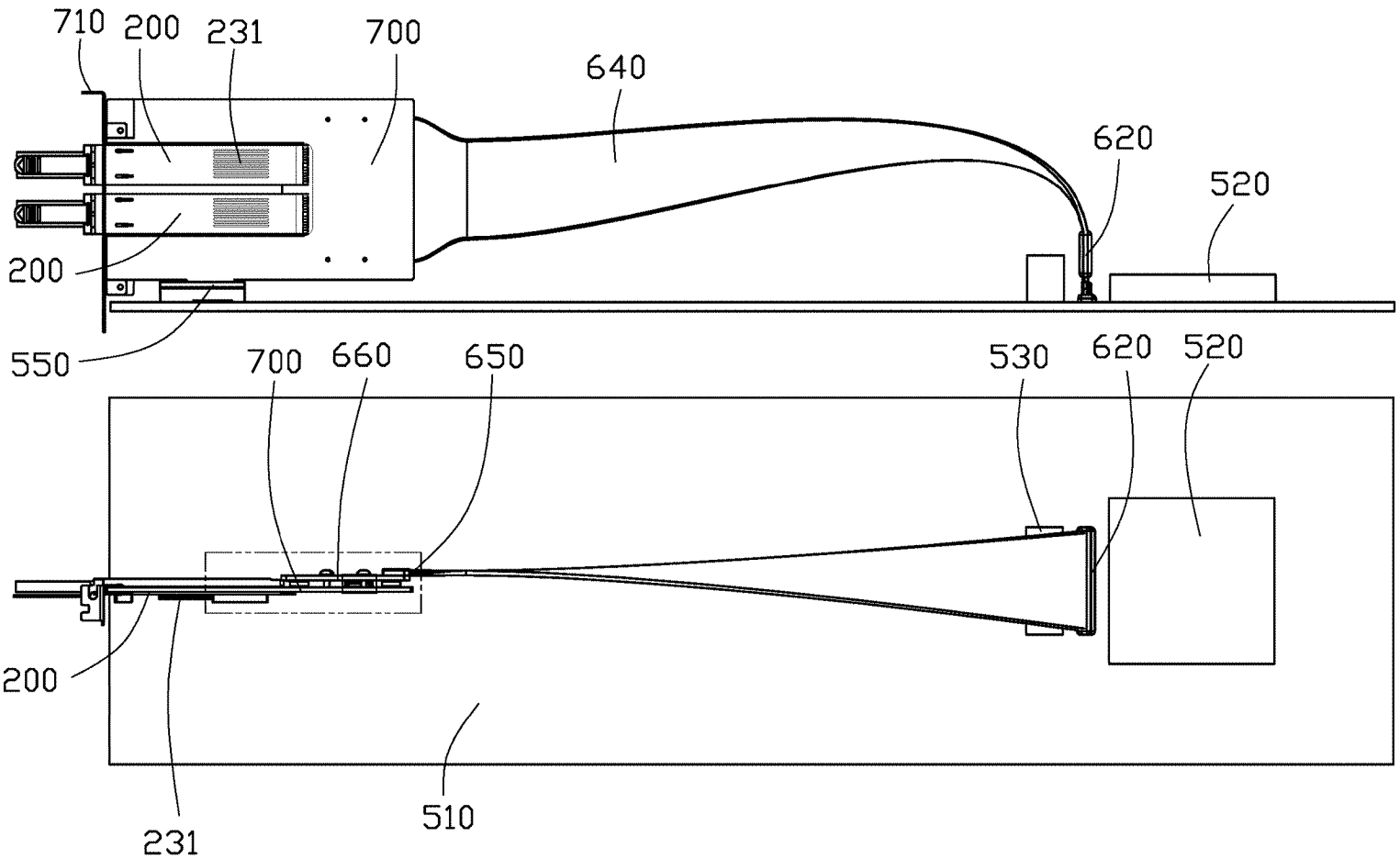
FIG. 42 shows the basis arrangement of the connection system of FIG. 22(A)
Figure 43:
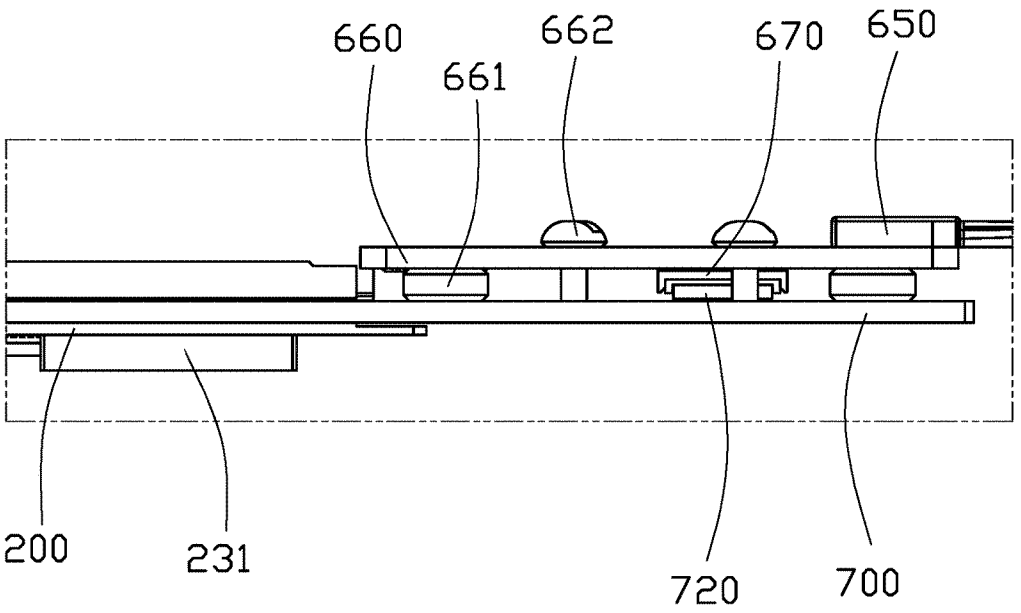
FIG. 43 is a partially enlarged view of the connection between the module card and the add-on card of FIG. 22(A), similar to FIG. 34.
Figure 44:
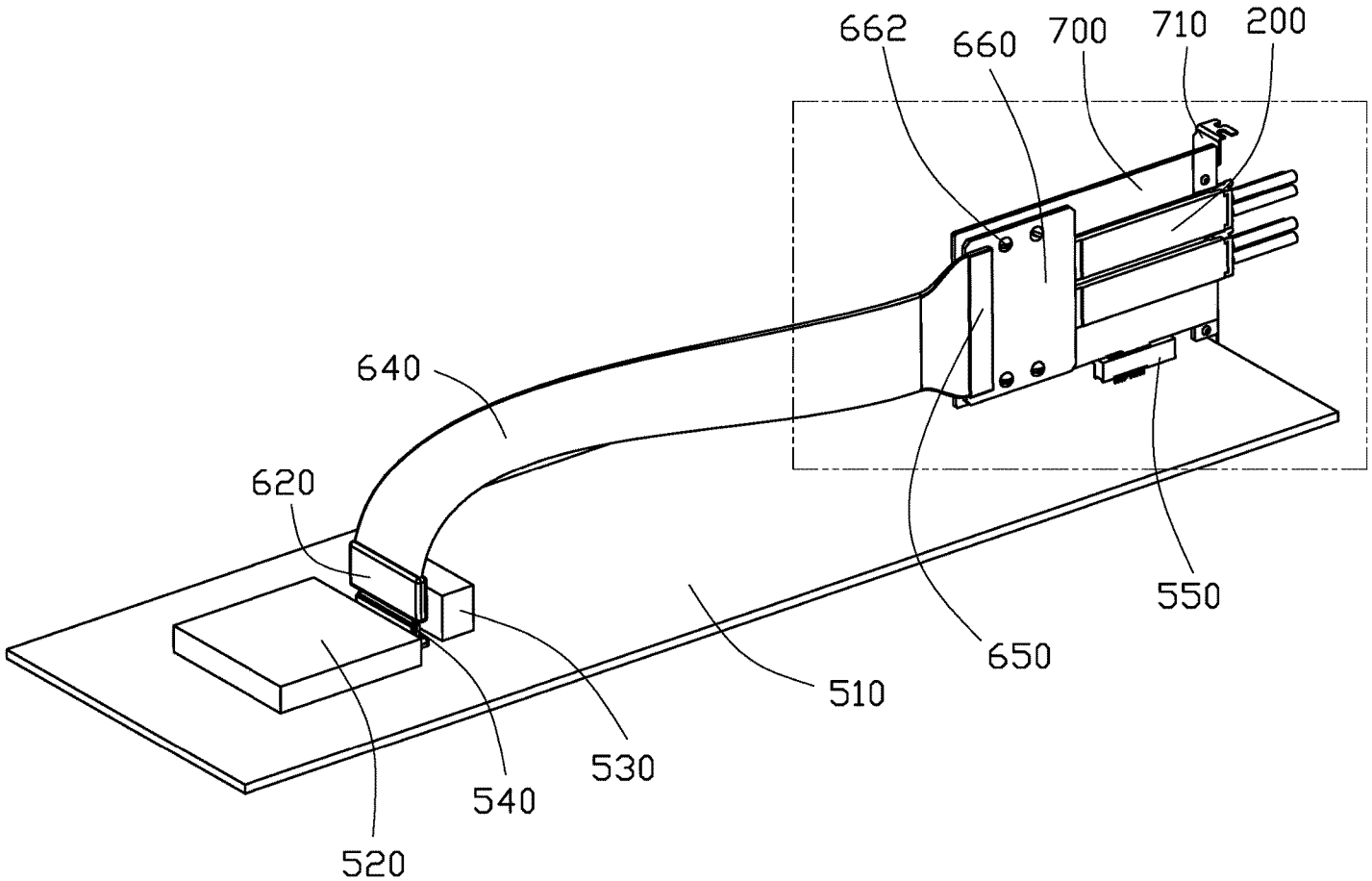
FIG. 44 is a perspective view of the connection system of FIG. 22(A).

An add-on card 700 stands above the main printed circuit board 510 with a bottom mating edge 702 received within the card edge connector 550 and with a front edge connected to a metallic bracket 710 via screws 712 wherein the bracket 710 is assembled to a back panel of a computer case as what the conventional add-on card is located. Specifically referring to FIG. 33, the card edge connector 550 includes an insulative housing 552 forming a receiving slot 554, and a plurality of terminals 556 with contacting section extending into the receiving slot 554. The module card 660 is assembled to the add-on card 700 via rivets 662 in a parallel manner with a plurality of spacers 661 sandwiched therebetween. An connector device is sandwiched between the add-on card 700 and the module card 660. Such connector device can be a first BGA connector 670 on the module card 660, and a second BGA connector 720 mounted upon the add-on card 700 to mate with each other for establishing electrical connection between the module card 660 and the add-on card 700, as shown in FIGS. 25-25(A), FIG. 38 and FIG. 43. Alternately, an LGA interposer connector 670' as shown in FIGS. 41(A)-41(B) may replace the BGA connectors 670 and 720. In this embodiment, the receptacle connector 100 is mounted upon the module card 660, and the add-on card 700 forms a cutout 730 to receive the receptacle connector 100 and the corresponding plug connector 200 therein as shown in FIGS. 22(A)-24(B), 34-35(A) and 43-44.

FIGS. 30(A)-32(B) and 39 show another embodiment in which the module card 660 is omitted and the jumper cable 640 is directly mounted upon the add-on card 800 via the connector 650' at the end of the jumper cable 640 and another connector 810 on the add-on card 800. On the other hand, no cutout is formed in the main printed circuit board 800 so the receptacle connector 100 is directly mounted upon the main printed circuit board 800 and the corresponding plug connector 200 extends in a spaced manner with the plane defined by the main printed circuit board 800. The corresponding bracket 710' forms a notch to allow the corresponding cable 250 to extend therethrough. Similar to the previous embodiment, the add-on card 800 forms a bottom mating edge 820 received within the card edge connector 550. FIG. 40 shows the RX differential pairs in the front row and the TX differential pairs in the rear row are commonly soldered upon each surface of the module card 660. Understandably, such arrangement may be applied to the internal printed circuit board 210.

What is claimed is:

1. An electrical connection system comprising:

a main printed circuit board defining opposite first and second regions;

a CPU (central Processing Unit) mounted on the first region;

an add-on card mounted on the second region;

a jumper cable connected between the first region and the second region;

a receptacle connector mounted around the add-on card; and a plug cable connector mated with the receptacle connector, wherein the jumper cable is connected to the add-on card via a module card on which the receptacle connector is mounted, and the add-on card forms a cutout in which the receptacle connector and the plug cable connector are received.

2. The electrical connection system as claimed in claim 1, wherein the add-on card is electrically and mechanically connected to the main printed circuit board via a card edge connector which is mounted upon the second region.

3. The electrical connection system as claimed in claim 1, wherein said add-on card is fastened to a metallic bracket which is adapted to be mounted to a back panel of a computer case, and said bracket forms a notch to have the plug cable connector extend therethrough.

4. An electrical connection system comprising:

a main printed circuit board defining opposite first and second regions;

a CPU (central Processing Unit) mounted on the first region;

an add-on card mounted on the second region;

a jumper cable electrically and mechanically connected between the first region and the second region;

a receptacle connector mounted around the add-on card; and a plug cable connector mated with the receptacle connector, the plug cable connector including:

an internal printed circuit board defining opposite mating and connecting regions in a front-to-back direction, and opposite first and second mounting surfaces in a vertical direction perpendicular to said front-to-back direction;

a contact module located on the mating region;

a cable located behind the internal printed circuit board with therein a plurality of TX differential pairs soldered upon the internal printed circuit board, and a plurality of RX differential pairs soldered upon the internal printed circuit board; and a wire organizer defining through holes to have the corresponding TX and RX differential pairs extend therethrough at least either located at different levels in the vertical direction or soldered in different positions in the front-to-back direction.

5. The electrical connection system as claimed in claim 4, further comprising a thermal conductive cover defining a space receiving the internal printed circuit board therein.

6. The electrical connection system as claimed in claim 5, further comprising an electronic component mounted on the internal printed circuit board, and a thermal interface material contacting an inner surface of the thermal conductive cover and sandwiched between the thermal conductive cover and the electronic component in a vertical direction.

7. The electrical connection system as claimed in claim 5, wherein the thermal conductive cover comprises a fin structure.

8. The electrical connection system as claimed in claim 7, wherein the thermal conductive cover comprises a top cover and a bottom cover assembled together to form the space, the fin structure formed on the top cover.

9. The electrical connection system as claimed in claim 4, wherein the TX differential pairs are arranged in front and rear rows, and the RX differential pairs are arranged in front and rear rows.

10. The electrical connection system as claimed in claim 9, wherein the wire organizer comprises a middle part with upper and lower rows of holes, an upper part with one row of holes, and a lower part with one row of holes.

11. The electrical connection system as claimed in claim 10, wherein the TX differential pairs in the front row extend through the corresponding holes of the upper part, and the TX differential pairs in the rear row extend through the corresponding holes in the upper row of the middle part, and the RX differential pairs in the front row extend through the corresponding holes of the lower part, and the RX differential pairs in the rear row extend through the corresponding holes in the lower row of the middle part.

12. The electrical connection system as claimed in claim 10, wherein the middle part forms retaining holes to receive the corresponding retaining posts on the upper part and the lower part.

13. The electrical connection system as claimed in claim 10, wherein each of the upper part, the middle part and the lower part forms a groove for receiving glue therein.

14. The electrical connection system as claimed in claim 9, wherein the TX differential pairs arranged in front row are offset with the TX differential pairs arranged in the rear row along transverse direction, and the RX differential pairs arranged in front row are offset with the RX differential pairs arranged in the rear row along transverse direction.

15. The electrical connection system as claimed in claim 4, wherein the TX differential pairs and the RX differential pairs are located on a same surface of the internal printed circuit board while being located at said different levels in the vertical direction and soldered in said different positions in the front-to-back direction.

16. The electrical connection system as claimed in claim 4, wherein corresponding soldering areas of said TX differential pairs and said RX differential pairs are arranged in opposite front and rear rows in said front-to-back direction, a rear glue protection in the rear row is applied upon the internal printed circuit board after the corresponding TX differential pairs or RX differential pairs in the rear row are soldered upon the internal printed circuit board while before the corresponding TX differential pairs or RX differential pairs in the front row area are soldered upon the internal printed circuit board, and a front glue protection in the front row is applied upon the internal printed circuit board after the corresponding TX differential pairs or RX differential pairs in the front row are soldered upon the internal printed circuit board.

17. The electrical connection system as claimed in claim 4, wherein all said TX differential pairs are located on one surface of the internal printed circuit board while all said RX differential pairs are located on the other surface of the internal printed circuit board, and soldering areas of all said TX differential pairs are arranged in both front and rear rows and those of all said RX differential pairs are arranged in both front and rear rows.

18. The electrical connection system as claimed in claim 4, wherein the jumper cable is connected to the add-on card via a module card on which the receptacle connector is mounted.

19. An electrical connection system comprising:

a main printed circuit board defining opposite first and second regions;

a CPU (Central Processing Unit) mounted on the first region;

an add-on card mounted on the second region;

a jumper cable connected between the first region and the second region;

a receptacle connector mounted around the add-on card; and a plug cable connector mated with the receptacle connector, wherein the plug cable connector and the jumper cable are physically separated from each other and electrically connected with each other via the receptacle connector.

20. The electrical connection system as claimed in claim 19, wherein the plug cable connector extends through a notch formed on a metallic bracket to which the add-on card is fastened.

* * * * *